US010621831B2

(12) United States Patent
Okamoto et al.

(10) Patent No.: US 10,621,831 B2
(45) Date of Patent: Apr. 14, 2020

(54) MEDIUM PROCESSING DEVICE AND MEDIUM TRANSACTION DEVICE

(71) Applicant: Oki Electric Industry Co., Ltd., Tokyo (JP)

(72) Inventors: Masaaki Okamoto, Tokyo (JP); Atsushi Takada, Tokyo (JP); Kazuhiro Hosokawa, Tokyo (JP); Wataru Wakushima, Tokyo (JP); Yuuji Oota, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/777,793

(22) PCT Filed: Dec. 20, 2016

(86) PCT No.: PCT/JP2016/087997
§ 371 (c)(1),
(2) Date: May 21, 2018

(87) PCT Pub. No.: WO2017/110833
PCT Pub. Date: Jun. 29, 2017

(65) Prior Publication Data

US 2018/0374317 A1 Dec. 27, 2018

(30) Foreign Application Priority Data

Dec. 22, 2015 (JP) ..... 2015-250028

(51) Int. Cl.
*G07F 19/00* (2006.01)
*B65H 1/26* (2006.01)

(52) U.S. Cl.
CPC ..... *G07F 19/202* (2013.01); *B65H 1/266* (2013.01); *G07F 19/203* (2013.01); *G07F 19/205* (2013.01); *B65H 2701/1912* (2013.01)

(58) Field of Classification Search
CPC ..... B65H 1/266; B65H 2701/1912; G07F 19/202; G07F 19/203; G07F 19/205; G07F 11/10; G07F 11/12; G07F 11/40
See application file for complete search history.

(56) References Cited

U.S. PATENT DOCUMENTS 4,638,746 A * 1/1987 Ishigure ..... B65H 31/06 109/52
2008/0007146 A1 1/2008 Hillman
(Continued)

FOREIGN PATENT DOCUMENTS

CN 102656611 A 9/2012
JP 2003-146448 A 5/2003
(Continued)

*Primary Examiner* — Mark J Beauchaine
(74) *Attorney, Agent, or Firm* — Rabin & Berdo, P.C.

(57) ABSTRACT

A medium processing device including a storage cassette, a casing, a loading section, a slide rail, and a connector is provided. The storage cassette is configured to store a medium. The casing includes an internal space to house the storage cassette inside. The loading section supports the storage cassette when the storage cassette is in a loaded state in a loading space having an open bottom section. The slide rail is attached to the casing and to the loading section, and lets the loading section move between the internal space of the casing and outside. The connector is provided inside the loading space of the loading section, and electrically connects to the storage cassette in a loaded state of the storage cassette in the loading space.

20 Claims, 43 Drawing Sheets

(56) References Cited

U.S. PATENT DOCUMENTS

| | | | | |
|---|---|---|---|---|
| 2012/0255829 | A1 | 10/2012 | Togiya | |
| 2014/0217669 | A1 | 8/2014 | Aoji et al. | |
| 2016/0364958 | A1* | 12/2016 | Jones | G07F 19/205 |

FOREIGN PATENT DOCUMENTS

| | | | |
|---|---|---|---|
| JP | 2011-118699 | A | 6/2011 |
| JP | 2012-247932 | A | 12/2012 |
| WO | WO-2013/061379 | A1 | 5/2013 |

* cited by examiner

MEDIUM PROCESSING DEVICE AND MEDIUM TRANSACTION DEVICE

TECHNICAL FIELD

The present disclosure relates to a medium processing device and to a medium transaction device, and, for example, is applicable to an automated teller machine handing banknotes as a medium.

BACKGROUND ART

Hitherto, automated teller machines employed in financial institutions and the like have, for example, let a customer pay-in cash such as banknotes and coins and have paid-out cash to the customer, according to the content of a transaction with the customer.

There are proposals for automated teller machines that, for example, include a pay-in/pay-out section for giving banknotes to or receiving banknotes from a customer, a classification section for classifying the denomination of inserted banknotes and classifying authenticity, damage etc. of banknotes, a temporary holding section for temporarily for holding inserted banknotes, and storage cassettes for storing banknotes according to denomination.

In a pay-in transaction with such an automated teller machine, when a customer inserts banknotes into a banknote pay-in/pay-out port, the inserted banknotes are classified by the classification section. Banknotes that are classified as being normal banknotes are held in the temporary holding section, and banknotes classified as unsuitable for transaction are returned to the banknote pay-in/pay-out port for handing back to the customer. Subsequently, when the automated teller machine has confirmed the pay-in amount via operational instructions by the customer, the banknotes held in the temporary holding section are re-classified for denomination by the classification section, and then stored in a storage cassette corresponding to this denomination.

Moreover, among such automated teller machines, in order to raise the efficiency of operations such as operations to replenish banknotes in the storage cassettes and operations to recover banknotes from these storage cassettes, there are also automated teller machine provided with a cassette loading section that includes plural slots. Such a configuration enables one-at-a-time loading or removal of storage cassettes at each of the slots in the cassette loading section.

There is also a proposal to, for example, configure such a cassette loading section so as to be movable in a front-rear direction with respect to a casing of the automated teller machine by using slide rails (see, for example, Japanese Patent Application Laid-Open (JP-A) No. 2011-118699 (FIG. 1) (Patent Document 1). Such a cassette loading section is housed inside a casing when the automated teller machine is in-action to perform each type of transaction, and the cassette loading section is pulled outside the casing for maintenance work or the like. The storage cassettes can then be loaded into or removed from each of the slots of the cassette loading section in this pulled-out state.

SUMMARY OF INVENTION

Technical Problem

However, the automated teller machine according to such a configuration incorporates various types of mechanism in each of the storage cassettes to store or to feed out banknotes out, and there are, for example, several thousand banknotes stored in each of the storage cassettes. This means that the total weight for each of the banknote cassettes becomes extremely high, for example, from 30 to 40 kg.

There is accordingly a need to employ strong slide rails in the cassette loading section in order to support such a large weight. However, when such strong slide rails are employed, there is a problem in that the configuration becomes more bulky and also more complex in order to secure strength etc., than when general purpose slide rails are employed.

In consideration of the above circumstances, the present disclosure proposes a medium processing device and a medium transaction device enabling a simplified configuration.

Solution to Problem

In consideration of the above circumstances, a medium processing device of an embodiment of the present invention includes a storage cassette, a casing, a loading section, a slide rail, and a connector. The storage cassette is configured to store a medium. The casing includes an internal space to house the storage cassette inside. The loading section supports the storage cassette when the storage cassette is in a loaded state in a loading space having an open bottom section. The slide rail is attached to the casing and to the loading section, and lets the loading section move between the internal space of the casing and outside. The connector is provided inside the loading space of the loading section, and electrically connects to the storage cassette in a loaded state of the storage cassette in the loading space.

A medium transaction device of an embodiment of the present invention includes a storage cassette, a casing, a loading section, a slide rail, and a connector. The storage cassette is configured to internally store a medium to be transacted with a user or a transacted medium. The casing includes an internal space to house the storage cassette inside. The loading section supports the storage cassette when the storage cassette is in a loaded state in a loading space having an open bottom section. The slide rail is attached to the casing and to the loading section, and lets the loading section move between the internal space of the casing and outside. The connector is provided inside the loading space of the loading section, and electrically connects to the storage cassette in a loaded state of the storage cassette in the loading space.

In the medium transaction device of the embodiment of the present invention, due to the bottom section of the loading space being open, the number of members can be reduced in the loading section that is moved between inside and outside the casing using the slide rail, compared to cases in which the bottom section is closed. In addition thereto, due to the connector, which is not able to be provided to the bottom section of the loading section in the present invention, being providing inside the loading space, there is no need to dispose a connector at the outside of the casing on the storage cassette side. This enables the storage cassette to be contained within a simple shape, such as a cuboidal shape, for example.

These embodiment of the present invention accordingly enable a medium processing device and a medium transaction device to be realized with a simplified configuration.

DESCRIPTION OF EMBODIMENTS

Explanation follows regarding embodiments to implement the invention (referred to below as exemplary embodiments), with reference to the drawings.

Figure 1:
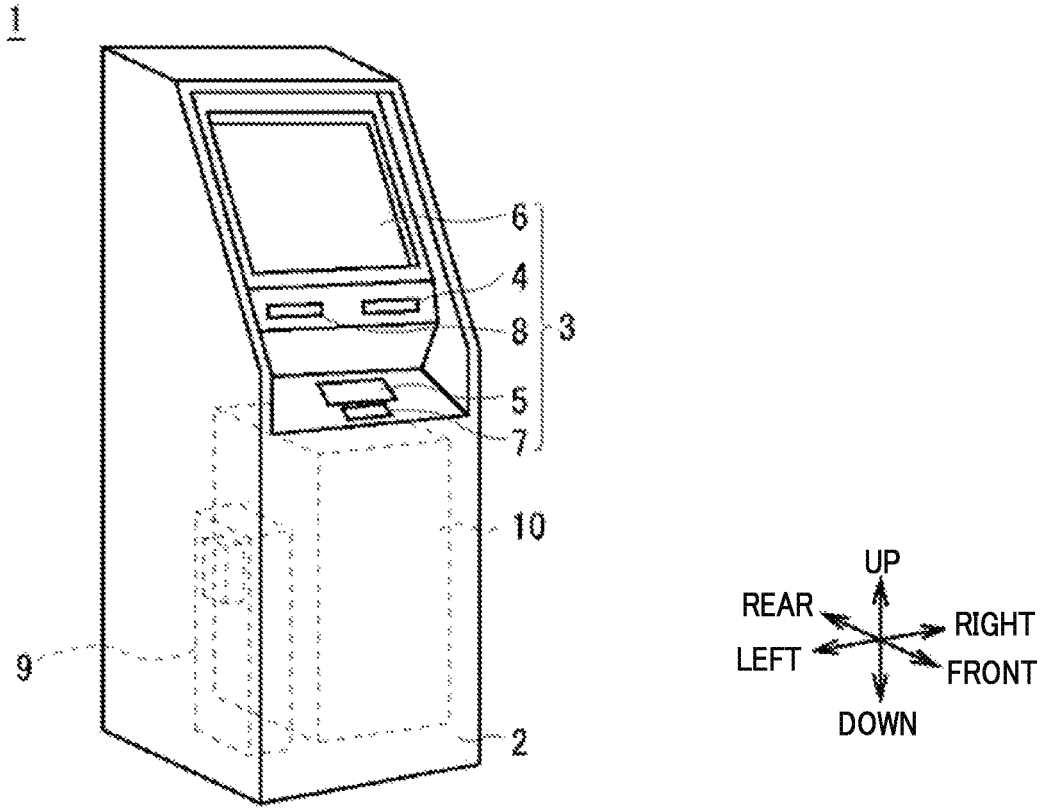
FIG. 1 is a schematic perspective view illustrating a configuration of an automated teller machine.

1. Automated Teller Machine and Banknote Pay-In/Pay-Out Machine Configuration As illustrated in FIG. 1, an automated teller machine 1 is configured around a box shaped casing 2 and is installed, for example, in a financial institution or the like to perform transactions related to cash, such as paying-in and paying-out, with a user (namely, with a customer of the financial institution).

The casing 2 is provided with a customer interface section 3 at a location on the casing 2 where it is easy for a customer standing at the front side of the casing 2 to insert banknotes, operate a touch panel, etc. The customer interface section 3 performs direct transfer of, for example, cash and cards, etc. to and from the customer, and also notifies the customer of information related to transactions and receives operational instructions from the customer. The customer interface section 3 is provided with a card input/output port 4, a pay-in/pay-out port 5, an operation and display section 6, a ten key 7, and a receipt issuing port 8.

The card input/output port 4 is a section which various cards, such as cash cards, are inserted into or dispensed from. A card processing section (not illustrated in the drawings) for reading bank account numbers etc. magnetically recorded on the various cards is provided behind the card input/output port 4. Banknotes to be paid in by a customer are inserted into the pay-in/pay-out port 5, and banknotes are dispensed to the customer from the pay-in/pay-out port 5. Driving a shutter opens or closes the pay-in/pay-out port 5. Banknotes are, for example, formed in a paper sheet shape from rectangular shaped paper.

The operation and display section 6 is a touch panel that integrates a liquid crystal display (LCD) for displaying operation screens during a transaction, to touch sensors for selecting a type of transaction, and for entering a PIN number, a transaction amount, and the like. The ten key 7 is physical keys, to receive entry of numbers from "0" to "9", employed during entry operations of PIN numbers, transaction amounts, and the like. The receipt issuing port 8 is a section that issues receipts printed with transaction content or the like at the end of transaction processing. A receipt processing section (not illustrated in the drawings) is provided behind the receipt issuing port 8 to print transaction content or the like on the receipt.

In the following explanation, the side of the automated teller machine 1 the customer is facing is defined as the front side, the opposite side thereto is defined as the rear side, the left and right as viewed by the customer facing the front side are defined as a left side and a right side, respectively, and an upper side and a lower side are also defined.

A main controller 9 to perform overall control of the automated teller machine 1, and a banknote pay-in/pay-out machine 10 to perform various processing related to banknotes, are provided inside the casing 2. The main controller 9 is configured around a non-illustrated central processing unit (CPU). Various processing related to pay-in transactions and pay-out transactions is performed by the CPU reading and executing predetermined programs from non-illustrated read only memory (ROM), flash memory, or the like. The main controller 9 includes internal random access memory (RAM), and a storage section configured by a hard disk drive, flash memory, or the like. Various information is stored on the storage section.

Figure 2:
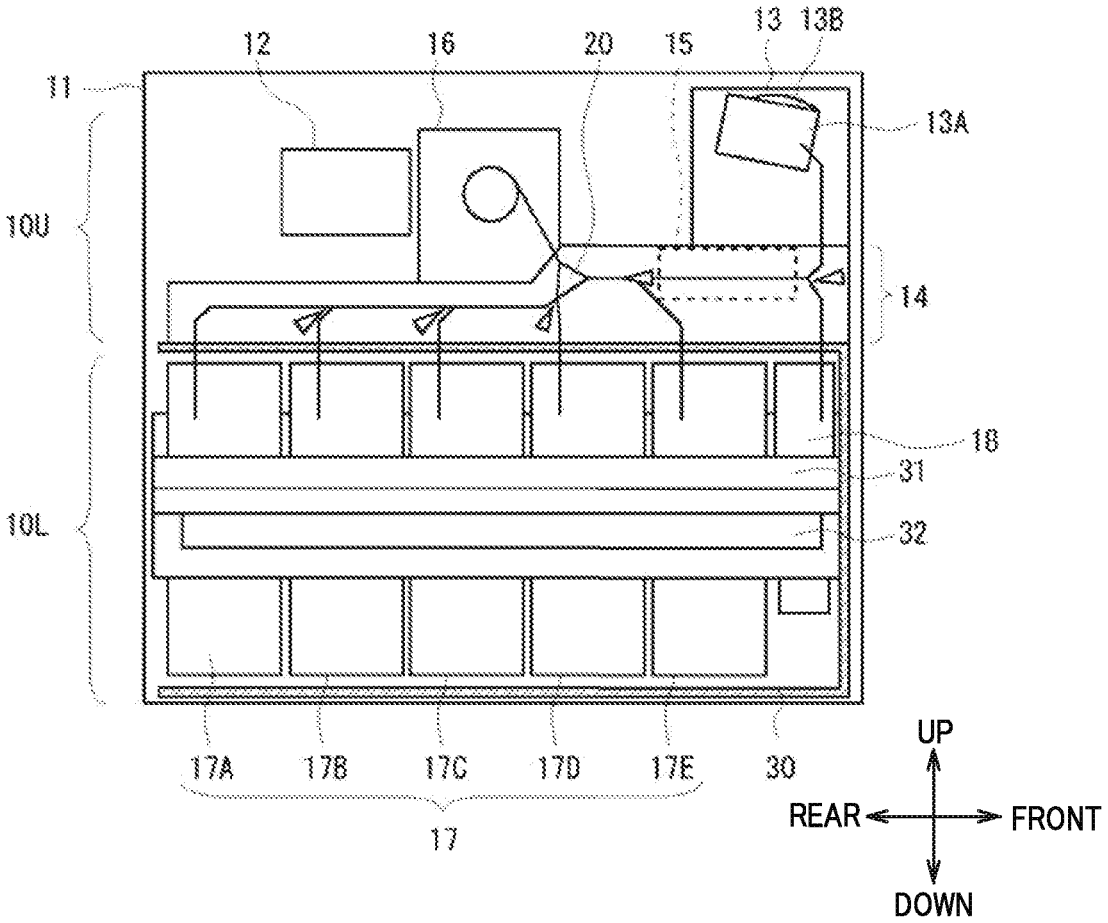
FIG. 2 is a schematic diagram illustrating a configuration of a banknote pay-in/pay-out machine.

As illustrated in side view in FIG. 2, the banknote pay-in/pay-out machine 10 includes plural sections to perform various processing related to banknotes as a medium, with these sections incorporated inside a banknote pay-in/pay-out machine casing 11. The banknote pay-in/pay-out machine 10 is configured with an upper unit 10U occupying part of the banknote pay-in/pay-out machine casing 11 at the upper side of a substantially central position in the up-down direction, and a lower unit 10L occupying part of the banknote pay-in/pay-out machine casing 11 below the substantially central position.

The upper unit 10U is provided with a banknote controller 12 to perform overall control, a pay-in/pay-out section 13 to pass banknotes out to a customer and receive banknotes in from a customer, a conveyance section 14 to convey banknotes to each section, a classification section 15 to classify banknotes, and a temporary holding section 16 to temporarily store banknotes. The lower unit 10L is provided with five banknote cassettes 17 (17A, 17B, 17C, 17D, and 17E) and a reject cassette 18, arrayed in this sequence from the rear side to the front side.

The banknote controller 12 is configured with a non-illustrated CPU, and a storage section configured from ROM, RAM, and flash memory, or the like. The CPU performs various processing by reading and executing various programs from the storage section. Various programs, such as, in addition to a basic operating program, a pay-in count program, a pay-in storage program, and a pay-out program, are stored on the non-volatile ROM and flash memory in the storage section. The non-volatile RAM in the storage section is used as a work area for the CPU, and also temporarily stores various information. For example, the banknote controller 12 executes pay-in transaction processing to perform a pay-in transaction with a customer by reading the pay-in count program from the storage section, and executing this program in the CPU.

The pay-in/pay-out section 13 (FIG. 2) is positioned in a front upper portion inside the upper unit 10U. The pay-in/pay-out section 13 includes inside a container 13A to accommodate banknotes received from a customer and banknotes to be passed to a customer. The container 13A is opened or closed from above by a shutter 13B. The container 13A is able to accommodate a maximum of about 200 banknotes. The shutter 13B opens or closes in lock step with a shutter of the pay-in/pay-out port 5 (FIG. 1) provided to the casing 2.

In the pay-in/pay-out section 13, when banknotes have been inserted into the container 13A by a customer during a pay-in transaction or the like, the shutter 13B is closed 3, and then the banknotes inside the container 13A are separated one-by-one, and sequentially delivered to the conveyance section 14. The pay-in/pay-out section 13 sequentially receives banknotes conveyed in by the conveyance section 14 during a pay-out transaction or the like. After the banknotes have been sequentially discharged into the container 13A and stacked therein, the shutter 13B is opened to let the customer take the banknotes.

The conveyance section 14 is positioned at a lower end portion inside the upper unit 10U, and, as a whole, has a shape elongated along the front-rear direction and thin in the up-down direction. A conveyance guide to guide banknotes and multiple rotating rollers etc. are disposed as appropriate to mainly form a straight line conveyance path inside the conveyance section 14 to convey banknotes in the front-rear direction, with the short side of the banknotes aligned along the direction of travel.

Figure 3:
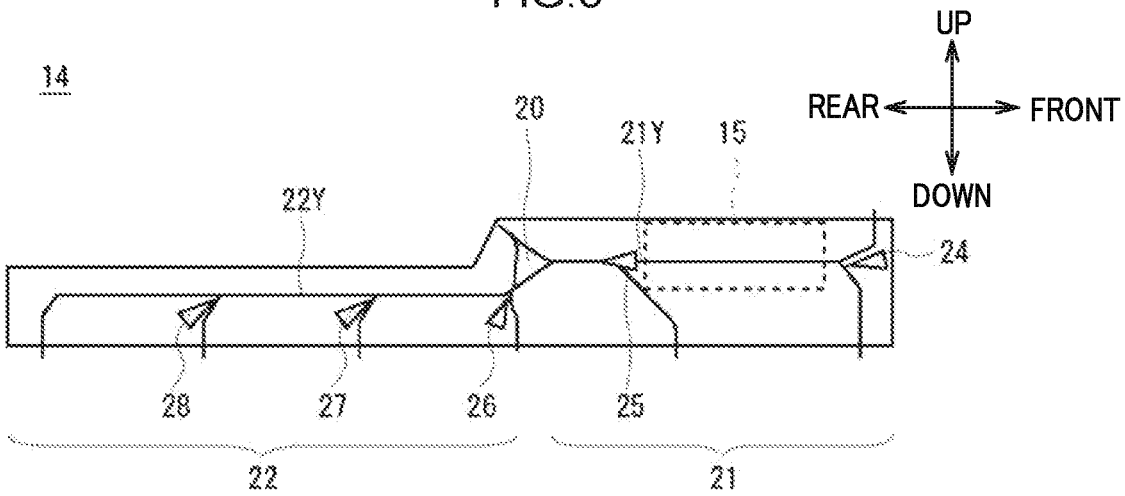
FIG. 3 is a schematic diagram illustrating a configuration of a conveyance section.

As illustrated in the enlarged diagram of FIG. 3, the conveyance section 14 has a configuration broadly divided into a temporary holding switching section 20 disposed in the vicinity of the center of the conveyance section 14, and a front conveyance section 21 and a rear conveyance section 22, respectively disposed at the front side and rear side of the temporary holding switching section 20. The temporary holding switching section 20 is configured by what is referred to as a three-way switch, and switches the banknote conveyance path three-ways under control of the banknote controller 12, so as to convey the banknotes between the front conveyance section 21, the rear conveyance section 22 and the temporary holding section 16.

There are also plural switching sections other than the temporary holding switching section 20 disposed inside the conveyance section 14. Each of the switching sections is configured by swingable blades (illustrated by triangles in the drawings) and plural rotatable rollers (not illustrated in the drawings) disposed at the periphery of the blades. Under control of the banknote controller 12, the switching sections change the inclination direction of the blades and rotate each of the rollers in a predetermined rotation direction according to the conveyance destination of each of the banknotes. The conveyance direction of the banknotes is thereby switch as appropriate, and the banknotes conveyed to the desired conveyance destination.

A reject switching section 24, the classification section 15, and a switching section 25 are disposed inside the front conveyance section 21, in this sequence from the front, so as to form a front conveyance path 21Y. The front conveyance path 21Y has an approximately straight line shape overall along the front-rear direction. Under control of the banknote controller 12, the reject switching section 24 and the switching section 25 respectively switch the conveyance paths of banknotes as appropriate, so as to convey banknotes between the front conveyance path 21Y and the reject switching section 24, and between the front conveyance path 21Y and the banknote cassette 17A.

Switching sections 26, 27 and 28 are disposed in approximately a straight line inside the rear conveyance section 22, in this sequence from the front, so as to form a rear conveyance path 22Y. The rear conveyance path 22Y has an approximately straight line shape overall along the front-rear direction. Under control of the banknote controller 12, the switching sections 26 to 28 respectively switch the conveyance paths of banknotes as appropriate, so as to convey banknotes between the rear conveyance path 22Y and the banknote cassettes 17B, 17C, 17D, or 17E. The front conveyance section 21 and the rear conveyance section 22 are also capable of accumulating several banknotes each on their respective conveyance paths.

The classification section 15 (see FIG. 2 and FIG. 3) is incorporated in the front conveyance section 21, and is positioned on the front conveyance path 21Y, between the pay-in/pay-out section 13 and the temporary holding switching section 20. Plural types of sensor, such as thickness sensors, imaging sensors, and magnetic sensors, are incorporated inside the classification section 15. Various information is read from each banknote by each of the sensors, and acquired information (referred to below as read information) is supplied to the banknote controller 12 (FIG. 2).

In response to this information, the banknote controller 12 determines the state of each of the banknotes, and decides whether the banknote is normal and receivable, or if the banknote is abnormal and should be returned to the user. More specifically, based on the obtained read information, the banknote controller 12 determines the conveyance state of each of the banknotes, the denomination and degree of damage thereof, and the authenticity of the banknote. The banknote controller 12 then decides on the conveyance destination for each of the banknotes based on these determination results, and controls the conveyance action in each of the switching sections and each of the conveyance paths in the conveyance section 14.

The temporary holding section 16 (FIG. 2) employs what is referred to as a tape escrow method, and temporarily accumulates the banknotes by wrapping the banknotes against a circumferential side face of a circular cylinder shaped drum, together with a tape, or feeds out the banknotes by peeling the tape away from the circumferential side face thereof.

The banknote cassettes 17 (17A to 17E) serving as storage cassettes are all similarly configured, and are formed in cuboid shapes long in the up-down direction. Each of the storage cassettes stacks and stores banknotes inside. Each of the banknote cassettes 17 has a pre-set denomination of banknote to be stored. Banknotes that are determined by the classification section 15 and the banknote controller 12 to have little damage and to be re-useable are conveyed by the conveyance section 14 to the banknote cassette 17 matching the banknote denomination. These banknotes are stacked and stored inside the banknote cassette 17. On receipt of an instruction from the banknote controller 12 to feed out banknotes, the banknote cassettes 17 separate and feed out the stacked banknotes one banknote at a time, and deliver the banknotes to the conveyance section 14.

The reject cassette 18 is formed in a cuboid shape long in the up-down direction, and includes an internal space inside for stacking and storing banknotes. The reject cassette 18 stores banknotes inside that have been determined by the classification section 15 and the banknote controller 12 to have a heavy degree of damage and to be unsuitable for re-use (referred to as reject banknotes) when such banknotes are conveyed in by the conveyance section 14.

2. Pay-In Processing and Pay-Out Processing

Explanation follows regarding pay-in processing and pay-out processing performed inside the banknote pay-in/pay-out machine 10 when a pay-in transaction and a pay-out transaction are performed by the automated teller machine 1 with a user (a customer of the financial institution). The pay-in processing will be explained as divided into a first stage of pay-in count processing and a later stage of pay-in storage processing.

2-1. Pay-In Count Processing

In pay-in processing, under control of the banknote controller 12, the banknote pay-in/pay-out machine 10 performs processing to count the number of banknotes while classifying banknotes that have just been paid in by denomination etc. The banknote pay-in/pay-out machine 10 then performs pay-in storage processing to convey the banknotes to the appropriate storage location, and to store the banknotes at the appropriate storage location.

Specifically, for example, on receiving an operational input by a customer through the operation and display section 6 (FIG. 1) to start pay-in processing, the banknote controller 12 starts the pay-in count processing, separates the banknotes that have been inserted into the pay-in/pay-out section 13 into single banknotes, and sequentially deliver the banknotes to the conveyance section 14 one at a time.

The conveyance section 14 uses the reject switching section 24 and the front conveyance section 21 to sequentially convey the banknotes received from the pay-in/pay-out section 13 rearwards. Each of the banknotes is sequentially classified by the classification section 15 while being transported rearwards along the front conveyance path 21Y. The banknotes are then sequentially delivered to the temporary holding switching section 20 at the rear side. When this is being performed, the classification section 15 sends obtained classification results to the banknote controller 12.

The banknote controller 12 determines the degree of damage and denomination, and authenticity, of each of the banknotes based on the acquired classification results. When the banknote was recognized as being a normal banknote, the banknote controller 12 then determines for each of the banknotes that the banknote is a pay-in acceptable banknote for which subsequent processing can proceed. Alternatively, when the banknote could not be recognized as a normal banknote, the banknote controller 12 determines that the banknote is a pay-in reject banknote that should for the time being be returned to the customer. Moreover, for the pay-in acceptable banknotes, the banknote controller 12 decides by denomination the respective final conveyance destination for normal and reusable banknotes in each of the banknote cassettes 17, and decides the final conveyance destination to be the reject cassette 18 for reject banknotes with a heavy degree of damage, and stores this decision.

The banknote controller 12 then, according to the banknote determination results, conveys the pay-in acceptable banknotes to the temporary holding section 16 and stores the banknotes therein by switching the conveyance destination of the banknotes using the temporary holding switching section 20. Alternatively, the banknote controller 12 transports pay-in reject banknotes into the rear conveyance section 22, and accumulates the banknotes in the rear conveyance path 22Y. Thus, when all of the banknotes have been taken in from the pay-in/pay-out section 13, the banknote controller 12 returns any pay-in reject banknotes accumulated in the rear conveyance path 22Y of the rear conveyance section 22 to the customer, for re-insertion as required.

On the other hand, if there are no pay-in reject banknotes accumulated in the rear conveyance path 22Y of the rear conveyance section 22, the banknote controller 12 ends the pay-in count processing. At this point in time, the banknote controller 12 computes the pay-in amount based on the denomination and total banknote counts for the banknotes taken in from the pay-in/pay-out section 13. The banknote controller 12 also displays a predetermined operation instruction screen on the operation and display section 6, to tell the customer this pay-in amount and to prompt the customer to select whether or not to continue with the pay-in processing. When instructed by the customer to stop the pay-in processing, the banknote controller 12 uses the conveyance section 14 to convey all of the banknotes being held in the temporary holding section 16 into the pay-in/pay-out section 13, for return to the customer.

In this manner, the banknote pay-in/pay-out machine 10 stores banknotes paid in by the customer in the temporary holding section 16 in the pay-in count processing.

2-2. Pay-In Storage Processing

The banknote controller 12 starts pay-in storage processing when instructed by the customer to continue with pay-in processing. Specifically, the banknote controller 12 first starts feed-out processing in the temporary holding section 16, sequentially feeds out the banknotes being stored (pay-in acceptable banknotes), and hands these banknotes over to the temporary holding switching section 20.

When doing so, the banknote controller 12 switches the banknote conveyance path using the temporary holding switching section 20 according to the conveyance destination for each of the banknotes as decided in the pay-in count processing. Specifically, if the banknote conveyance destination is the reject cassette 18 or the banknote cassette 17E, the temporary holding switching section 20 hands the banknote over to the front conveyance section 21. Moreover, if the banknote conveyance destination is a banknote cassette 17A to 16D, the temporary holding switching section 20 hands the banknote over to the rear conveyance section 22.

Furthermore, by appropriately controlling each of the switching sections of the front conveyance section 21 and the rear conveyance section 22 according to the conveyance destination of each of the banknotes, the banknote controller 12 classifies the normal reusable banknotes by denomination, and stores them in each of the banknote cassettes 17, or stores reject banknotes that are not reusable in the reject cassette 18.

In this manner, in the pay-in storage processing, the banknote pay-in/pay-out machine 10 conveys the banknotes that were being stored in the temporary holding section 16 to, and stores these banknotes in the banknote cassettes 17 or the reject cassette 18.

2-3. Pay-Out Processing

In pay-out processing, under control of the banknote controller 12, the banknote pay-in/pay-out machine 10 performs pay-out processing so as to pay-out banknotes having the denomination and number of banknotes according to the instructed amount. Explanation follows regarding a case in which banknotes that are being stored in the banknote cassettes 17A to 17D are paid out.

On receipt of a predetermined operational input from the customer through the operation and display section 6 (FIG. 1) that includes a pay-out amount, the banknote controller 12 decides on the denomination and number of banknotes according to the pay-out amount. Next, the banknote controller 12 sequentially feeds out banknotes being stored in each of the banknote cassettes 17 according to the decided denomination and number of banknotes, and sequentially hands these banknotes over to the conveyance section 14.

In the conveyance section 14, the state of transport of the banknotes as they travel forward is classified by the classification section 15 in the front conveyance section 21, and these classification results are sent to the banknote controller 12 (FIG. 2). The banknote controller 12 switches the reject switching section 24 according to the state of transport of the banknotes. The banknotes are transported to the pay-in/pay-out section 13 as long as there is no problem with the state of transport. However, when there is a problem with the state of conveyance, for example overlapping, then the banknotes are transported to the reject cassette 18 and respectively stored therein. Thus, when conveying of all of the banknotes to the pay-in/pay-out section 13 according to the pay-out amount has finished, the banknote controller 12 lets the customer take the banknotes.

3. Lower Unit Configuration

Peripheral side faces of the lower unit 10L are covered by a sturdy safe casing 30. The safe casing 30 has a cuboidal shaped internal space 30S formed at its interior. The rear face of the safe casing 30 is configured so as to be closed or opened using openable/closeable door (not illustrated in the drawings). Moreover, there are pass-through holes provided as appropriate in the upper face of the safe casing 30 for passing banknotes through, such that banknotes can be handed over between each of the conveyance paths of the conveyance section 14, and the banknote cassettes 17 or the reject cassette 18.

A lower frame 31 is provided inside the safe casing 30 to retain the five banknote cassettes 17 and the reject cassette 18. The lower frame 31, serving as a loading section, is attached to the safe casing 30 through side rails 32 that telescope in the front-rear direction, enabling the lower frame 31 to be moved in the front-rear direction. For ease of explanation, the front-rear direction will also be referred to below as the movement direction.

Figure 4:
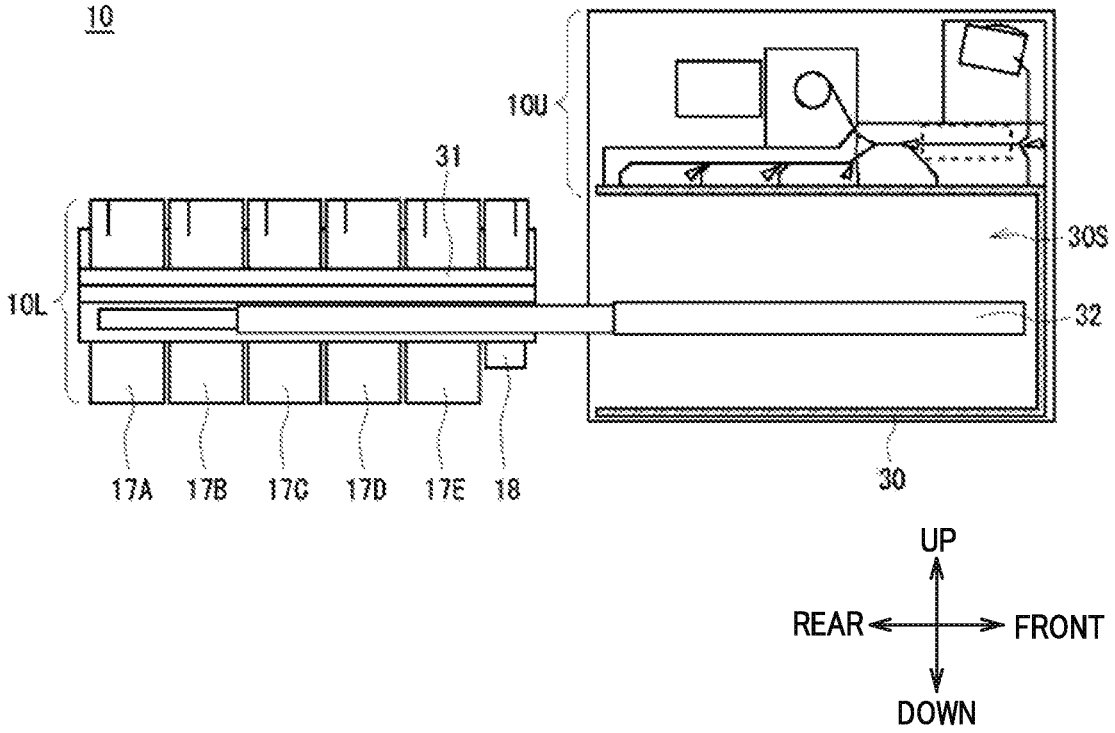
FIG. 4 is a schematic diagram illustrating a lower unit being pulled-out.

Thus when moved rearward from a state housed in the safe casing 30 (FIG. 2), the lower frame 31 adopts a rearward pulled-out state from the safe casing 30, as illustrated in FIG. 4. Moreover, the lower frame 31 returns again to the housed state (FIG. 2) when moved forward from the rearward pulled-out state.

Figure 5A:
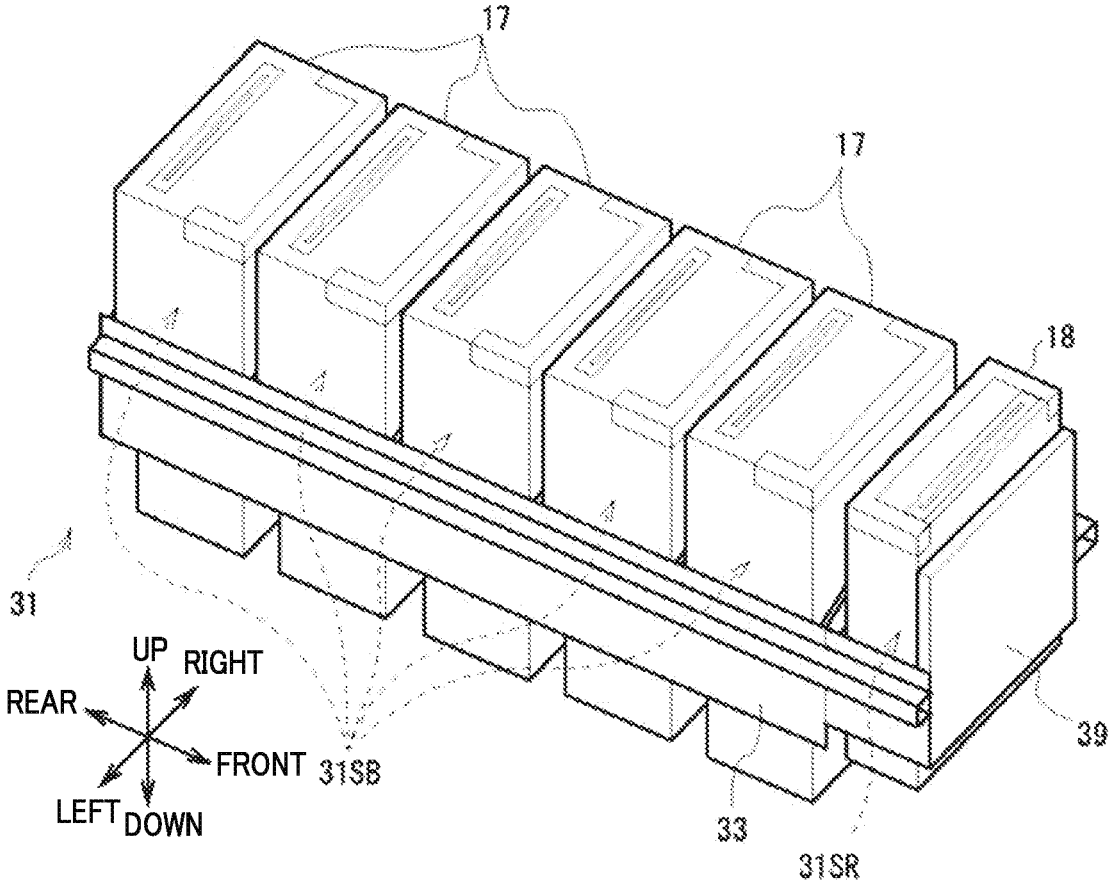
FIG. 5A is a schematic perspective view illustrating a configuration of a lower frame.
Figure 5B:
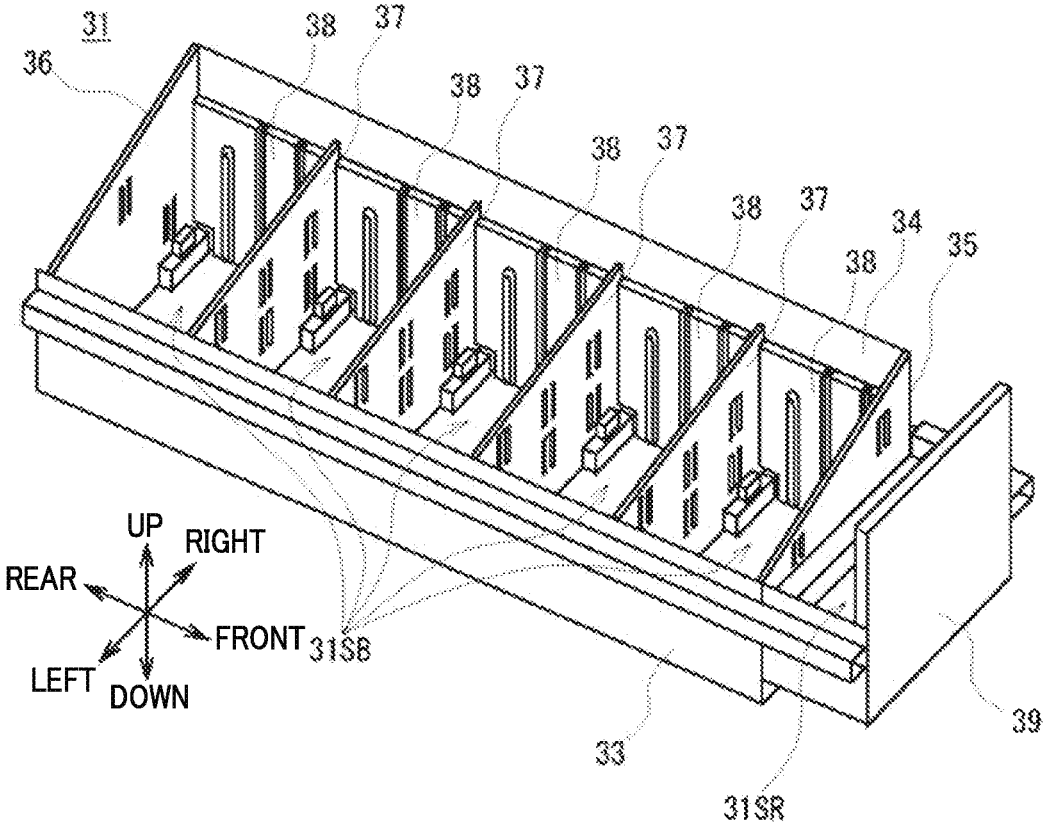
FIG. 5B is a schematic perspective view illustrating a configuration of a lower frame.

As illustrated in FIG. 5A and FIG. 5B, the lower frame 31 is formed such that five individual banknote cassette loading spaces 31SB for loading the banknote cassettes 17 into are arrayed along the front-rear direction. The lower frame 31 is also formed with a reject cassette loading space 31SR for loading the reject cassette 18 into disposed at the front side of the foremost-positioned banknote cassette loading space 31SB. The upper face and the lower face of each of the banknote cassette loading spaces 31SB and the reject cassette loading space 31SR (referred to below collectively as cassette loading spaces 31S) are both open.

The length of the lower frame 31 in the up-down direction is shorter than that of the banknote cassettes 17 and the reject cassette 18 (FIG. 5A). Thus in the lower frame 31, the banknote cassettes 17 and the reject cassette 18 are loaded into the respective cassette loading spaces 31S from above, and the lower frame 31 retains the banknote cassettes 17 and the reject cassette 18 in a state sticking out above and below.

Figure 6:
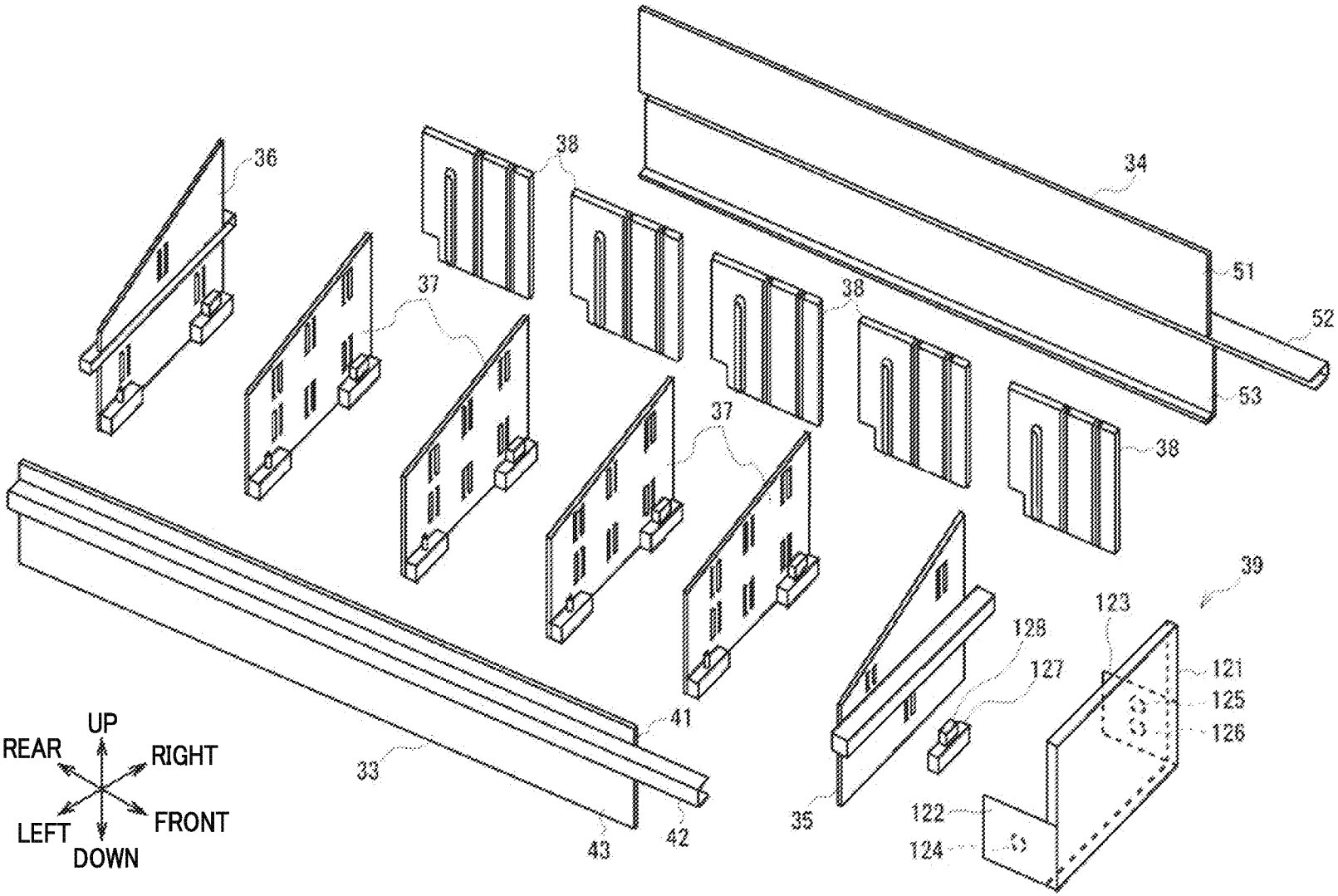
FIG. 6 is a schematic exploded perspective view illustrating configuration components of a lower frame.

As illustrated in the schematic exploded perspective view of FIG. 6, the lower frame 31 is configured such that the periphery of the five banknote cassette loading spaces 31SB is, as a whole, surrounded by a left side plate 33, a right side plate 34, a front side plate 35, and a rear side plate 36. Four divider plates 37 are disposed at even intervals between the front side plate 35 and the rear side plate 36. The left and right ends of each of the divider plates 37 are each fixed to the left side plate 33 and the right side plate 34, respectively.

Namely, a space long in the front-rear direction is formed in the lower frame 31 the by the left side plate 33, the right side plate 34, the front side plate 35, and the rear side plate 36. This space is divided by the four divider plates 37 into the five banknote cassette loading spaces 31SB.

Right internal side plates 38 are attached to the left side of the right side plate 34, namely, at right side face portions within each of the respective banknote cassette loading spaces 31SB. Furthermore, a reject loading section 39 to form a reject cassette loading space 31SR is provided at the front side of the front side plate 35.

In the lower frame 31, the upper edge of the left side plate 33 is lower than at the upper edge of the right side plate 34. This is because it is anticipated that an operator or the like would be positioned at the left side of the lower frame 31 when the operator or the like performs various operations and work (referred to below as maintenance work) at the lower frame 31, and is designed to raise operational efficiency when the operator or the like is loading or removing the banknote cassettes 17. Thus, in the following, the left side and the right side of the lower frame will be referred to as the maintenance face side and the non-maintenance face side, respectively. Moreover, for ease of explanation, in the following the left side and the right side will be respectively referred to as the one face side and the other face side, and the front side and the rear side will be respectively referred to as the first intersecting face side and the second intersecting face side.

3-1. Left Side Plate Configuration

Figure 7A:
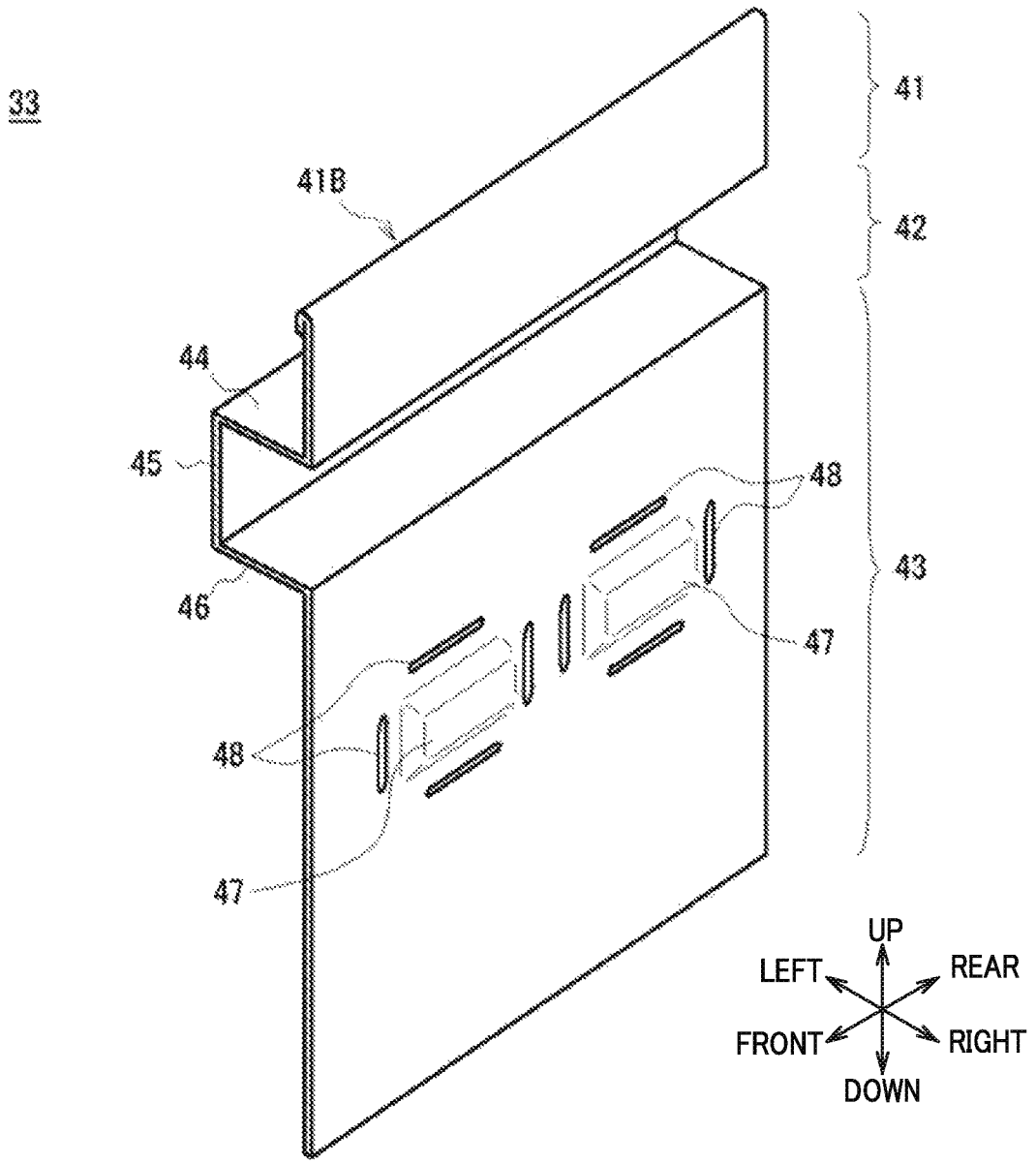
FIG. 7A is a schematic diagram illustrating a configuration of a left side plate.

The left side plate 33, serving as a one face side plate, is formed overall in a sheet shape that is thin in the left-right direction and is long in the front-rear direction, as illustrated in FIG. 5A, FIG. 5B, and FIG. 6. The left side plate 33 is fabricated, for example, by bending a thin metal sheet shaped material into a crank shape, as viewed along the front-rear direction, at plural bend lines running along the front-rear direction so as to be. As illustrated in the partial perspective view of FIG. 7A viewed from a different direction to FIG. 5A, FIG. 5B, and FIG. 6, the left side plate 33 is thereby configured so as to be broadly divided into an upper sheet shaped portion 41 at the upper side, an intermediate reinforcement portion 42, and a lower sheet shaped portion 43 at the lower side.

As illustrated in FIG. 5A, FIG. 5B, and FIG. 6, in a range with respect to the front-rear direction corresponding to the five banknote cassette loading spaces 31SB, the left side plate 33 is formed with the upper sheet shaped portion 41, the reinforcement portion 42, and the lower sheet shaped portion 43. However, in the range corresponding to the reject cassette loading space 31SR, the upper sheet shaped portion 41 and the lower sheet shaped portion 43 are omitted and the left side plate 33 is formed with only the reinforcement portion 42.

The upper sheet shaped portion 41 is formed in a substantially flat sheet shape. However, a bent portion 41B is formed by performing what is referred to as "crush bending" at the vicinity of an upper edge of the upper sheet shaped portion 41, so as to fold the upper sheet shaped portion 41 over toward the left side, namely toward the outside of the banknote cassette loading spaces 31SB (FIG. 5B). This means that a curved face is configured at the upper edge of the upper sheet shaped portion 41, and the cut face of the metal sheet can be positioned below the upper edge. Thus injuries when the hand of the operator or the like contacts the upper sheet shaped portion 41, and damage or the like when the banknote cassettes 17 hit the upper sheet shaped portion 41, can be prevented before they occur. Moreover, due to forming the bent portion 41B, the strength in the left-right direction of the upper sheet shaped portion 41 is raised, which also contributes to reduced occurrence of warping.

Figure 7B:
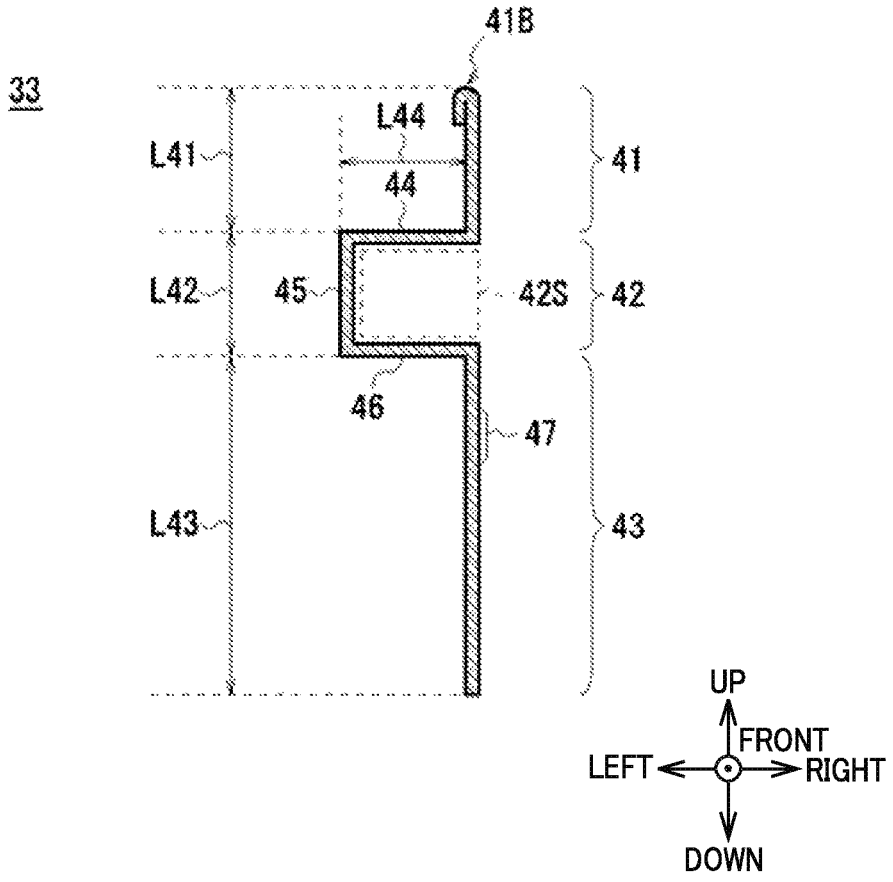
FIG. 7B is a schematic diagram illustrating a configuration of a left side plate.

As illustrated in the cross-section of FIG. 7B, the reinforcement portion 42 is configured by an upper face portion 44 bent at 90 degrees toward the left with respect to the upper sheet shaped portion 41, a left face portion 45 bent downward at 90 degrees with respect to the upper face portion 44, and a lower face portion 46 bent toward the right at 90 degrees with respect to the left face portion 45. Thus in the reinforcement portion 42, a reinforcement space 42S, having a rectangular shaped cross-section formed by the mutually orthogonal upper face portion 44, left face portion 45, and lower face portion 46, is formed at a position projecting out to the left side of the upper sheet shaped portion 41, namely toward the outside of the banknote cassette loading spaces 31SB (FIG. 5B). The lower sheet shaped portion 43 is bent downward at 90 degrees with respect to the lower face portion 46. Moreover, the upper face portion 44 and the lower face portion 46 have lengths in the left-right direction that are the same as a length L44.

Figure 8A:
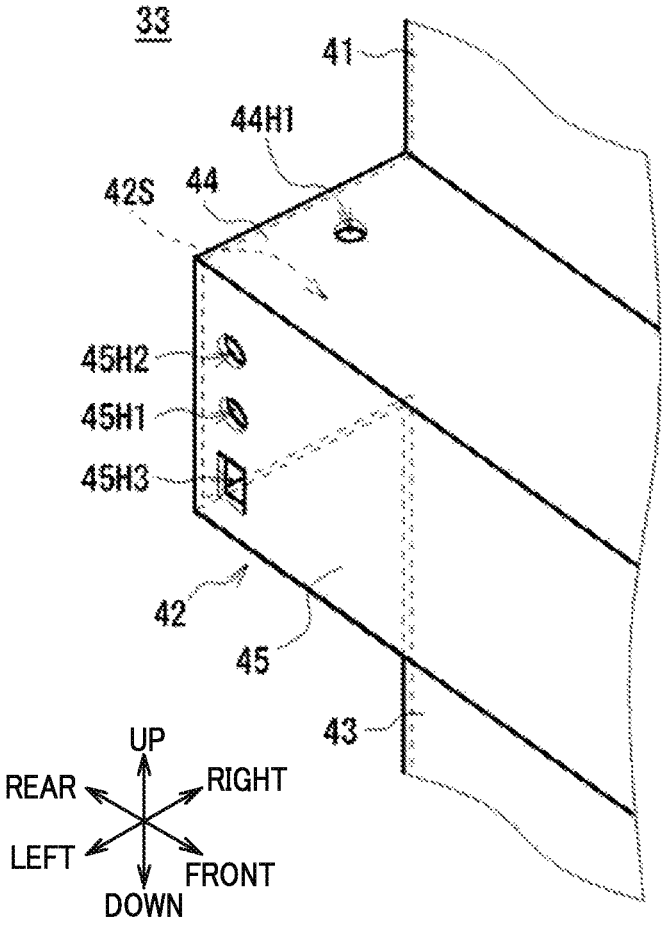
FIG. 8A is a schematic perspective view illustrating a configuration of a reinforcement portion on a left side plate.

Furthermore, as illustrated in FIG. 8A, a fixing hole 45H1 is formed in the vicinity of the rear end of the left face portion 45 of the reinforcement portion 42, so as to pass through the left face portion 45 in the left-right direction in the vicinity of the up-down direction center thereof. Positioning holes 45H2 and 45H3 are formed above and below the fixing hole 45H1, so as to pass through in the left-right direction. Both the fixing hole 45H1 and the positioning hole 45H2 are round holes of predetermined diameters. However, the positioning hole 45H3 is a rectangular shaped hole, long in the up-down direction as viewed from the left. A fixing hole 44H1 is formed in the vicinity of a rear end of the upper face portion 44 so as to pass through in the up-down direction. The fixing hole 44H1 is a round hole of a predetermined diameter, similar to the fixing hole 45H1 of the left face portion 45.

The lower sheet shaped portion 43 (FIG. 7A and FIG. 7B) is formed in a flat sheet shape substantially the same as the upper sheet shaped portion 41, and the lower sheet shaped portion 43 is at the same left-right direction position as the upper sheet shaped portion 41. Raised portions 47 are formed on the lower sheet shaped portion 43, so as to be raised toward the right side with respect to the periphery of the raised portions 47, namely, toward the inside of the banknote cassette loading spaces 31SB (FIG. 5B). For every one location of banknote cassette loading space 31SB, the raised portions 47 are disposed at two locations on the lower sheet shaped portion 43, arranged in a row along the front-rear direction.

There are plural slits 48 at the periphery of each of the raised portions 47 (FIG. 7A and FIG. 7B) formed by using what is referred to as "drawing" or "deep drawing" processing technology. The raised portions 47 are formed such that the rightmost projecting portion of each raised portion 47 has a rectangular shape when viewed face-on. Inclined faces with trapezoidal shapes are respectively formed between each of the edges of the rectangular shapes, and the peripheral portions of the lower sheet shaped portion 43.

The raised portions 47 thereby make contact with the side faces of the banknote cassettes 17 when the banknote cassettes 17 (FIG. 2 etc.) have been loaded into the banknote cassette loading spaces 31SB (FIG. 5B). This accordingly avoids a situation in which the banknote cassettes 17 make contact with the flat sheet shaped portions on the upper sheet shaped portion 41 and the lower sheet shaped portion 43, forming scratches etc. over a wide area.

3-2. Right Side Plate Configuration

The right side plate 34 (FIG. 5A FIG. 5B, and FIG. 6), serving as an other face side plate, is formed overall in a sheet shape that is thin in the left-right direction and long in the front-rear direction, similarly to the left side plate 33. Similarly to the left side plate 33, the right side plate 34 is also fabricated by, for example, bending a thin metal sheet shaped material into a crank shape, as viewed along the front-rear direction, at plural bend lines running along the front-rear direction. As illustrated in the partial perspective view of FIG. 9B viewed from a different direction to FIG. 5A, FIG. 5B, and FIG. 6, the right side plate 34 is thereby formed so as to be broadly divided into an upper sheet shaped portion 51 at the upper side, an intermediate reinforcement portion 52, and a lower sheet shaped portion 53 at the lower side.

As illustrated in FIG. 5A, FIG. 5B, and FIG. 6 and similarly to the left side plate 33, the right side plate 34 is formed by the upper sheet shaped portion 51, the reinforcement portion 52, and the lower sheet shaped portion 53 for a range corresponding to the five banknote cassette loading spaces 31SB in the front-rear direction. However, the right side plate 34 is formed by only the reinforcement portion 52 for a range corresponding to the reject cassette loading space 31SR, and the upper sheet shaped portion 51 and the lower sheet shaped portion 53 are omitted.

Figure 9A:
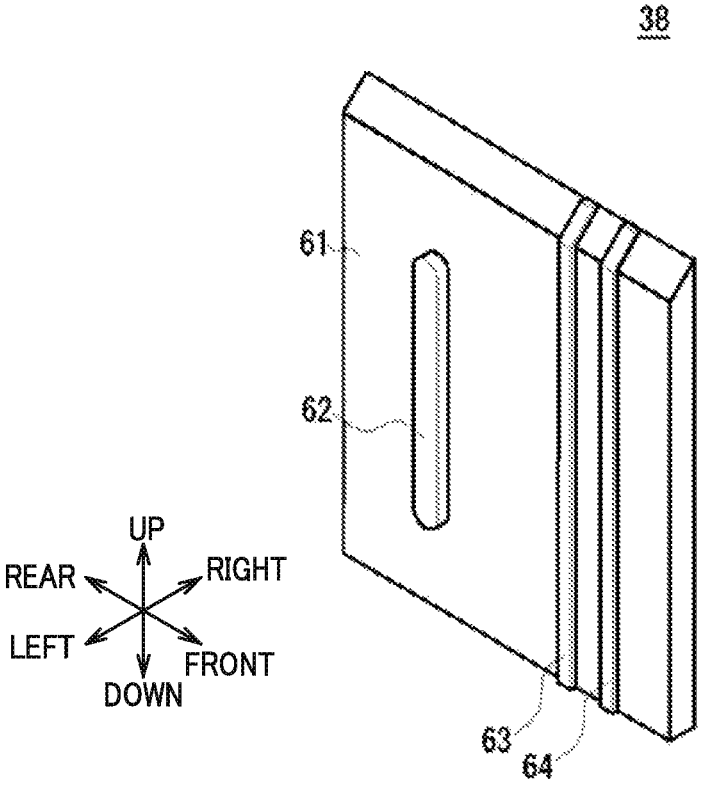
FIG. 9A is a schematic perspective view illustrating a configuration of a right side plate and a right internal side plate.
Figure 9B:
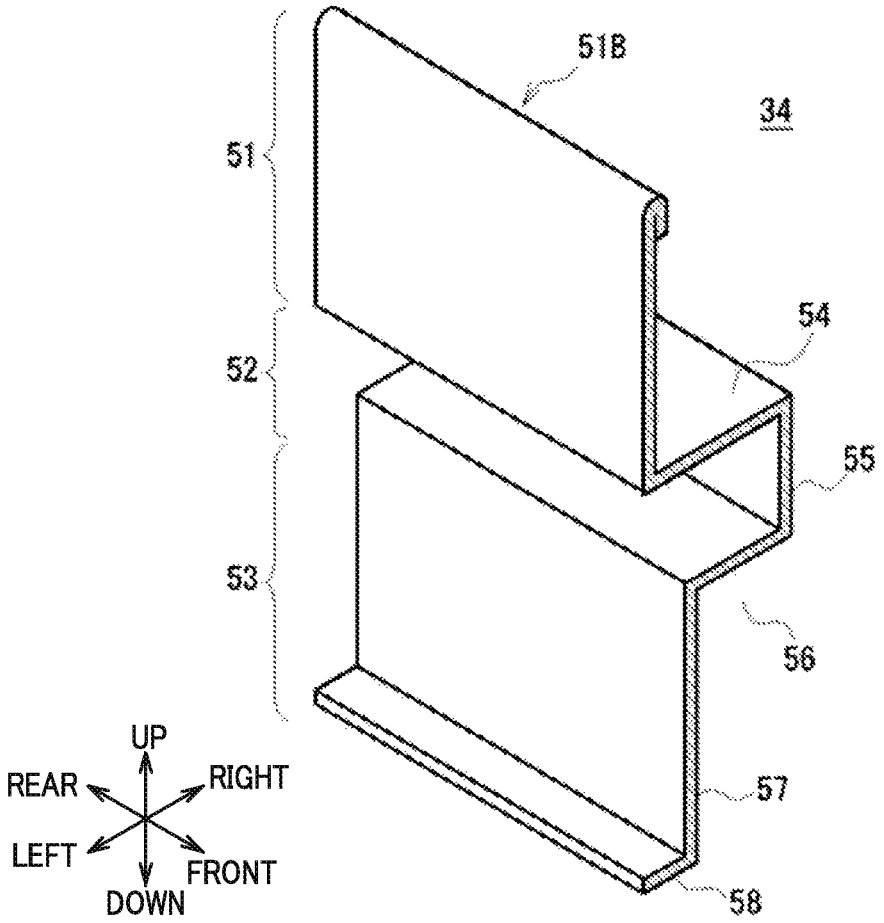
FIG. 9B is a schematic perspective view illustrating a configuration of a right side plate and a right internal side plate.
Figure 9C:
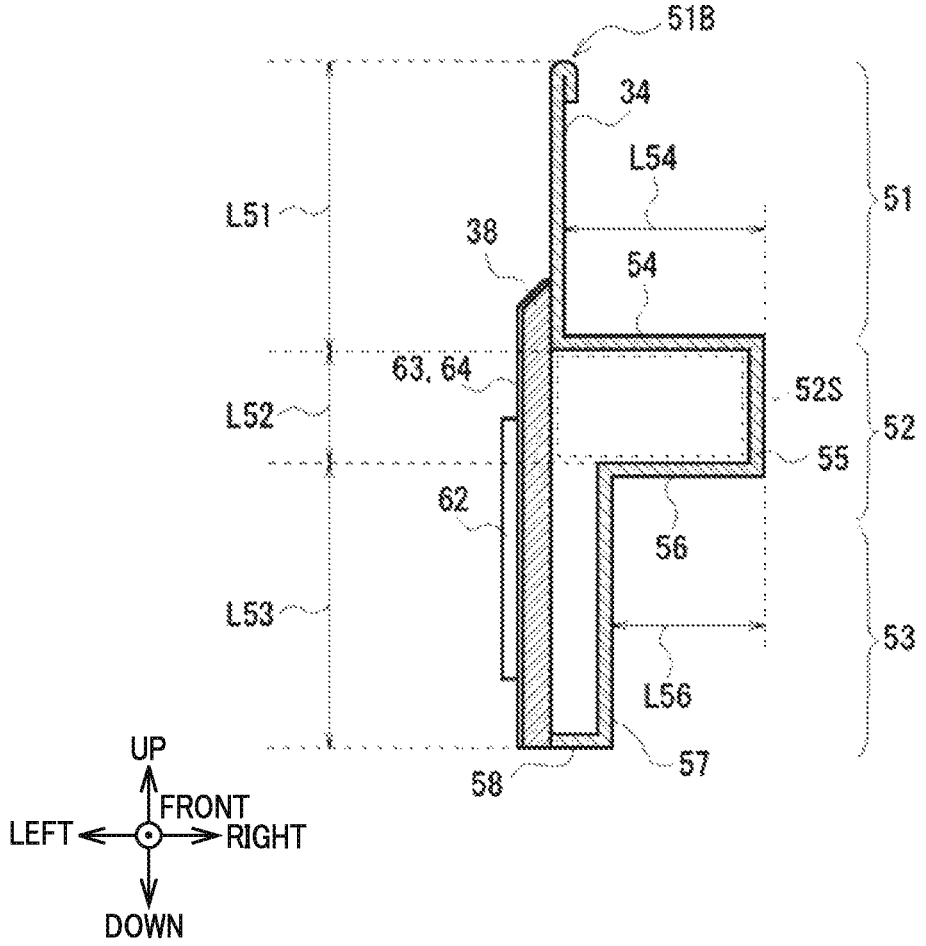
FIG. 9C is a schematic perspective view illustrating a configuration of a right side plate and a right internal side plate.

Although the upper sheet shaped portion 51 is formed so as to be substantially left-right symmetrical to the upper sheet shaped portion 41 of the left side plate 33, as illustrated in FIG. 9C, a length L51 in the up-down direction is longer than a length L41 (FIG. 7B) in the up-down direction of the upper sheet shaped portion 41. A bent portion 51B is formed by what is referred to as "crush bending" in the vicinity of an upper edge of the upper sheet shaped portion 51, so as to fold the upper sheet shaped portion 51 over toward the right side, namely toward the outside of the banknote cassette loading spaces 31SB (FIG. 5B).

The reinforcement portion 52 is configured so as to be substantially left-right symmetrical to the reinforcement portion 42 of the left side plate 33. The reinforcement portion 52 is configured including an upper face portion 54 bent at 90 degrees toward the right with respect to the upper sheet shaped portion 51, a right face portion 55 bent downward at 90 degrees with respect to the upper face portion 54, and a lower face portion 56 bent toward the left at 90 degrees with respect to the right face portion 55. Thus in the reinforcement portion 52, a reinforcement space 52S having a rectangular shaped cross-section is formed by the mutually orthogonal upper face portion 54, right face portion 55, and lower face portion 56, at a position projecting out toward the right side of the upper sheet shaped portion 51, namely toward the outside of the banknote cassette loading spaces 31SB (FIG. 5B). A wiring member, described later, is disposed inside the reinforcement space 52S.

An up-down direction length L52 of the reinforcement portion 52 is substantially the same as a length L42 of the reinforcement portion 42 (FIG. 7B) on the left side plate 33. However, a left-right direction length L54 of the upper face portion 54 is longer than a length L44 of the upper face portion 44 on the left side plate 33. Thus the cross-sectional area of the reinforcement space 52S is larger than the cross-sectional area of the reinforcement space 42S. A length L56 of the lower face portion 56 is slightly shorter than a length L54 of the upper face portion 54. Moreover, similarly to in the reinforcement portion 42, plural holes (not illustrated in the drawings) are formed in the vicinity of the rear end of the upper face portion 54 and the upper face portion 55 of the reinforcement portion 52.

The lower sheet shaped portion 53 is configured by a lower right face portion 57 formed in a flat sheet shape, similarly to the upper sheet shaped portion 51, and a bottom face portion 58 formed by bending toward the left at the vicinity of the lower edge of the lower right face portion 57. As illustrated in FIG. 9C, the left end of the bottom face portion 58 is at a position substantially the same as the position of the upper sheet shaped portion 51 in the left-right direction. Namely, the lower right face portion 57 is positioned further to the right side than the upper sheet shaped portion 51. A length L53 of the lower sheet shaped portion 53 is the same as the length L43 (FIG. 7B) of the lower sheet shaped portion 43 on the left side plate 33.

3-3. Right Internal Side Plate Configuration

Respective right internal side plates 38 are attached to the left side of the right side plate 34 (FIG. 5A, FIG. 5B, and FIG. 6) for each of the banknote cassette loading spaces 31SB. The right internal side plates 38 each have a configuration, as illustrated in FIG. 9A, in which a positioning projection 62, and contacting projections 63 and 64 are respectively provided to a flat sheet shape base plate 61. The right internal side plates 38 are, for example, fabricated as components molded from a predetermined resin material.

The base plate 61 is formed overall in a sheet shape thin in the left-right direction. The upper face of the base plate 61 is an inclined face that is higher on the right side and lower on the left side. A positioning projection 62, serving as another loading-section-side positioning portion, is disposed at a position slightly toward the rear of center on the left side face of the base plate 61. The positioning projection 62 is formed overall as an elongated bar shape that runs along the up-down direction and projects out by a predetermined length toward the left from the left side face of the base plate 61. Semi-spherical profiles are formed at the upper end and the lower end of the positioning projection 62, as viewed from the left.

The contacting projection 63 is disposed in the vicinity of the front-rear direction center of the base plate 61, spans the upper face and the left side face of the base plate 61, and projects out to the left by a small amount relative to the periphery. The length in the front-rear direction and the projection length to the left of the contacting projection 63 are sufficiently smaller than those of the positioning projection 62. The contacting projection 64 is provided at a location at the front side of the contacting projection 63 and slightly separated from the contacting projection 63. The contacting projection 64 is formed with substantially the same shape as the contacting projection 63.

3-4. Front Side Plate Configuration

Figure 10A:
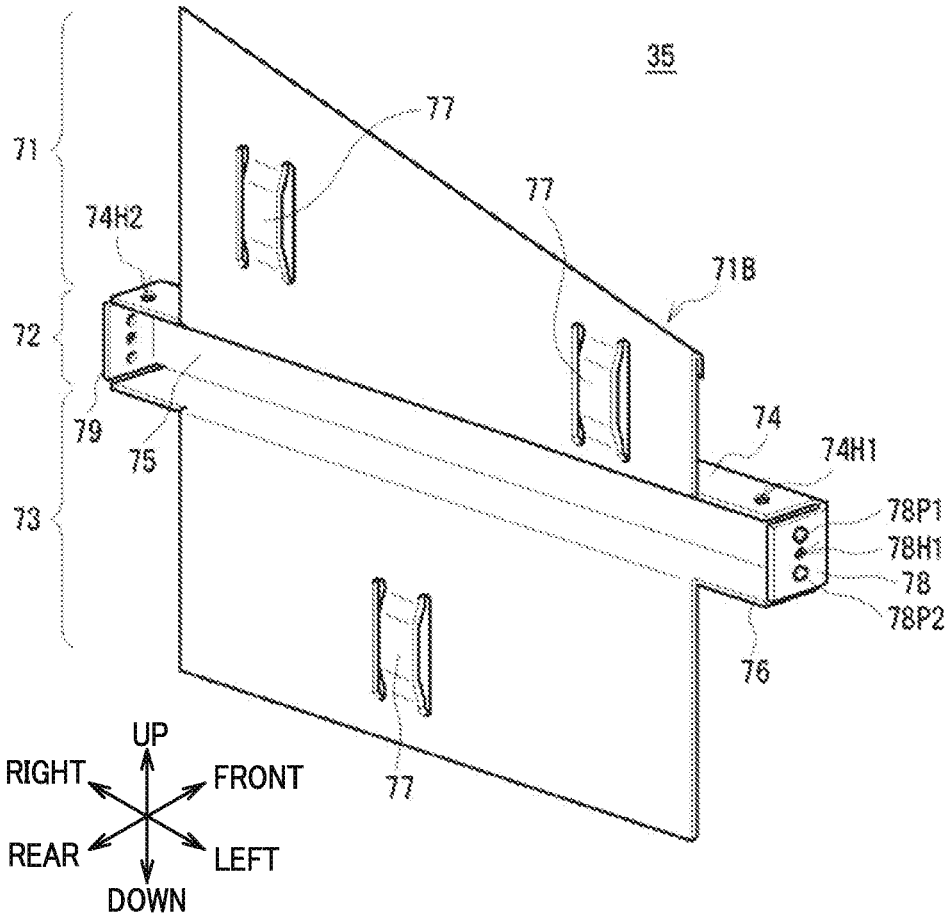
FIG. 10A is a schematic diagram illustrating a configuration of a front side plate.

As illustrated in the perspective view of FIG. 10A viewed from a different direction to FIG. 5A, FIG. 5B, and FIG. 6, the front side plate 35, serving as a first intersecting face side plate, is formed overall in a sheet shape, thin in the front-rear direction. The front side plate 35 is shaped as if a left upper portion had been cut off from a rectangular shape, namely, is formed with a trapezoidal profile that has a shorter left side than right side. Similarly to the left side plate 33 and the right side plate 34, the front side plate 35 is fabricated, for example, by bending a thin metal sheet shaped material into a crank shape, as viewed along the left-right direction, at plural bend lines running along the left-right direction. Similarly to in the left side plate 33 and the like, the front side plate 35 is thereby formed so as to be broadly divided into an upper sheet shaped portion 71 at the upper side, an intermediate reinforcement portion 72, and a lower sheet shaped portion 73 at the lower side.

The upper sheet shaped portion 71 is formed in a substantially flat sheet shape, with the vicinity of an upper edge of the upper sheet shaped portion 71 folded over toward the front side, namely, toward the outside of the banknote cassette loading spaces 31SB (FIG. 5B) so as to form a bent portion 71B. There are also rear raised portions 77 respectively formed at two locations on the upper sheet shaped portion 71, toward the left and toward the right, and at one location in the vicinity of the left-right center of the lower sheet shaped portion 73. The rear raised portions 77 are each formed by two slits that run along the up-down direction and have upper and lower ends aligned in height with each other. The rear raised portions 77 are formed by performing what is referred to as "drawing" or "deep drawing" processing technology on the portions between the two slits to form profiles that are raised toward the rear.

Figure 10B:
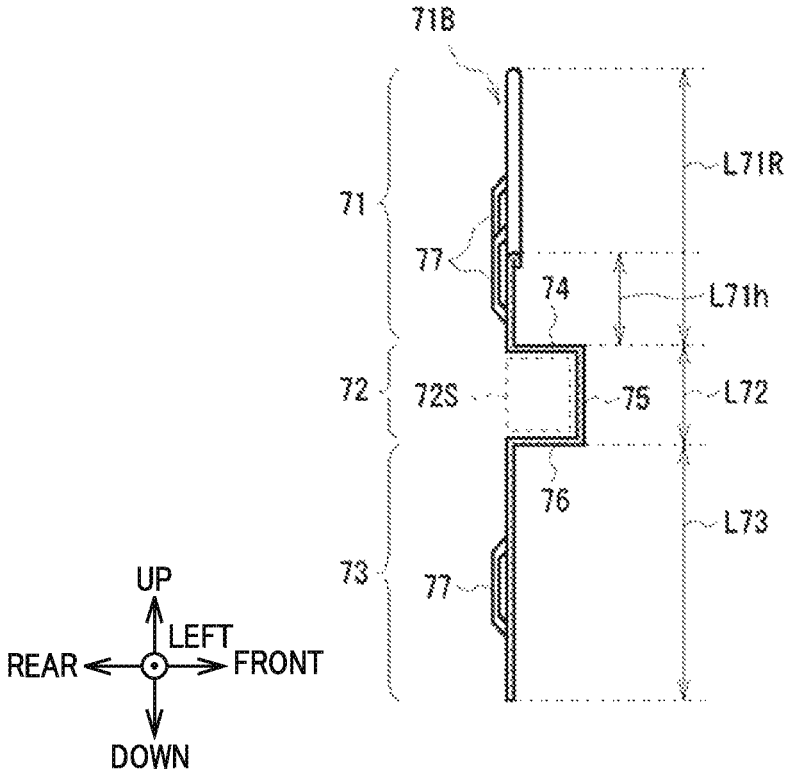
FIG. 10B is a schematic diagram illustrating a configuration of a front side plate.

As illustrated in cross-section in FIG. 10B, the reinforcement portion 72 is configured including an upper face portion 74 bent at 90 degrees toward the right with respect to the upper sheet shaped portion 71, a front face portion 75 bent downward at 90 degrees with respect to the upper face portion 74, and a lower face portion 76 bent toward the left at 90 degrees with respect to the front face portion 75. Thus in the reinforcement portion 72, a reinforcement space 72S having a rectangular shaped cross-section is formed by the mutually orthogonal upper face portion 74, front face portion 75, and lower face portion 76, at a position projecting out toward the front side of the upper sheet shaped portion 71, namely toward the outside of the banknote cassette loading spaces 31SB (FIG. 5A and FIG. 5B).

Moreover, as illustrated in FIG. 10A, the reinforcement portion 72 is configured so as to be longer in the left-right direction than the upper sheet shaped portion 71 and the lower sheet shaped portion 73. The vicinity of the left end of the reinforcement portion 72 projects out further toward the left than the left ends of the upper sheet shaped portion 71 and the lower sheet shaped portion 73. Similarly, the vicinity of the right end of the reinforcement portion 72 projects out further toward the right than the right ends of the upper sheet shaped portion 71 and the lower sheet shaped portion 73.

Moreover, a left face portion 78 and a right face portion 79 are respectively provided so as to extend perpendicularly at the left and right ends of the front face portion 75 of the reinforcement portion 72. The left face portion 78 is formed in a comparatively small rectangular sheet shape, and a fixing hole 78H1 is formed in the vicinity of the up-down direction center of the left face portion 78 so as to pass through along the left-right direction.

Positioning projections 78P1 and 78P2 are respectively provided above and below the fixing hole 78H1, projecting out toward the left with respect to the periphery. The positioning projections 78P1 and 78P2 are formed by performing what is referred to as "punching" or "half punching" processing technology on the sheet shaped portion configuring the left face portion 78, and both have flattened circular pillar shapes. A fixing hole 74H1 is formed in the vicinity of the left end of the upper face portion 74, so as to pass through in the up-down direction. Similarly to the fixing hole 78H1 of the left face portion 78, the fixing hole 74H1 is a circular hole with a predetermined diameter.

The right face portion 79 is configured with left-right symmetry to the left face portion 78. A fixing hole 74H2 is also formed in the vicinity of the right end of the upper face portion 74, similarly to that in the vicinity of the left end thereof.

Fixing tabs (not illustrated in the drawings) for fixing to the left side plate 33 and the right side plate 34 are respectively provided so as to extend appropriately at the left and right ends of the upper sheet shaped portion 71 and the lower sheet shaped portion 73 of the front side plate 35. These fixing tabs have fixing holes formed as appropriate therein, and the fixing tabs are fixed to the left side plate 33 and the right side plate 34 by rivets (not illustrated in the drawings) or the like.

3-5. Rear Side Plate Configuration

Figure 11:
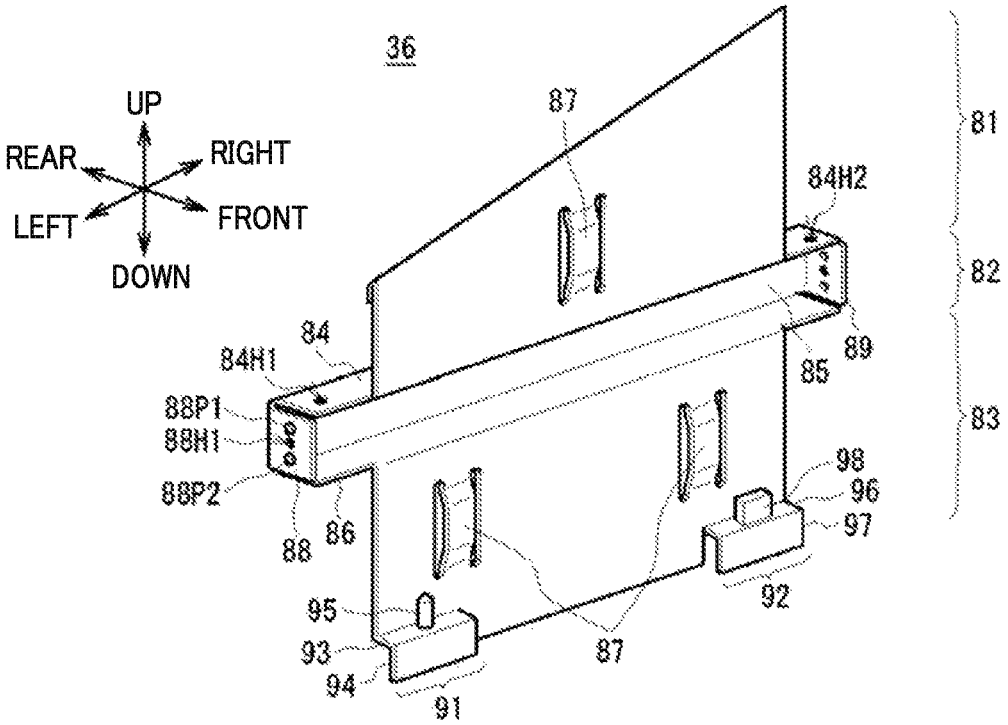
FIG. 11 is a schematic perspective view illustrating a configuration of a rear side plate.

As illustrated in FIG. 11, the rear side plate 36, serving as a second intersecting face side plate, is configured so as to be substantially front-rear symmetrical to the front side plate 35 (FIG. 10A, FIG. 10B). Namely, the rear side plate 36 is configured so as to be broadly divided into an upper sheet shaped portion 81, a reinforcement portion 82, and a lower sheet shaped portion 83, respectively corresponding to the upper sheet shaped portion 71, the reinforcement portion 72, and the lower sheet shaped portion 73. The reinforcement portion 82 is configured by an upper face portion 84, a rear face portion 85, and a lower face portion 86, respectively corresponding to the upper face portion 74, the front face portion 75, and the lower face portion 76. A left face portion 88 and a right face portion 89, respectively corresponding to the left face portion 78 and the right face portion 79, are provided at the left and right ends of the front face portion 75.

A fixing hole 88H1 and positioning projections 88P1 and 88P2, respectively corresponding to the fixing hole 78H1 and positioning projections 78P1 and 78P2 (FIG. 10A), are provided to the left face portion 88. A fixing hole 84H1, corresponding to the fixing hole 74H1, is provided in the upper face portion 84. The right face portion 89 is formed with left-right symmetry to the left face portion 88. A fixing hole 84H2 is provided in the vicinity of the right end of the upper face portion 84, similarly to that the vicinity of the left end thereof.

Front raised portions 87 are respectively formed in the vicinity of the left-right center of the upper sheet shaped portion 81 and at locations toward the front and rear of the lower sheet shaped portion 83. The front raised portions 87 are front-rear symmetrical to the rear raised portions 77 of the front side plate 35, and are raised toward the front.

A left lower support section 91 and a right lower support section 92 are also provided in the vicinity of the lower edge of the lower sheet shaped portion 83, at a portion in the vicinity of the left end and a portion in vicinity of the right end. The left lower support section 91 is formed with a substantially horizontal upper face portion 93 and a substantially vertical front face portion 94 by bending a portion of the sheet shaped material configuring the rear side plate 36 toward the front, and by then further bending a front end side portion thereof downward. A positioning pin 95 is provided on the upper face portion 93. The positioning pin 95, serving as a first loading-section-side positioning portion, is formed overall as an elongated circular pillar shape running along the up-down direction, with a circular conical profile at the vicinity of the upper end of the positioning pin 95.

Similarly to the left lower support section 91, the right lower support section 92 is formed with a substantially horizontal upper face portion 96 and a substantially vertical front face portion 97 by bending a portion of the sheet shaped material configuring the rear side plate 36 toward the front, and by then further bending a front end side portion thereof downward. The up-down direction position (namely the height) of the upper face portion 96 is aligned so as to be the same as that of the upper face portion 93 of the left lower support section 91. The position in the front-rear direction of the front face portion 97 is aligned so as to be the same as that of the front face portion 94 of the left lower support section 91.

A loading-section-side connector 98 is provided to the upper face portion 96. The loading-section-side connector 98 is configured in a small cuboidal shape, and plural conductive connection terminals (not illustrated in the drawings) are incorporated in a connector body section configured from an insulating resin. Each of the connection terminals is connected to a wiring member (not illustrated in the drawings), such as a signal line for exchanging electrical signals with the banknote controller 12 (FIG. 2), a power line (not illustrated in the drawings) for supplying power, or the like.

Similarly to on the front side plate 35, fixing tabs (not illustrated in the drawings) for fixing to the left side plate 33 and the right side plate 34 are respectively provided on the rear side plate 36, so as to extend appropriately at the left and right ends of the upper sheet shaped portion 81 and the lower sheet shaped portion 83 of the rear side plate 36.

3-6. Divider Plate Configuration

Figure 12:
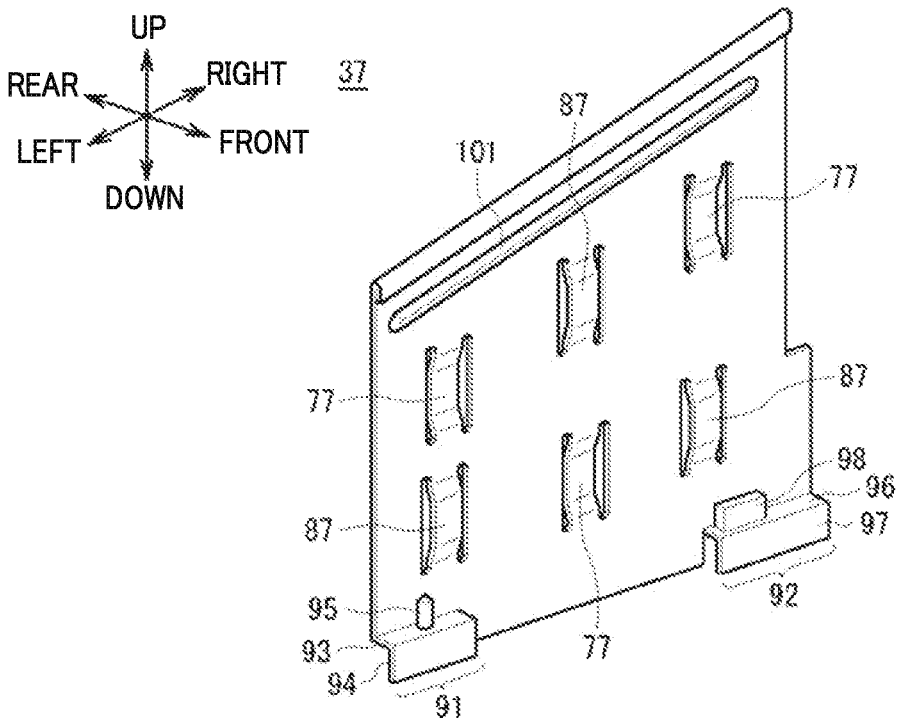
FIG. 12 is a schematic perspective view illustrating a configuration of a divider plate.

As illustrated in FIG. 12, the divider plates 37 are formed overall in sheet shapes thin in the front-rear direction, and similarly to the front side plate 35 and the rear side plate 36, the divider plates 37 are formed with a profile as if a left upper portion has been cut off from a rectangular shape, namely with a trapezoidal profile that has a shorter left side to the right side. However, the divider plates 37 are not formed with a reinforcement portion like that of the front side plate 35 (FIG. 10A and FIG. 10B) or the rear side plate 36 (FIG. 11), and the divider plates 37 have a single continuous flat sheet shape from the upper edge to the lower edge.

The upper edge of each of the divider plates 37 is folded back toward the front, similarly to in the front side plate 35 (FIG. 10A and FIG. 10B). A raised portion 101 is provided so as to project forwards from slightly below the upper edge of each of the divider plates 37. The raised portion 101 is formed by processing with what is referred to as "drawing" or "deep drawing", and is formed in a straight line shape substantially parallel to the upper edge, namely inclined to the horizontal direction so as to be higher on the right side. The apex portion of the raised portion 101, namely, the portion that projects out furthest forwards, projects out further forwards than the folded over portion at the upper edge.

Rear raised portions 77 are formed on each of the divider plates 37, similarly to on the front side plate 35 (FIG. 10A and FIG. 10B), so as to be raised toward the rear at a total of three locations: toward the left and right at the upper side, and in the vicinity of the left-right center at the lower side. Namely, the positions of the rear raised portions 77 on the divider plates 37 are substantially the same as the positions of the rear raised portions 77 on the front side plate 35 (FIG. 10A and FIG. 10B).

Front raised portions 87 are formed on each of the divider plates 37, similarly to on the rear side plate 36 (FIG. 11), so as to be raised toward the front at a total of three locations: in the vicinity of the left-right center at the upper side, and toward the left and right at the lower side. Namely, the positions of the front raised portions 87 on the divider plates 37 are substantially the same as the positions of the front raised portions 87 on the rear side plate 36 (FIG. 11).

Moreover, a left lower support section 91 and a right lower support section 92, which are configured similarly to those on the rear side plate 36 (FIG. 11), are provided in the vicinity of the lower edge of each of the divider plates 37, at a portion in the vicinity of the left end and at a portion in the vicinity of the right end. Namely, the left lower support section 91 includes an upper face portion 93, a front face portion 94, and a positioning pin 95. The right lower support section 92 includes an upper face portion 96, a front face portion 97, and a loading-section-side connector 98.

Similarly to on the front side plate 35 and the rear side plate 36, fixing tabs (not illustrated in the drawings) for fixing to the left side plate 33 and the right side plate 34 are respectively provided so as to extend appropriately at the left and right ends of the divider plates 37.

3-7. Reject Loading Section Configuration

The reject loading section 39 (FIG. 6) is mainly configured by a front side plate 121 positioned at the front side, a left side plate 122 positioned at the left side, and a right side plate 123 positioned at the right side. The reject loading section 39 is open at the rear side, upper side, and lower side. The front side plate 121 is formed in a hollow cuboidal shape assembled from plural members, with various components, such as sensors, wiring members, and the like, housed inside the front side plate 121. The reject loading section 39, as illustrated in FIG. 5B, forms a reject cassette loading space 31SR by being attached to the front side of the front side plate 35.

The left side plate 122 and the right side plate 123 are configured by respective processing thin sheet shaped metal. A single positioning projection 124 is provided at the right side of the left side plate 122, namely at the inside of the reject cassette loading space 31SR. Two positioning projections 125 and 126 are provided at the left side of the right side plate 123, namely at the inside of the reject cassette loading space 31SR. The positioning projections 124, 125, and 126 are each formed by what is referred to as "drawing" or "deep drawing" processing technology.

A lower support section 127 formed in a small cuboidal shape is attached in the vicinity of the lower edge of the front face of the front side plate 35. The lower support section 127 is in a state raised toward the front with respect to the front side plate 35, similarly to the right lower support section 92 of the rear side plate 36 (FIG. 11). Similarly to the right lower support section 92, a loading-section-side connector 128 corresponding to the loading-section-side connector 98 is provided on the upper face of the lower support section 127.

3-8. Lower Frame Fabrication

However, as illustrated in FIG. 5A, FIG. 5B and FIG. 6, when fabricating the lower frame 31, the front side plate 35 and the rear side plate 36 are attached to the left side plate 33 and the right side plate 34. When this is performed, for example, at a portion of the lower frame 31 where the rear side plate 36 is attached to the left rear of the left side plate 33, fixing tabs (not illustrated in the drawings) that are appropriately provided to the upper sheet shaped portions 81 and 83 of the rear side plate 36 are fastened by non-illustrated rivets in a state overlapped in the vicinity of the rear edge of the rear side plate 36.

Figure 8B:
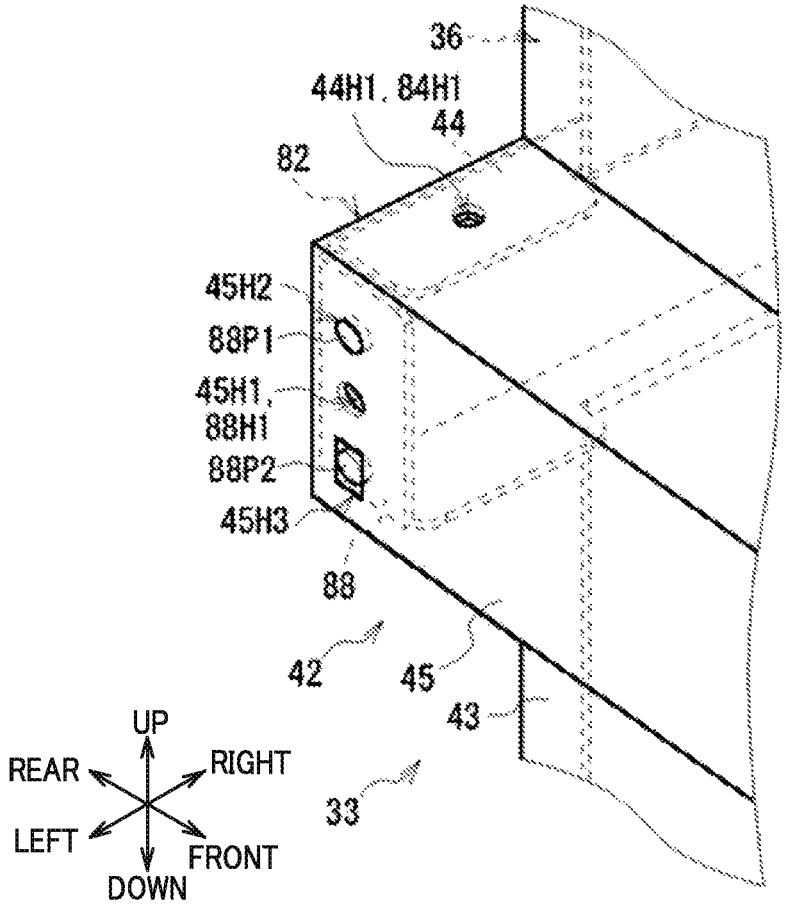
FIG. 8B is a schematic perspective view illustrating a configuration of a reinforcement portion on a left side plate.

Moreover, as illustrated in FIG. 8B, in the lower frame 31, the reinforcement portion 82 of the rear side plate 36 is placed so as to enter inside the reinforcement space 42S in the reinforcement portion 42 of the left side plate 33. Then, in a state in which the left face portion 88 of the rear side plate 36 is overlapped with the left face portion 45 of the left side plate 33, the positioning projections 88P1 and 88P2 are respectively inserted into the positioning holes 45H2 and 45H3.

The hole diameter of the positioning hole 45H2 is the same as, or slightly larger than, the outer diameter of the positioning projection 88P1. Thus the positioning hole 45H2 defines the position of the inserted positioning projection 88P1 with respect to the front-rear direction and the up-down direction, and restricts movement in these directions.

Moreover, the hole length of the positioning hole 45H3 with respect to the front-rear direction is the same as, or slightly larger than, the outer diameter of the positioning projection 88P1. Thus, the positioning hole 45H3 defines the position of the inserted positioning projection 88P2 with respect to the front-rear direction, and restricts the reinforcement portion 82 from rotating about the positioning hole 45H2.

Namely, the position of the reinforcement portion 82 of the rear side plate 36 can be defined in relation to the front-rear direction and the up-down direction with respect to the reinforcement portion 42 of the left side plate 33 by the positioning projections 88P1 and P2 being respectively inserted into the positioning holes 45H2 and H3. When doing so, in the lower frame 31, the positions of the fixing hole 45H1 and the fixing hole 88H1 are aligned when viewed from the left, and the positions of the fixing hole 44H1 and the fixing hole 84H1 are aligned when viewed from above.

Figure 8C:
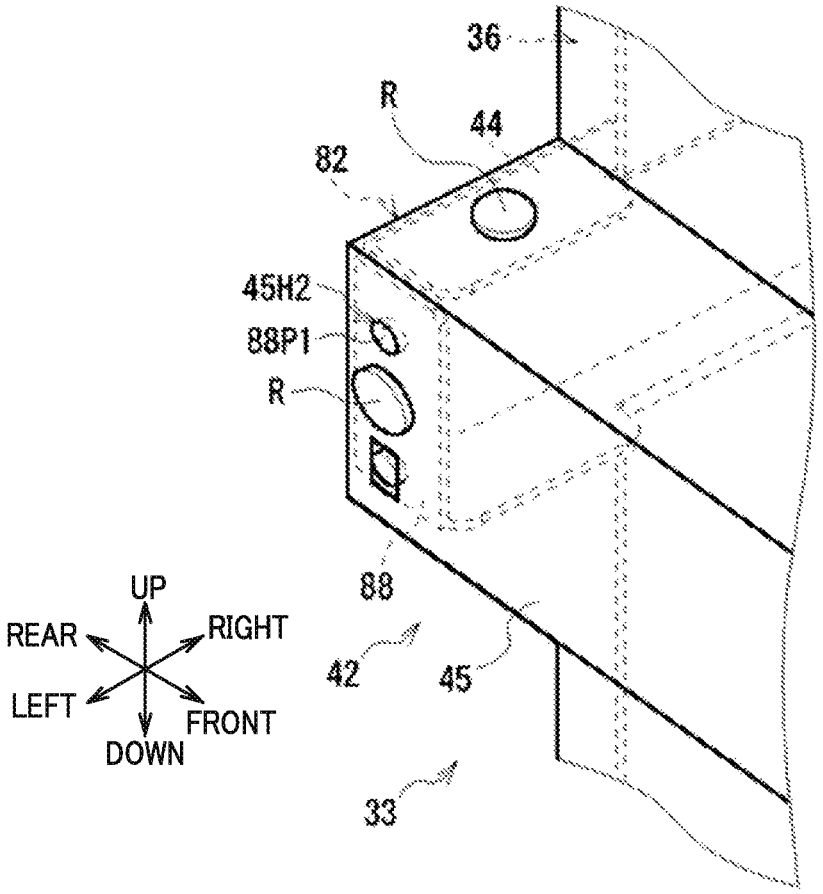
FIG. 8C is a schematic perspective view illustrating a configuration of a reinforcement portion on a left side plate.

In this state of the lower frame 31, as illustrated in FIG. 8C, rivets R are inserted so as to pass through the fixing hole 45H1 and the fixing hole 88H1, and are crimped (namely, clinched) using a crimping tool or the like. Thus in the lower frame 31, the left face portion 45 on the reinforcement portion 42 of the left side plate 33, and the left face portion 88 of the reinforcement portion 82 of the rear side plate 36, can be strongly fastened together in a mutually positioned state.

Moreover, in the lower frame 31, the rivets R are inserted so as to pass through the fixing hole 44H1 and the fixing hole 84H1 and then clinched. Thereby, in the lower frame 31, the upper face portion 44 of the reinforcement portion 42 of the left side plate 33, and the upper face portion 84 of the reinforcement portion 82 of the rear side plate 36, can be fixed together so as not to come apart from each other.

Moreover, at each of the portions at the left front, right rear, and right front of the lower frame 31, similarly to at the left rear portion thereof, the upper sheet shaped portions are fixed together and the lower sheet shaped portions are fixed together. This is achieved by inserting each of the positioning projections into each of the positioning holes, inserting rivets into each of the fixing holes, and then clinching. Thus, the reinforcement portions on each of the side plates at the front, rear, left, and right of the lower frame 31 can be fastened to each other so as to surround the five locations of banknote cassette loading spaces 31SB.

In addition thereto, in the lower frame 31, the four divider plates 37 are attached between the left side plate 33 and the right side plate 34, and the right internal side plates 38 are attached to the inside (left side) of the right side plate 34 at the respective five locations of the banknote cassette loading spaces 31SB. Moreover, the reject loading section 39 and the lower support section 127 are attached to the front side of the front side plate 35.

Moreover, in the lower frame 31, the wiring members or the like, for sending and receiving electrical power and various electrical signals to and from the loading-section-side connectors 98 and 128, are attached between the right side plate 34 and the right internal side plates 38 so as to pass inside the reinforcement portion 52 of the right side plate 34 (FIG. 9B, FIG. 9C) or the like. The state of the lower frame 31 illustrated in FIG. 5B is accordingly achieved thereby.

Figure 13A:
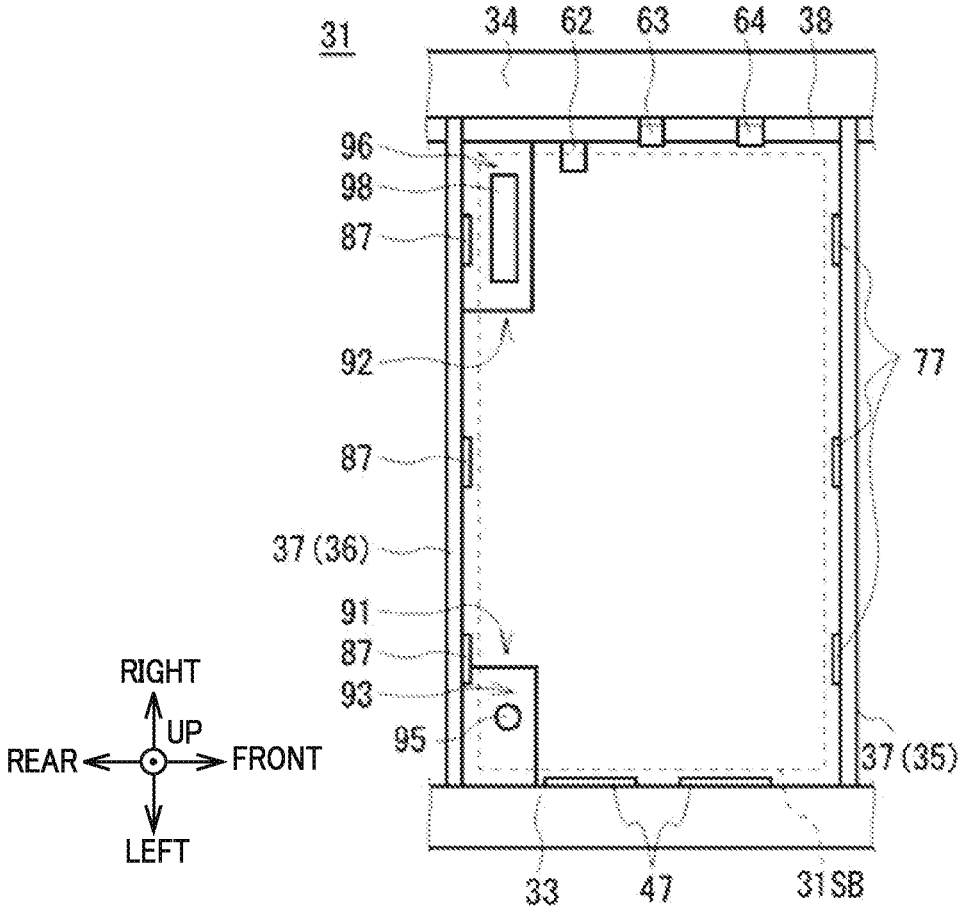
FIG. 13A is a plan view illustrating a banknote cassette loading space and a banknote cassette.

In the lower frame 31, as illustrated in FIG. 13A showing the banknote cassette loading space 31SB at one location as viewed from above, the left lower support section 91 and the right lower support section 92 on the divider plate 37 or on the rear side plate 36, and the positioning projection 62 of the right internal side plate 38, are in a state projecting out greatly toward the inside. Moreover, in the lower frame 31, the raised portions 47 of the left side plate 33, the contacting projections 63 and 64 of the right internal side plate 38, the front raised portions 87 of the divider plate 37 at the rear side or of the rear side plate 36, and the rear raised portions 77 of the divider plate 37 at the front side or the front side plate 35, each project out slightly toward the inside.

Figure 14A:
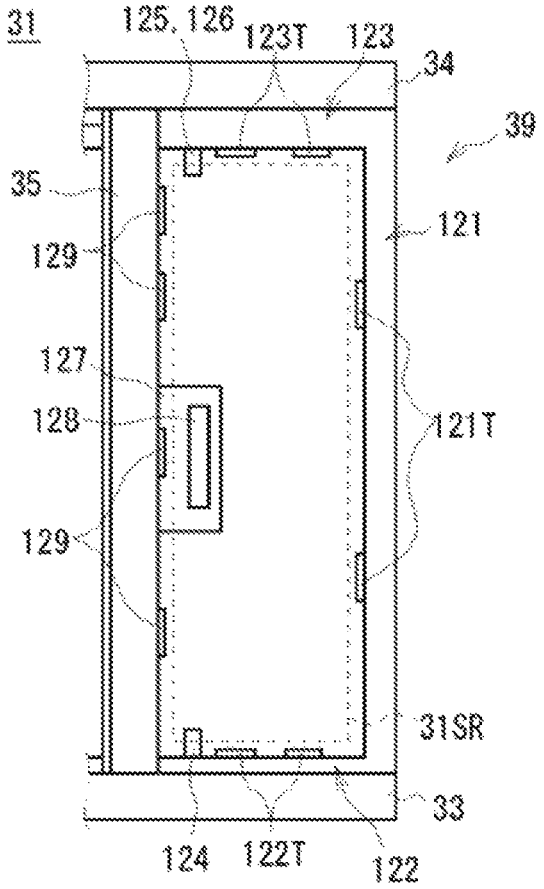
FIG. 14A is a plan view illustrating a reject cassette loading space and a reject cassette.

Furthermore, in the lower frame 31, as illustrated in FIG. 14A, showing the reject cassette loading space 31SR as viewed from above, the lower support section 127, and the positioning projections 124, 125, and 126, are in a state projecting out greatly toward the inside. Moreover, in the lower frame 31, plural raised portions 129, which are configured similarly to the raised portions 47 etc. of the left side plate 33, are provided as appropriate to portions at the front side, rear side, left side, and right side of the reject cassette loading space 31SR. Similarly to the raised portions 47 etc., the raised portions 129 project out slightly toward the inside of the reject cassette loading space 31SR.

Figure 15A:
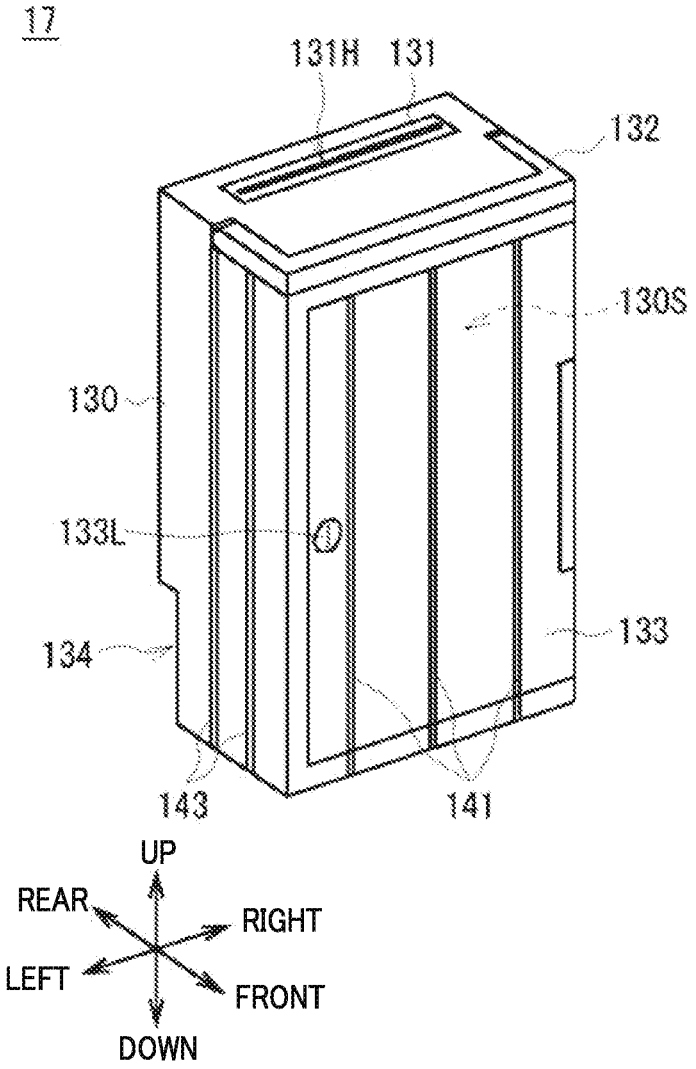
FIG. 15A is a schematic perspective view illustrating a configuration of a banknote cassette.
Figure 15B:
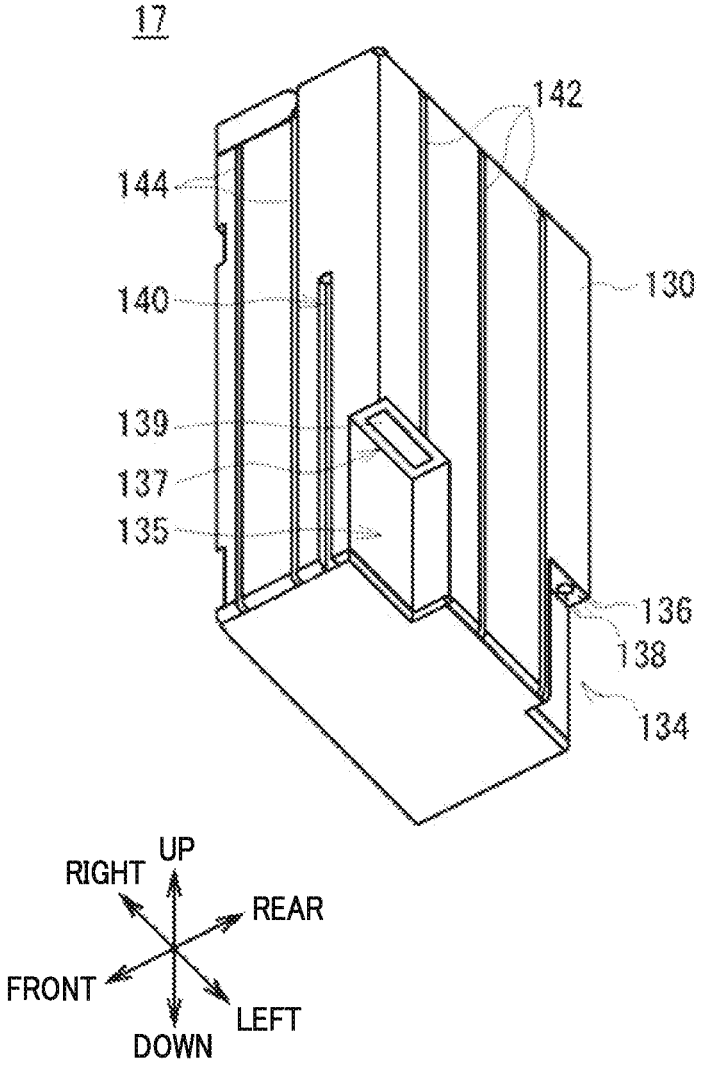
FIG. 15B is a schematic perspective view illustrating a configuration of a banknote cassette.

4. Banknote Cassette Configuration and Loading 4-1. Banknote Cassette External Configuration Explanation follows regarding the banknote cassettes 17. As illustrated in FIG. 15A and FIG. 15B, the banknote cassettes 17 are each configured around a cassette casing 130 forming an outside portion (namely, the external profile) thereof. The cassette casing 130 is formed overall in a cuboidal shape that is long in the up-down direction, and comparatively short in the front-rear direction. The cassette casing 130 is configured, for example, by an assemblage of plural components molded from a predetermined resin material.

The lengths of each of the cassette casings 130 in the front-rear direction and the left-right direction are slightly shorter than those of each of the banknote cassette loading spaces 31SB (FIG. 5B). However, the length of the cassette casing 130 in the up-down direction is longer than that of the right side plate 34 (FIG. 5A).

A handover section 131 for handing over banknotes is provided at a position toward the rear on the upper face of the cassette casing 130. An insertion hole 131H is formed in the handover section 131. The insertion hole 131H has an elongated slit shape, with a length direction along the left-right direction. The handover section 131 transports banknotes along the up-down direction, so as to move the banknotes into and out of the cassette casing 130 in a state in which a length direction of the banknotes is oriented along the left and right, and in which the faces of the banknotes face toward the front and rear. When the lower frame 31 loaded with the banknote cassettes 17 is housed inside the safe casing 30 (FIG. 2), the handover sections 131 handover banknotes to and from the conveyance section 14 positioned at the upper side thereof, though pass-through holes formed in the safe casing 30.

A recess is formed toward the front of the upper face of the cassette casing 130, so as to run along the outer periphery of the front side and the left and right sides. A handle 132 is attached so as to fit into the recess. The handle 132 is formed overall in a shape depicting the English letter "U", with a portion running along the left-right direction at a position on the front side of the handle 132, and portions running along the front-rear direction at respective positions on the left and right sides of the handle 132.

The handle 132 is attached to the cassette casing 130 through predetermined rotation shafts in the vicinity of the rear end of portions on the left and right sides. The handle 132 is accordingly housed in the recess of the cassette casing 130 when not in use, and can easily be gripped by an operator or the like by being rotated upward and rearward by the operator or the like when in use, such that the portion running along the left-right direction of the handle 132 is pulled slightly away from the cassette casing 130.

A front door 133 is provided at the front face of the cassette casing 130. The front door 133 is configured so as to be opened and closed by swinging about the axis of a hinge provided in the vicinity of the right edge. Access can be obtained to a storage space 130S formed at the interior of the cassette casing 130 by opening the front door 133. Access to the internal space from outside the cassette casing 130 is prevented by closing the front door 133.

A lock 133L is provided to the front door 133. The lock 133L can be locked or unlocked by a predetermined key. In the cassette casing 130, the opening of the front door 133 is prevented by locking the lock 133L in a closed state of the front door 133. Opening of the front door 133 is only permitted when the lock 133L is unlocked.

A left lower indentation 134 and a right lower indentation 135 are provided at the lower side of the rear face of the cassette casing 130, toward the right and left. The left lower indentation 134 and the right lower indentation 135 are provided by indenting toward the inside from the surface of the cassette casing 130, as if respective parts of the cassette casing 130 had been scooped out in cuboidal shapes. Respective top faces 136 and 137 of the left lower indentation 134 and the right lower indentation 135 are aligned at the same height (namely, position in the up-down direction) as each other.

A positioning hole 138 is formed in the top face 136 of the left lower indentation 134. The hole diameter of the positioning hole 138, serving as a first cassette-side positioning portion, is lightly larger than the external diameter of the positioning pin 95 provided on the lower frame 31. A cassette-side connector 139 is embedded in the top face 137 of the right lower indentation 135. The cassette-side connector 139 is configured with a shape that fits together with the loading-section-side connector 98 (FIG. 11 and FIG. 12) provided to the lower frame 31, and plural connection terminals are incorporated therein.

Furthermore, a positioning groove 140 is formed in the right side face of the cassette casing 130, slightly to the rear of center in the front-rear direction, and over a range from a lower edge to about ⅔ up the cassette casing 130. The positioning groove 140, serving as another cassette-side positioning portion, is formed in a straight line shape running along the up-down direction and recessed toward the inside (namely, the left side) relative to the periphery thereof. The length of the positioning groove 140 in the front-rear direction, namely, the groove width, is slightly longer than the length in the front-rear direction of the positioning projection 62 provided to each of the right internal side plates 38 (FIG. 9A) on the lower frame 31.

Front contact ribs 141 are provided on the front side face of the cassette casing 130 and the front face of the front door 133, so as to slightly project out toward the front relative to the periphery at three locations separated from each other in the left-right direction. The front contact ribs 141 are formed so as to span a range from the vicinity of the upper edge of the cassette casing 130 to the vicinity of the lower edge thereof. The length of the front contact ribs 141 is extremely short in the left-right direction.

Similarly to on the front side face, rear contact ribs 142, similar to the front contact ribs 141, are also provided on the rear side face of the cassette casing 130, at three locations separated from each other in the left-right direction. One of the rear contact ribs 142 on the right side is formed so as to span a range from the vicinity of the upper edge of the cassette casing 130 to the upper edge of the right lower indentation 135. The other two of the rear contact ribs 142 are formed so as to span a range from the vicinity of the upper edge of the cassette casing 130 to the vicinity of the lower edge thereof.

Left contact ribs 143 similar to the front contact ribs 141 are provided on the left side face of the cassette casing 130, at two locations separated from each other in the front-rear direction and spanning a range from the vicinity of the upper edge to the vicinity of the lower edge thereof. Moreover, right contact ribs 144 similar to the front contact ribs 141 are also formed on the right side face of the cassette casing 130, at two locations separated from each other in the front-rear direction and spanning a range from the vicinity of the upper edge to the vicinity of the lower edge thereof.

Figure 13B:
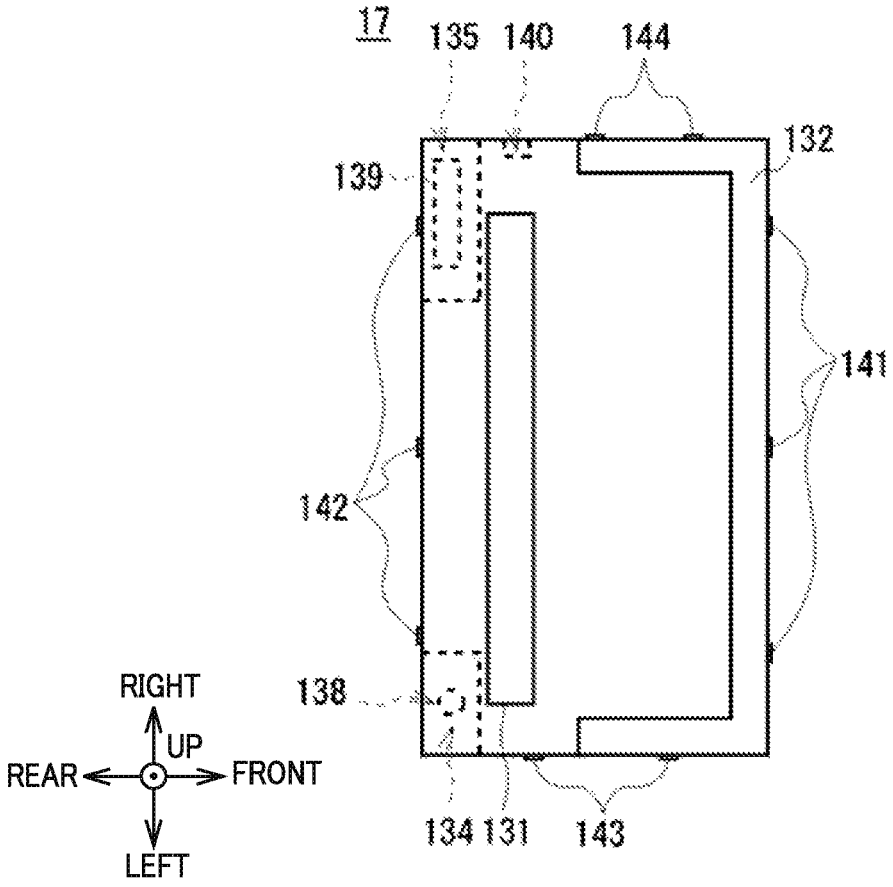
FIG. 13B is a plan view illustrating a banknote cassette loading space and a banknote cassette.

Namely, as illustrated in FIG. 13B, when the banknote cassette 17 is viewed from above, the front contact ribs 141, the rear contact ribs 142, the left contact ribs 143, and the right contact ribs 144 (referred to below collectively as a contact rib group) project slightly outward from the outer peripheral faces of the cassette casing 130.

4-2. Banknote Cassette Internal Configuration

Figure 16:
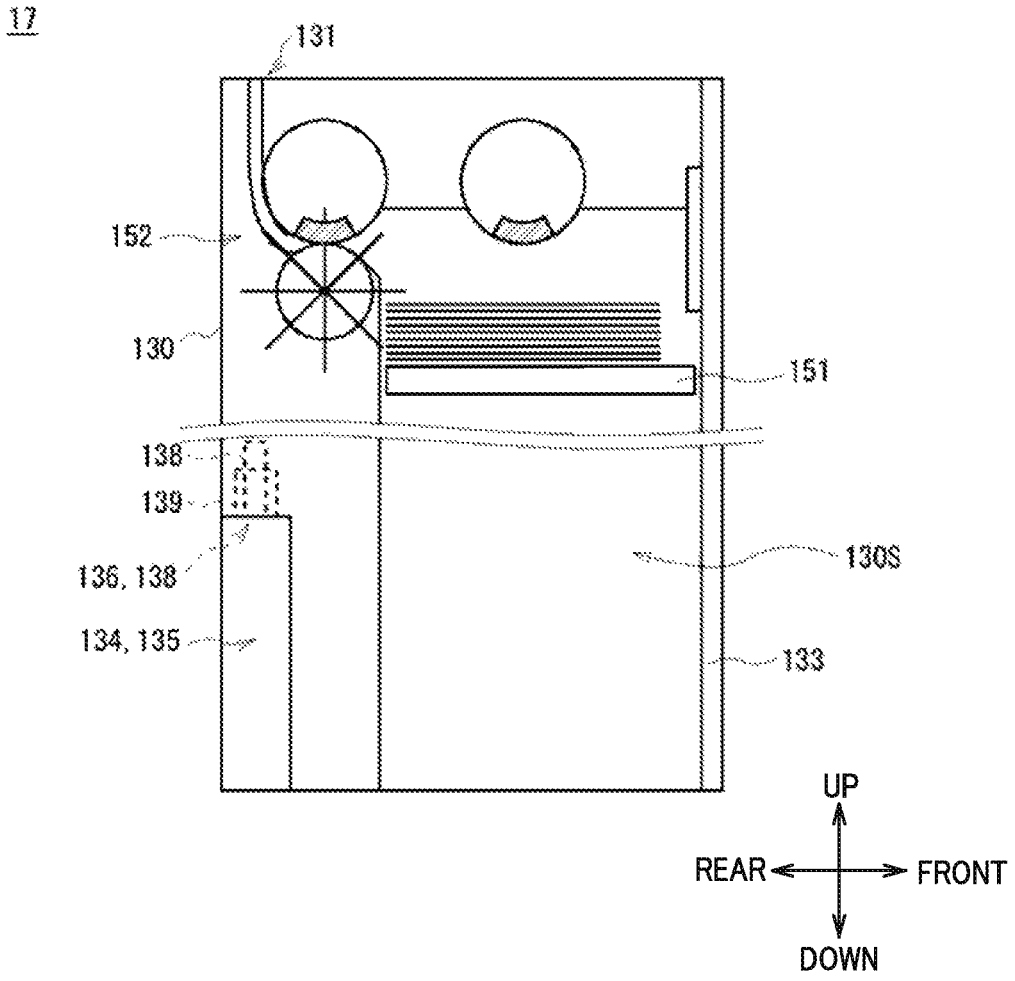
FIG. 16 is a schematic diagram illustrating internal configuration of a banknote cassette.

As illustrated schematically in the left side view of FIG. 16, the banknote cassette 17 includes the storage space 130S, which is a space for storing banknotes, at a portion toward the front of the interior of the cassette casing 130. The storage space 130S is formed in a cuboidal shape long in the up-down direction. A large quantity of banknotes, for example 3000 banknotes, can be stacked and stored in the storage space 130S. A stage 151 is provided inside the storage space 130S. The stage 151 has a sheet shape thin in the up-down direction. The stage 151 is moved in the up-down direction by a stage moving mechanism, not illustrated in the drawings, such that banknotes can be placed on an upper face of the stage 151.

Moreover, a separation/stacking section 152, for feeding out banknotes and taking in banknotes, is also provided inside the cassette casing 130 in a range spanning from the upper side of the storage space 130S to the rear side thereof. The separation/stacking section 152 is configured by a guide and plural rollers to guide banknotes, by an impeller, and the like. Each of the rollers, the impeller, and the like are rotated as appropriate by driving force from a non-illustrated motor.

For example, when taking in banknotes from the conveyance section 14 (FIG. 2) of the handover section 131, the separation/stacking section 152 conveys these banknotes forward and downward, and discharges the banknotes into the storage space 130S. The banknotes are stacked on the stage 151 by being tapped downward by the impeller. Moreover, the separation/stacking section 152 separates the banknotes one-by-one and conveys the banknotes rearward and upward by rotating each of the rollers appropriately in a state in which the stage 151 has been moved upward such that the uppermost face of the stacked banknotes is pressed against the roller above. The banknotes are thereby delivered from the handover section 131 to the conveyance section 14 (FIG. 2).

4-3. Banknote Cassette Loading

In order to load the banknote cassettes 17 into the banknote cassette loading spaces 31SB of the lower frame 31 (FIG. 5A and FIG. 5B), the operator or the like gradually lowers each of the banknote cassettes 17 from a state positioned substantially directly above the respective banknote cassette loading space 31SB, thereby loading the banknote cassette 17 from the bottom side into the interior of the banknote cassette loading space 31SB.

Figure 13C:
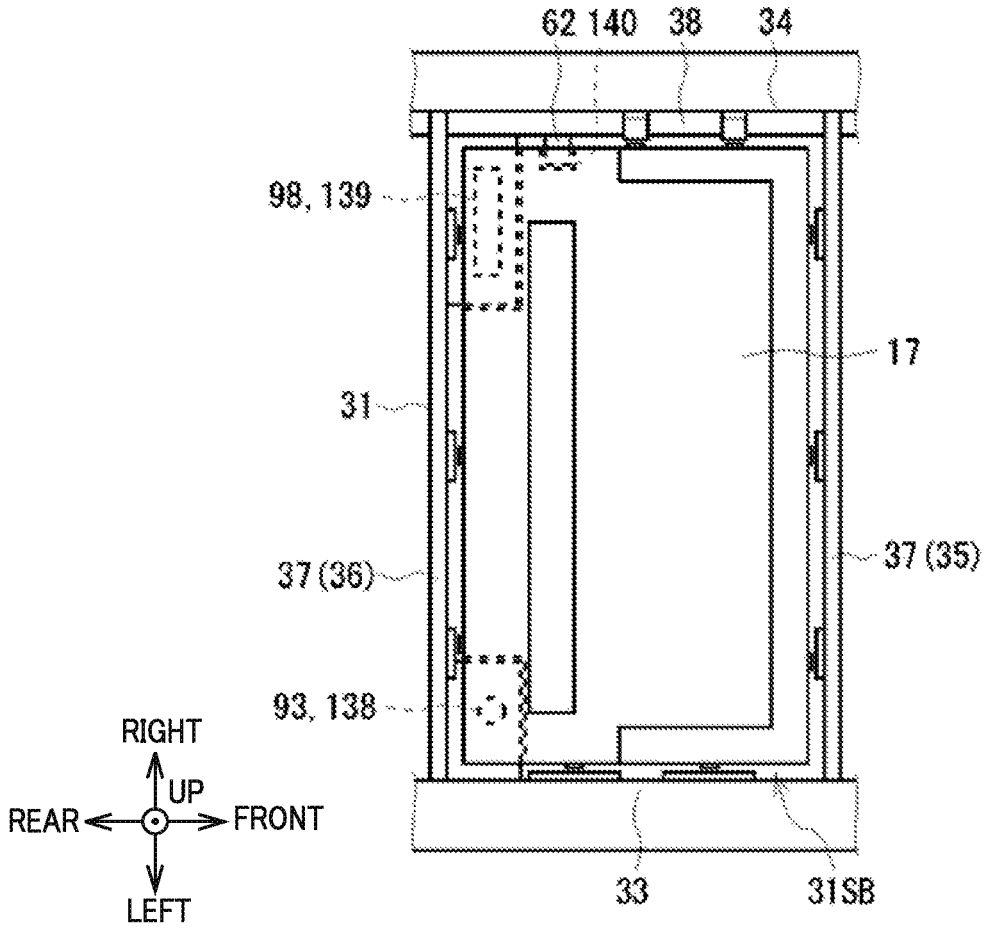
FIG. 13C is a plan view illustrating a banknote cassette loading space and a banknote cassette.

When doing so, as illustrated in FIG. 13C that corresponds to FIG. 13A and FIG. 13B, the banknote cassette 17 is roughly positioned in the front-rear direction and the left-right direction with respect to the banknote cassette loading space 31SB, first by the contact ribs such as the front contact ribs 141 in the contact rib group being placed in close proximity to or placed in contact with portions of the lower frame 31 such as the rear raised portions 77. Moreover, the position of the banknote cassette 17 in the front-rear direction with respect to the lower frame 31 at the vicinity of the right side face is aligned with high precision by the positioning projection 62 of the right internal side plate 38 entering the positioning groove 140, namely, by engagement of the positioning projection 62 and the positioning groove 140 with each other.

When this occurs, the locations where the banknote cassette 17 makes contact with the lower frame 31 side on each of the side faces at the front, rear, left, and right are only at the contact ribs such as the front contact ribs 141 in the contact rib group. There is accordingly only an extremely low possibility that scratches or the like are formed over a wide area of the flat sheet shaped portions on each of the side faces when the banknote cassette 17 is loaded into or removed from the banknote cassette loading space 31SB of the lower frame 31, and the external appearance of the banknote cassette 17 is not damaged. Moreover, contact is made with the banknote cassette 17 at each of the inside faces at the front, rear, left, and right of the lower frame 31. However, this contact is only at the raised portions 47, the rear raised portions 77, the front raised portions 87, and the contacting projections 63 and 64. Therefore, similarly to the banknote cassette 17, the lower frame 31 only has an extremely low possibility of scratches or the like being formed over a wide area of flat sheet shaped portions on each of its side plates as the banknote cassettes 17 are being loaded or removed, and the external appearance of the lower frame 31 is not damaged.

As the banknote cassette 17 is lowered further, the left lower support section 91 and the right lower support section 92 on the lower frame 31 side are caused to gradually enter the left lower indentation 134 and the right lower indentation 135, respectively. Thus, the position of the left side portion of the banknote cassette 17 is aligned in the front-rear direction and the left-right direction with respect to the lower frame 31 by the positioning pin 95 being inserted into the positioning hole 138, namely, by engagement of the positioning pin 95 with the positioning hole 138.

Figure 17:
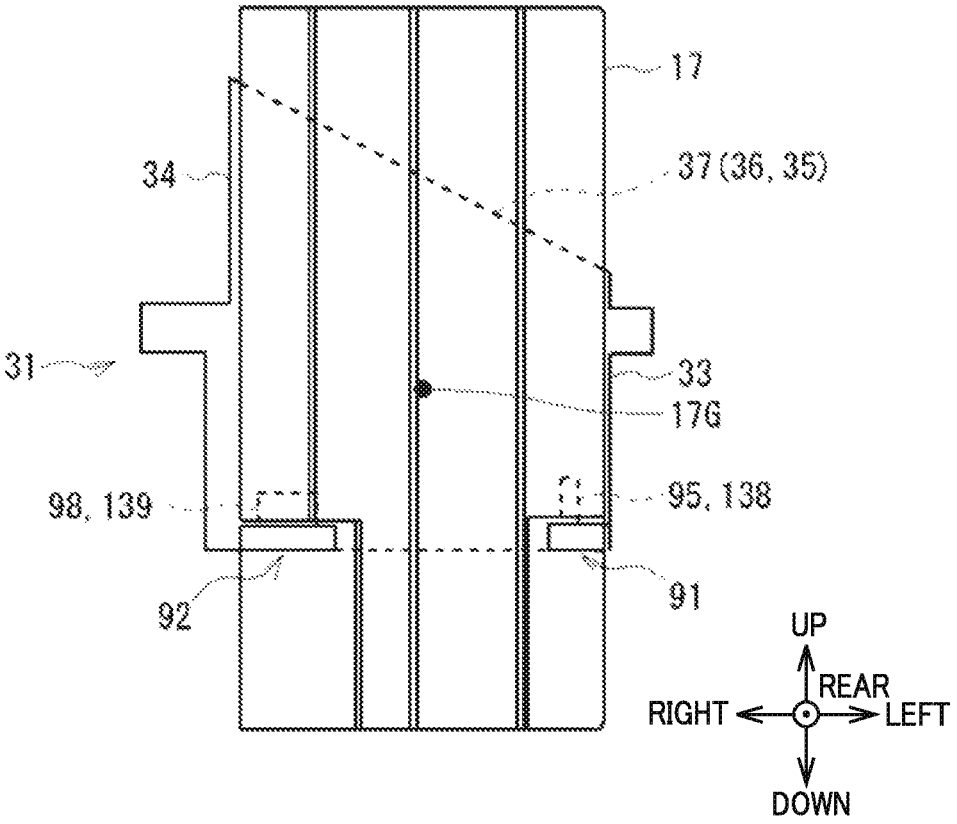
FIG. 17 is schematic diagram illustrating a loaded state of a banknote cassette in banknote cassette loading space.

Thus, as illustrated schematically in the rear view of FIG. 17, in the banknote cassette 17, the top face 136 of the left lower indentation 134 is placed in contact with the upper face portion 93 of the left lower support section 91, and the top face 137 of the right lower indentation 135 is placed in contact with the upper face portion 96 of the right lower support section 92. The load of the banknote cassette 17 is thereby supported by the left lower support section 91 and the right lower support section 92 in a state in which the bottom end of the banknote cassette 17 projects further downward than the lower end of the lower frame 31.

However, since the banknote cassette 17 is only supported from the lower side by the top face 136 of the left lower indentation 134 and the top face 137 of the right lower indentation 135 at positions on the rear side of the center of gravity of the banknote cassette 17, force acts to attempt to tilt an upper side portion of the banknote cassette 17 forward. However, due to the positioning projection 62 that is long in the up-down direction being inside the positioning groove 140 that is long in the up-down direction, the banknote cassette 17 can be prevented from tilting under this force, and can be maintained in an orientation in which the upper face of the banknote cassette 17 faces substantially straight up.

Moreover, in the banknote cassette 17, the cassette-side connector 139 is fitted together with the loading-section-side connector 98 on the lower frame 31 side when this is performed, so as to electrically connect the terminal groups together. The banknote cassette 17 is thereby able to receive power supplied from the lower frame 31 side, and various electrical signals can be sent to and received from the banknote controller 12 (FIG. 2).

When the banknote cassette 17 has been loaded into the banknote cassette loading space 31SB of the lower frame 31, the center of gravity 17G of the banknote cassette 17 is at a position lower than the reinforcement portions such as the reinforcement portion 42.

5. Reject Cassette Configuration and Loading

Figure 18A:
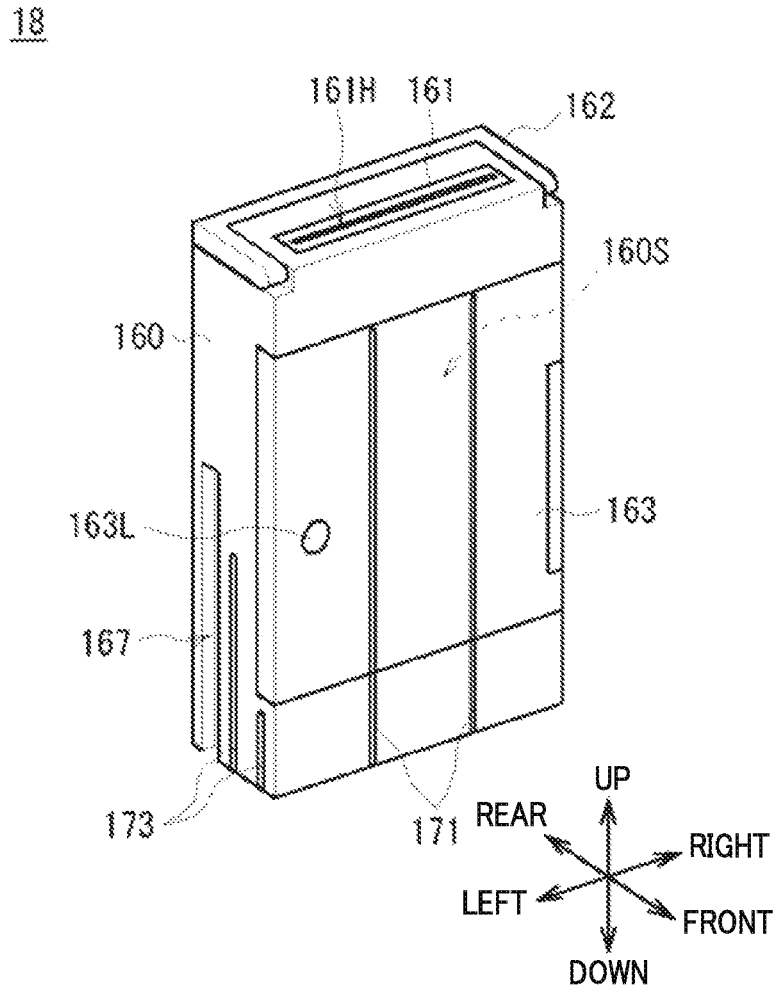
FIG. 18A is schematic perspective view illustrating a configuration of a reject cassette.
Figure 18B:
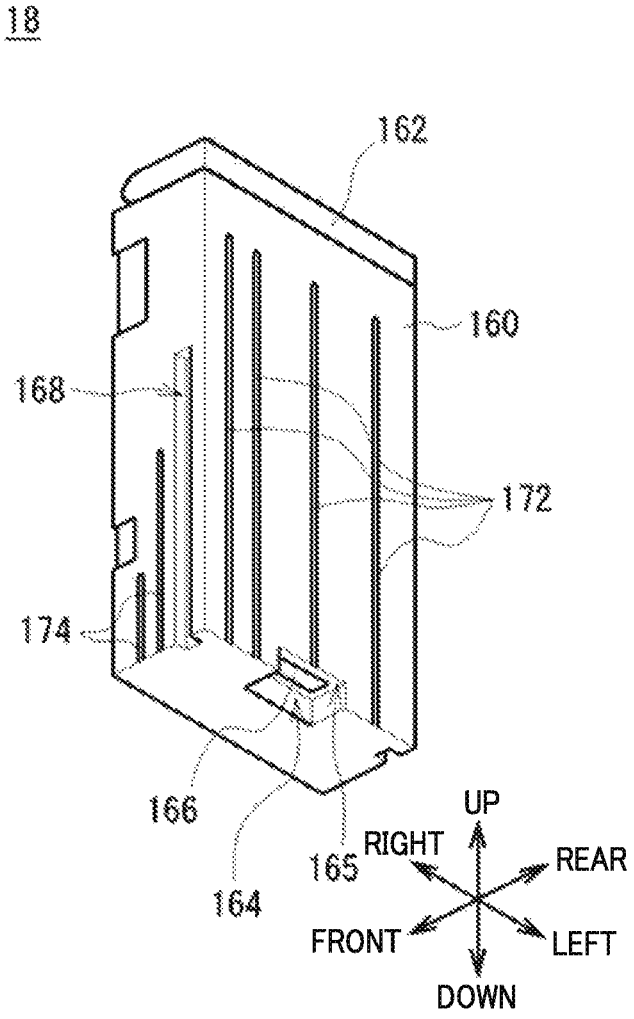
FIG. 18B is a schematic perspective view illustrating a configuration of a reject cassette.

Explanation follows regarding the reject cassette 18. As illustrated in FIG. 18A and FIG. 18B, corresponding to FIG. 15A and FIG. 15B, the reject cassette 18 has a configuration approximately the same as the banknote cassettes 17, however, part of the reject cassette 18 is configured differently.

Specifically, the reject cassette 18 includes a cassette casing 160, a handover section 161, an insertion hole 161H, a handle 162, a front door 163, and a lock 163L, corresponding to the cassette casing 130, the handover section 131, the through hole 131H, the handle 132, the front door 133, and the lock 133L of the banknote cassette 17. The handle 162 is configured with front-rear symmetry to the handle 132.

The cassette casing 160 is substantially the same as the cassette casing 130 in length in the left-right direction; however, the cassette casing 160 is about ½ the length in the front-rear direction, and is about ¾ to ⅘ the length in the up-down direction. The lengths of the cassette casing 160 in the front-rear direction and the left-right direction are slightly shorter than those of the reject cassette loading space 31SR (FIG. 5B). However, the length of the cassette casing 160 in the up-down direction is longer than the length of the right side plate 34 (FIG. 5A).

A lower indentation 164 is provided instead of the left lower indentation 134 and the right lower indentation 135 of the banknote cassette 17, as if part of the cassette casing 160 in the vicinity of the center at the lower side of the rear face of the cassette casing 160 had been scooped out in a cuboidal shape. A cassette-side connector 166, corresponding to the cassette-side connector 139, is embedded in a top face 165 of the lower indentation 164. The cassette-side connector 166 is configured with a shape that fits together with the loading-section-side connector 128 provided to the lower frame 31 (FIG. 5B and FIG. 14A), and incorporates plural connection terminals.

Furthermore, positioning grooves 167 and 168, corresponding to the positioning grooves 140 (FIG. 15A, FIG. 15B), are respectively formed toward the rear in the left side face and the right side face of the cassette casing 160, over a range from a lower edge to about ⅔ up the cassette casing 160. The positioning grooves 167 and 168 are recessed toward the inside (namely, the right side or the left side) with respect to the periphery thereof, and are each formed in a straight line shape running along the up-down direction. The length of the positioning grooves 167 and 168 in the front-rear direction, namely the groove width, is slightly longer than the length in the front-rear direction of positioning projections 124, 125, and 126 provided to the reject loading section 39 (FIG. 5B) on the lower frame 31.

Front contact ribs 171, rear contact ribs 172, left contact ribs 173, and right contact ribs 174, corresponding to the front contact ribs 141, rear contact ribs 142, left contact ribs 143, and right contact ribs 144 of the cassette casing 130, are provided on the front side face, rear side face, left side face, and right side face of the cassette casing 160. However, the numbers of the front contact ribs 171, the rear contact ribs 172, the left contact ribs 173, and the right contact ribs 174 on the cassette casing 160, and the positions and sizes thereof, differ from those of the cassette casing 130.

Figure 14B:
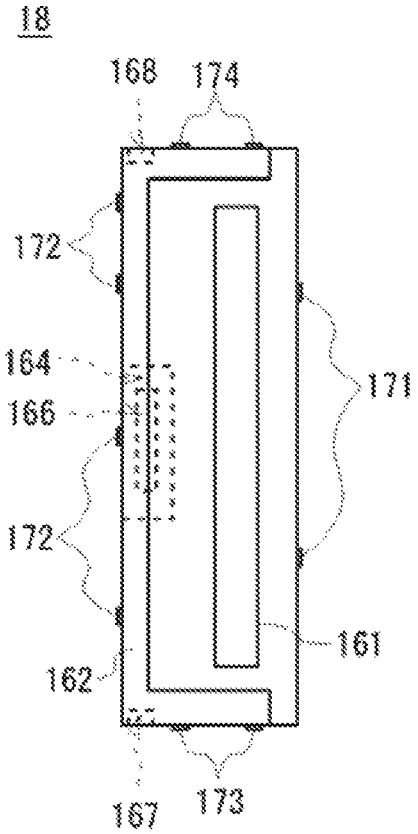
FIG. 14B is a plan view illustrating a reject cassette loading space and a reject cassette.

Namely, when the reject cassette 18 is viewed from above as illustrated in FIG. 14B, corresponding to FIG. 13B, similarly to the banknote cassette 17, the front contact ribs 171, the rear contact ribs 172, the left contact ribs 173, and the right contact ribs 174 (referred to below collectively as a contact rib group) project slightly outward from the outer peripheral face of the cassette casing 160.

Figure 14C:
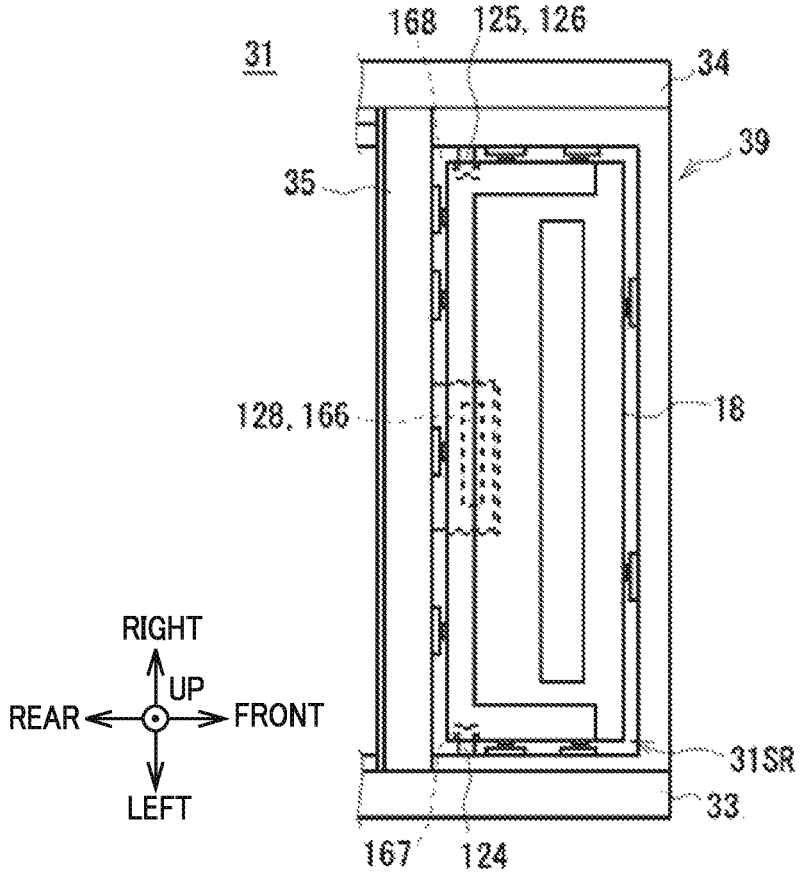
FIG. 14C is a plan view illustrating a reject cassette loading space and a reject cassette.

In order to load the reject cassette 18 into the reject cassette loading space 31SR of the lower frame 31 (FIG. 5B), similarly to the banknote cassette 17, the operator or the like gradually lowers the reject cassette 18 from a state positioned substantially directly above the reject cassette loading space 31SR. When doing so, as illustrated in FIG. 14C, corresponding to FIG. 14A and FIG. 14B, the reject cassette 18 is roughly positioned in the front-rear direction and the left-right direction with respect to the reject cassette loading space 31SR, first by the contact ribs such as the front contact ribs 171 in the contact rib group being placed in close proximity to or placed in contact with each of the raised portions 129 of the lower frame 31.

Moreover, the position in the front-rear direction of the reject cassette 18 with respect to the lower frame 31 is aligned with high precision at the vicinity of the left side face and at the vicinity of the right side face by the positioning projections 124, 125 and 126 entering the positioning grooves 167 and 168.

Specifically, the position of the reject cassette 18 in the front-rear direction with respect to the lower frame 31 at the vicinity of the right side face is first aligned by the positioning projection 124 entering the positioning groove 168 on the right side. The position of the reject cassette 18 in the front-rear direction with respect to the lower frame 31 is then aligned at the vicinity of the left side face by the positioning projection 126 entering the positioning groove 167 on the left side. When doing so, due to the positioning projections 124 and 126 entering the left and right positioning grooves 167 and 168, the reject cassette 18 is also aligned in position in the left-right direction with respect to the lower frame 31. Moreover, due to the positioning projection 125 entering the positioning groove 168 on the right side, the reject cassette 18 is restricted from tilting in the front-rear direction, namely the reject cassette 18 is restricted from rotating about an axis running along the left-right direction.

Moreover, similarly to the banknote cassette 17, the locations where the reject cassette 18 contacts the lower frame 31 side on each of the side faces at the front, rear, left, and right are only at the contact ribs such as the front contact ribs 171 of the contact rib group. Therefore, similarly to with the banknote cassette 17, the reject cassette 18 accordingly only has an extremely low possibility that scratches or the like are formed over a wide area of the flat sheet shaped portions on each of the side faces and each portion on the lower frame 31 side when the reject cassette 18 is being loaded or removed, and the external appearance is accordingly not damaged.

By further lowering the reject cassette 18, the lower support section 127 on the lower frame 31 side enters the lower indentation 164, and thereby, similarly to as illustrated in FIG. 17 for the banknote cassette 17, the top face 165 of the lower indentation 164 is placed in contact with the upper face of the lower support section 127, and the load of the reject cassette 18 is supported by the lower support section 127.

When this is performed with the reject cassette 18, the cassette-side connector 166 fits together with the loading-section-side connector 128 on the lower frame 31 side, such that the respective terminal groups are electrically connected. The reject cassette 18 is thereby able to receive power supplied from the lower frame 31 side, and moreover various electrical signals can be sent to or received from the banknote controller 12 (FIG. 2) and the like. By power received from the lower frame 31 side being supplied to a non-illustrated motor in the reject cassette 18, non-illustrated rollers etc. can be appropriately rotated so as to enable banknotes to be taken inside the reject cassette 18.

6. Advantageous Effects Etc.

In the configuration described above, the banknote pay-in/pay-out machine 10 of the automated teller machine 1 is configured so as to enable the plural banknote cassettes 17 and the reject cassette 18 to be attached to or removed from the lower frame 31 in the lower unit 10L. Configuration is also made such that the lower frame 31 loaded therewith is able to be slid in the front-rear direction with respect to the safe casing 30 using the side rails 32. Moreover, the lower frame 31 is open at the lower face side in addition to at the upper face side where the banknote cassettes 17 and the reject cassette 18 are loaded or removed. When loaded, the vicinity of the lower ends of the banknote cassettes 17 and the reject cassette 18 project out downward further than the lower end of the lower frame 31 (FIG. 2, FIG. 4, FIG. 5A, and FIG. 17).

Thus in the banknote pay-in/pay-out machine 10, the side plates at the front, rear, left, and right can be shortened in the up-down direction compared to cases in which a bottom face plate is provided and each of the side plates of the lower frame 31 extend as far as positions where the lower face of the banknote cassettes 17 is supported, as in Patent Document 1. This enables the amount of sheet metal employed to be reduced, and a reduction in weight to be achieved. Accompanying this effect, slide rails having a smaller load limit and a simple configuration can be employed for the side rails 32 in the banknote pay-in/pay-out machine 10. This enables a reduction in fabrication cost, and enables a more compact device to be achieved overall. Furthermore, in the banknote pay-in/pay-out machine 10, accompanying the reduction in weight of the lower frame 31, the amount of force an operator or the like needs to apply in order to slide the lower frame 31 can also be reduced, enabling the ease of operation to be improved for maintenance work or the like.

In the lower frame 31, the left side plate 33, the right side plate 34, the front side plate 35, and the rear side plate 36 are also all configured from sheet metal, and the reinforcement portions 42, 52, 72, and 82 are formed by appropriately bending these side plates (FIG. 7A and FIG. 7B, FIG. 9A to FIG. 9C, FIG. 10A and FIG. 10B, and FIG. 11).

Figure 19A:
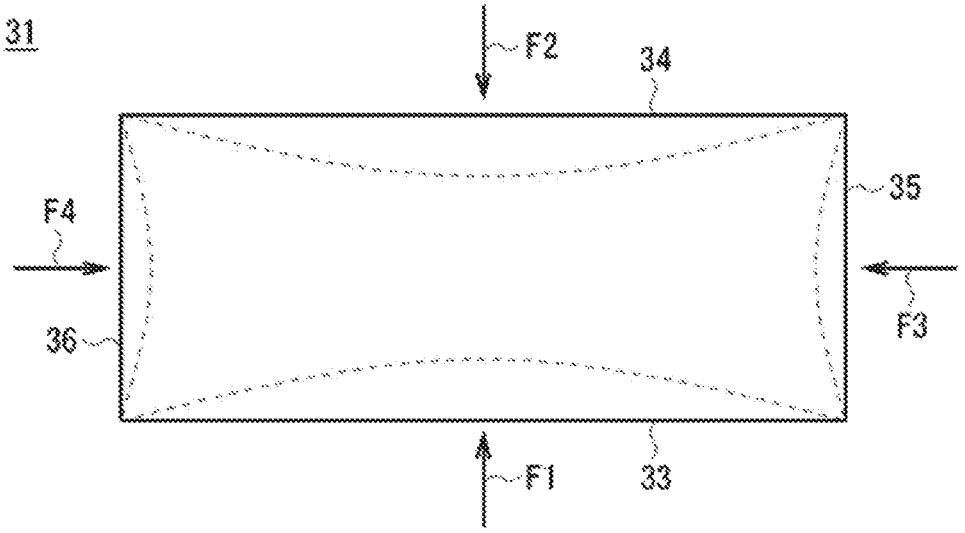
FIG. 19A is a schematic plan view illustrating warping and shear of a lower frame due to external force.

In cases in which the lower frame 31 was not formed with the reinforcement portions on the left side plate 33, the right side plate 34, the front side plate 35, and the rear side plate 36, namely, when configured by flat sheet shapes, there was a possibility of a large degree of warping when external forces F1, F2, F3, and F4 are applied to each of the side faces, as illustrated by the broken lines in FIG. 19A. In contrast thereto, in the actual lower frame 31, due to the reinforcement portions being respectively formed to each of the left side plate 33, the right side plate 34, the front side plate 35, and the rear side plate 36, the flexural strength of each can be raised significantly, enabling the shape to be maintained and warping to be prevented from occurring even if external forces F1 etc. are applied.

In the lower frame 31, the reinforcement portions such as the reinforcement portion 42 are formed by bending a portion of the left side plate 33 and not by attaching another components to the left side plate 33. Thus, in the banknote pay-in/pay-out machine 10, the number of components of the lower frame 31 can be suppressed to a minimum, and the number of processes required to assemble the lower frame 31 can also be suppressed to a minimum, enabling the fabrication cost to be suppressed to a moderate cost.

Moreover, in the lower frame 31, the reinforcement portions (for example, the reinforcement portion 42 and the reinforcement portion 82) are fastened (FIG. 8B and FIG. 8C) by fastening adjacent side plates (for example, the left side plate 33 and the rear side plate 36 etc.) together at four locations at the left rear, left front, right rear, and right front. Moreover, when fastening the reinforcement portions together in the lower frame 31 at pairs of orthogonal faces, such as the left face portion 45 and the upper face portion 44 of the reinforcement portion 42, the overlapped sheet metal is fastened together by clinching the rivets R.

Figure 20:
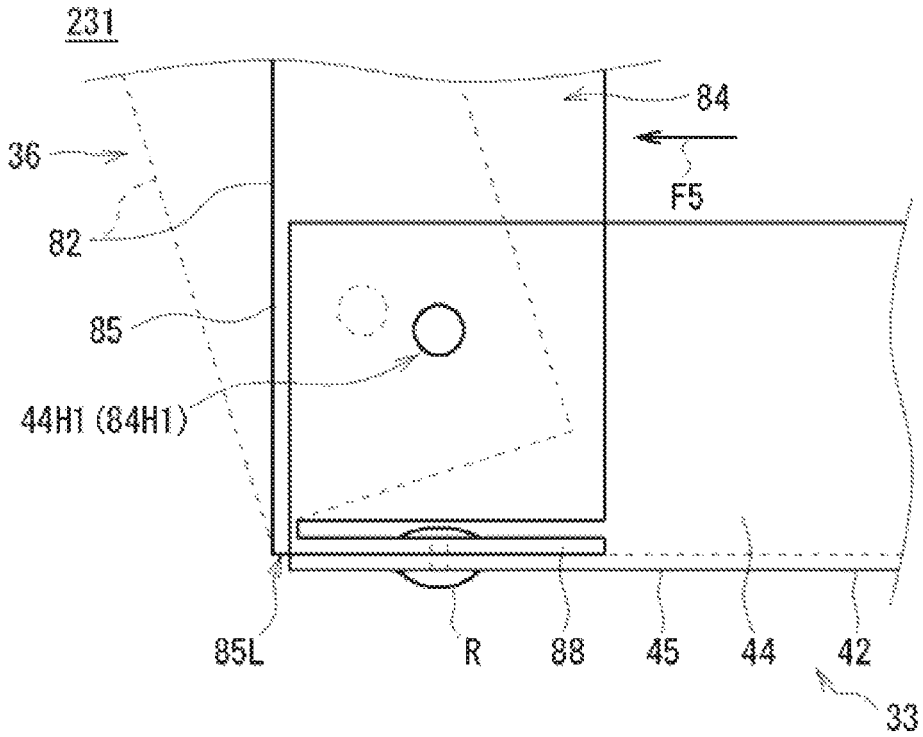
FIG. 20 is a schematic diagram illustrating the occurrence of shear at a fastening portion of a hypothetical reinforcement portion.

Consider a hypothetical lower frame 231 as illustrated in FIG. 20, corresponding to the lower frame 31. In the hypothetical lower frame 231, an upper face portion 44 of a reinforcement portion 42 on a left side plate 33 and an upper face portion 84 of a reinforcement portion 82 on a rear side plate 36 are not fixed together by rivets R. Thus, in the lower frame 231, when an external force F5 is applied to the rear side plate 36, as illustrated by the broken lines, there is a concern that the rear side plate 36 might pivot with respect to the left side plate 33 about a bend location 85L, which is a location where the left face portion 88 is bent with respect to the rear face portion 85.

Figure 19B:
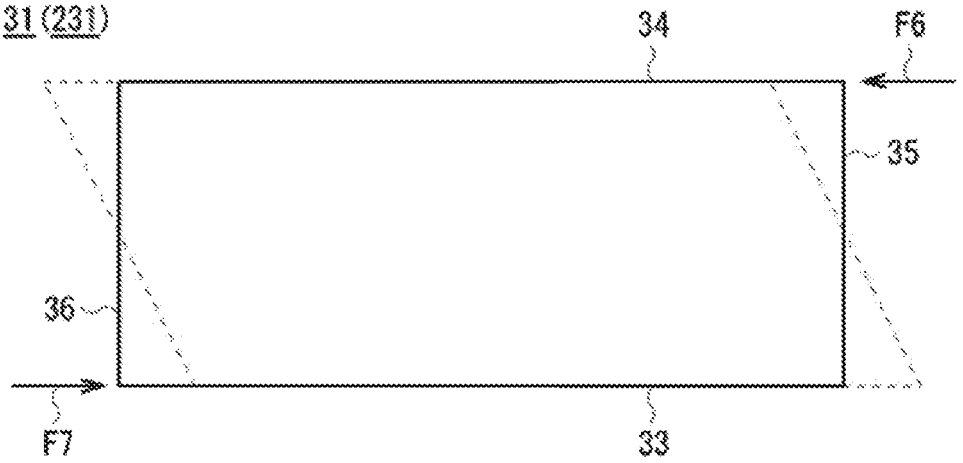
FIG. 19B is a schematic plan view illustrating warping and shear of a lower frame due to an external force.

Thus in the lower frame 231, as illustrated by the broken lines in FIG. 19B, when external forces F6 and F7 are applied from outside in a shear direction, there is a concern regarding deformation such that the lower frame 231 transitions from having a rectangular shape overall to having a parallelogram shape. Namely, a concern that each of the banknote cassette loading spaces 31SB is deformed such that the banknote cassette 17 is no longer able to be loaded correctly therein.

With regard to this point, in the actual lower frame 31, the fixing holes 44H1 and 84H1 are respectively formed in the upper face portion 44 of the reinforcement portion 42 and to the upper face portion 84 of the reinforcement portion 82, so as to let the rivets R be inserted therein and clinched (FIG. 8B and FIG. 8C). Thus even when the external forces F6 and F7 are applied to the lower frame 31 in the shear direction as illustrated in FIG. 19B, due to being able to maintain the shape illustrated by the solid lines, each of the banknote cassette loading spaces 31SB is not deformed, and a state can be maintained that enables the banknote cassettes 17 to be loaded therein.

The reinforcement portions such as the reinforcement portion 42 in the lower frame 31 are disposed at positions higher than the center of gravity 17G when the banknote cassettes 17 have been loaded into the banknote cassette loading spaces 31SB (FIG. 17). Thus, in the lower frame 31, the lower frame 31 can be reinforced as a whole by the reinforcement portion 42 that is relatively close to the handover section 131 of each of the banknote cassettes 17 when loaded. This enables unwanted movement of the banknote cassettes 17 when subjected to vibration or the like to be effectively suppressed, and in particular enables positional misalignment between the handover sections 131 and the conveyance section 14 (FIG. 2) to be effectively suppressed.

Furthermore, in the lower frame 31, the wiring members for connecting to the loading-section-side connector 98 etc. are accommodated inside the reinforcement space 52S (FIG. 9B) formed to the reinforcement portion 52 of the right side plate 34. Thus, in the banknote pay-in/pay-out machine 10, even in an exposed state in which the lower frame 31 is pulled out to the rear of the safe casing 30, the wiring member can be protected by the reinforcement portion 52. This enables damage, breakage and the like of the wiring members due to contact with foreign matter to be prevented.

Moreover, in the lower frame 31, the loading-section-side connector 98 is provided inside the banknote cassette loading space 31SB (FIG. 13A). To interface therewith, the banknote cassette 17 includes the cassette-side connector 139 (FIG. 13B, and FIG. 15A and FIG. 15B) provided on the top face 137 of the right lower indentation 135, which is formed as if part of cassette casing 130 had been formed as a substantially cuboidal shape and then scooped out.

There is accordingly no need in the banknote pay-in/pay-out machine 10 to dispose the cassette-side connector 139 outside the cassette casing 130 of the banknote cassette 17. This enables the cassette casing 130 to be formed in a cuboidal shape since there is no need to provide a portion that projects outside the cassette casing 130. Thus, in the banknote pay-in/pay-out machine 10, in cases in which plural of the banknote cassettes 17 are taken out from the lower frame 31 and stacked together, due to being able to arrange the banknote cassettes 17 such that their side faces are in close contact with each other, the floor space and volume required for storage can be suppressed to a minimum, and safe stacking can be achieved. Moreover, in the banknote pay-in/pay-out machine 10, due to the weight also being suppressed as the volume of the banknote cassettes 17 is suppressed, the ease of operation can be improved when being transported by an operator or the like.

As viewed from another perspective, the banknote cassette 17 includes the separation/stacking section 152 provided inside the cassette casing 130 over a range spanning from the upper side to the rear side thereof, with the storage space 130S and is formed comparatively toward the front (FIG. 16). In the banknote cassette 17, the size of the storage space 130S is determined according to the size of the banknotes and the number of banknotes to be stored. The position of the separation/stacking section 152 with respect to the storage space 130S is also determined thereby, and so it is difficult to change the size and positions thereof.

Thus in the banknote cassette 17, suppose that the cassette-side connector 139 were to be provided on the left and right side faces and the front face, then the size of the cassette casing 130 would have to be further enlarged since the cassette-side connector 139 would have to be disposed outside the storage space 130S. Moreover, suppose that the cassette-side connector 139 was provided on a bottom face of the banknote cassette 17, then a need would arise to extend the lower frame 31 side downward, leading to an increase in weight.

Moreover, even though generally for the banknote pay-in/pay-out machine 10, the size of the device overall, for example, the length in the front-rear direction, is determined by limitations of the installation location and the like, there is still a desire to house as many banknotes as possible therein. Thus, in cases in which a layout employed is one in which the banknote cassettes 17 are arranged in a line along the front-rear direction with respect to the lower frame 31, it is desirable to suppress the length of the banknote cassettes 17 in the front-rear direction to as short as possible, so as to secure the greatest number of banknote cassettes 17 loaded into the lower frame 31.

Thus, the right lower indentation 135 is formed to a portion at the lower side of the separation/stacking section 152 on the rear face of each of the banknote cassettes 17, and the cassette-side connector 139 is disposed on the top face 137. This enables the banknote cassettes 17 to contain the cassette-side connector 139 inside the space already formed at the rear side of the storage space 130S, such that no enlargement of the cassette casing 130 is required. Moreover, by disposing the cassette-side connector 139 at a location separated by a certain amount toward the upper side from the lower end of the banknote cassette 17, there is no need to extend the lower frame 31 side downward, enabling a contribution to be made to a reduction in weight.

On the other hand, in the lower frame 31, the right lower support sections 92 (FIG. 11 and FIG. 12) are provided in the vicinity of the lower edge of the divider plates 37 and the rear side plate 36. Thus in the banknote cassettes 17, the height of the right lower indentation 135, namely the distance from the lower edge to the top face 137, can be suppressed to a minimum. This enables the volume to be suppressed to a minimum for the portion of the banknote cassette 17 where the right lower indentation 135 is formed as if the cassette casing 130 had been scooped out, enabling sufficient space to be secured to accommodate other components, such as a circuit board, mechanism components, and the like.

Moreover, the left lower indentation 134 is provided at a location in the banknote cassette 17 on the opposite side to the right lower indentation 135 in the left-right direction, and the positioning hole 138 is formed in the top face 136 of the left lower indentation 134. Thus, when each of the banknote cassettes 17 has been loaded into the banknote cassette loading space 31SB, the top faces 136 and 138 of the left lower indentation 134 and the right lower indentation 135 are placed in contact with the upper face portions 93 and 96 of the left lower support section 91 and the right lower support section 92, enabling the banknote cassette 17 to be supported thereby. The banknote cassette 17 is accordingly supported at both sides of the center of gravity in the left-right direction, enabling swaying in the left-right direction to be prevented, and enabling banknotes to be stably handed over between the handover section 131 and the conveyance section 14 (FIG. 2).

Furthermore, in each of the banknote cassettes 17, the positioning pin 95 of the left lower support section 91 is inserted into the positioning hole 138, and the positioning projection 62 of the right internal side plate 38 enters the positioning groove 140 provided on the right side face (FIG. 13A to FIG. 13C). This enables the banknote cassette 17 to be positioned with high precision with respect to the banknote cassette loading spaces 31SB in the front-rear direction and the left-right direction, and also enables the banknote cassette 17 to be effectively prevented from tilting forwards.

Due to the configuration described above, in the banknote pay-in/pay-out machine 10 of the automated teller machine 1, the upper face and the lower face of the lower frame 31 are open, and the loading-section-side connectors 98 are disposed inside the banknote cassette loading spaces 31SB. Thus, in the banknote pay-in/pay-out machine 10, the side plates at the front, rear, left, and right of the lower frame 31 can be shorter in the up-down direction relative to hitherto, enabling a reduction in weight, and achieving a simplification of components and an improvement in operability. Moreover, in the banknote pay-in/pay-out machine 10, there is no need to provide a portion projecting outside the cassette casing 130 in the banknote cassettes 17, and the cassette casing 130 can accordingly be formed in a cuboidal shape. This enables the configuration thereof to be simplified, and enables easy handling thereof by an operator or the like.

7. Other Exemplary Embodiments

Figure 26:
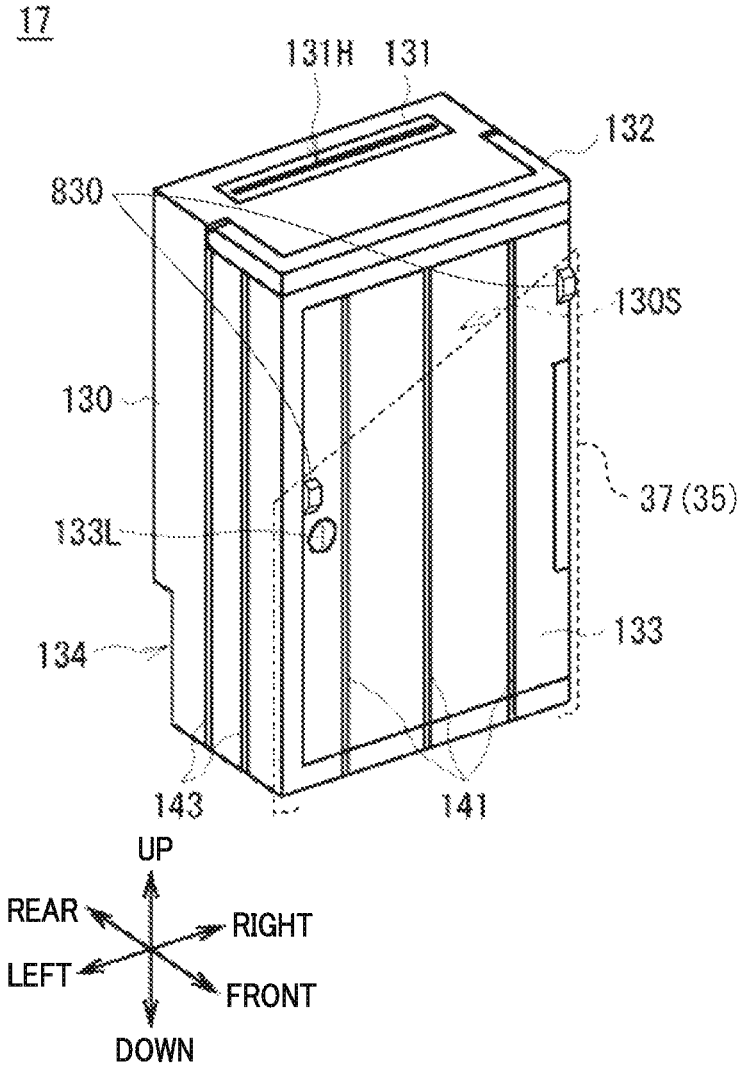
FIG. 26 is a schematic perspective view illustrating a configuration of a contact face of another exemplary embodiment.
Figure 27:
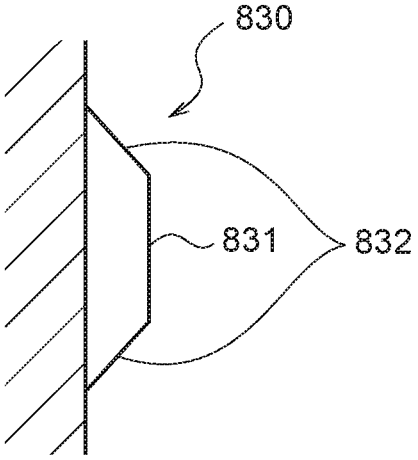
FIG. 27 is a side view illustrating a configuration of a contact face of another exemplary embodiment.
Figure 28A:
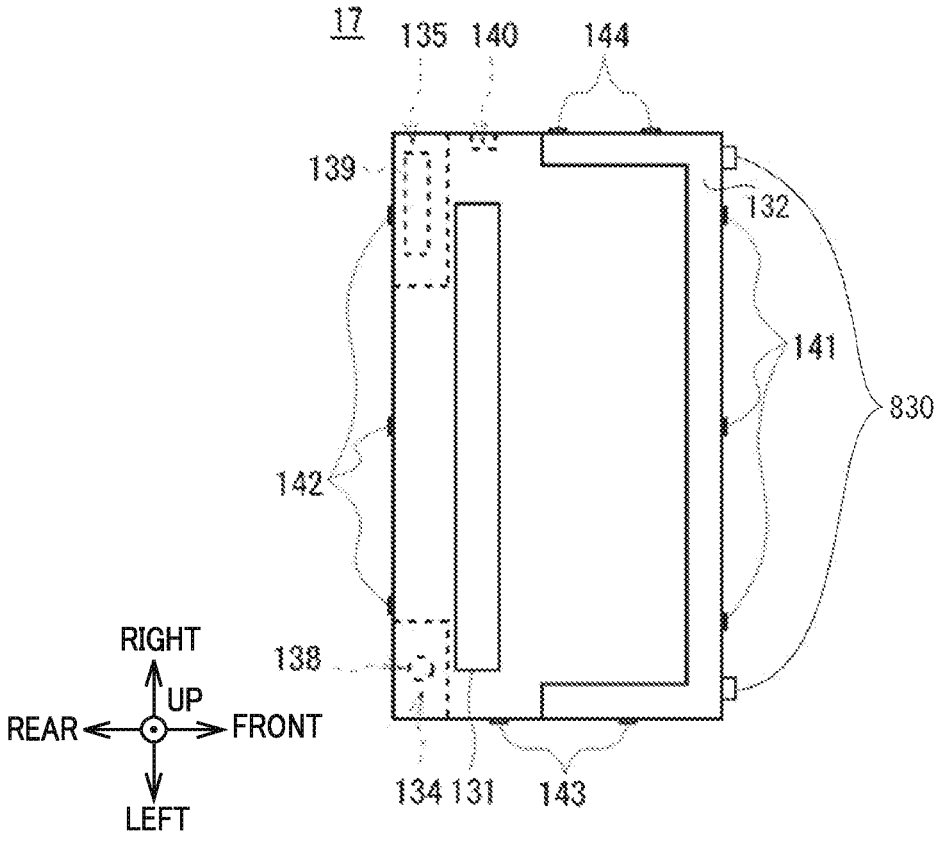
FIG. 28A is a plan view illustrating a configuration of contact faces of another exemplary embodiment.
Figure 28B:
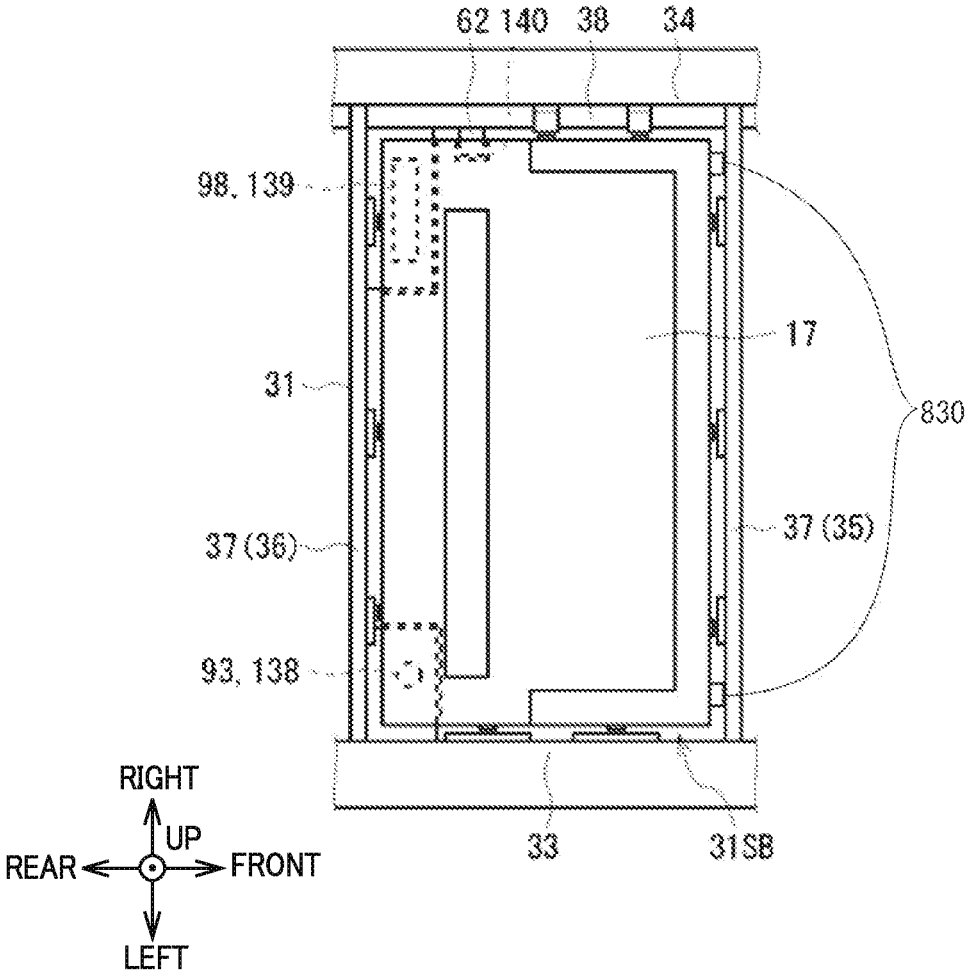
FIG. 28B is a plan view illustrating a configuration of contact faces of another exemplary embodiment.

Note that in the exemplary embodiment described above, as illustrated in FIG. 15B, the left lower indentation 134 and the right lower indentation 135 are formed to the rear face of each of the banknote cassettes 17. As illustrated in FIG. 17, the banknote cassettes 17 are retained (hung) by the positioning hole 138 provided to the top face 136 of the left lower indentation 134 and the cassette-side connector 139 provided to the top face 137 of the right lower indentation 135, fitting together with the positioning pin 95 and the loading-section-side connector 98 (FIG. 12) provided on the side face of the respective divider plates 37. In such cases, the positioning pin 95 and the loading-section-side connector 98 fit together at the rear and lower side of the center of gravity of each of the banknote cassettes 17. There is accordingly a possibility that the banknote cassette 17 tilts in a clockwise direction about the center of gravity, namely toward the front side. As illustrated in FIG. 26, FIG. 28A, and FIG. 28B, contact faces 830 to contact the divider plates 37 may be formed on the front door 133, this being a side face of the banknote cassette 17, so as to restrict the housing position of the banknote cassettes 17. Positioning the banknote cassettes 17 using a position near to handover ports (the handover sections 131) results in higher precision. Thus, the contact faces 830 may be formed at positions that contact the upper edge of the divider plate 37. Moreover, in order to reduce the effect of manufacturing differences in the lower frame 31, including in the divider plates 37 etc., the contact faces 830 may be formed at both left-right direction edges of the front face of each of the banknote cassettes 17. Note that the contact faces 830 may each be formed in a tapered shape having a flat face portion 831 to contact the divider plate 37 and inclined face portions 832 inclined from a front face side of the banknote cassette 17 toward the up-down direction edges of the flat face portion 831, so as to form in trapezoidal shape in cross-section viewed from the side, as illustrated in FIG. 27. In such cases, the flat face portion 831 of the contact face 830 contacts the divider plate 37 so as to position the banknote cassette 17, and impact with the upper edge face of the divider plate 37 can be avoided due to providing the inclined face portions 832 at the up-down direction edges of the flat face portion 831. By forming such contact faces 830 on the front door 133 side of each of the banknote cassettes 17, the banknote cassette 17 can be prevented from tilting, and positioning can be performed at high precision between the handover port (the handover section 131) of the banknote cassette 17 and the handover port of the conveying path.

Figure 21A:
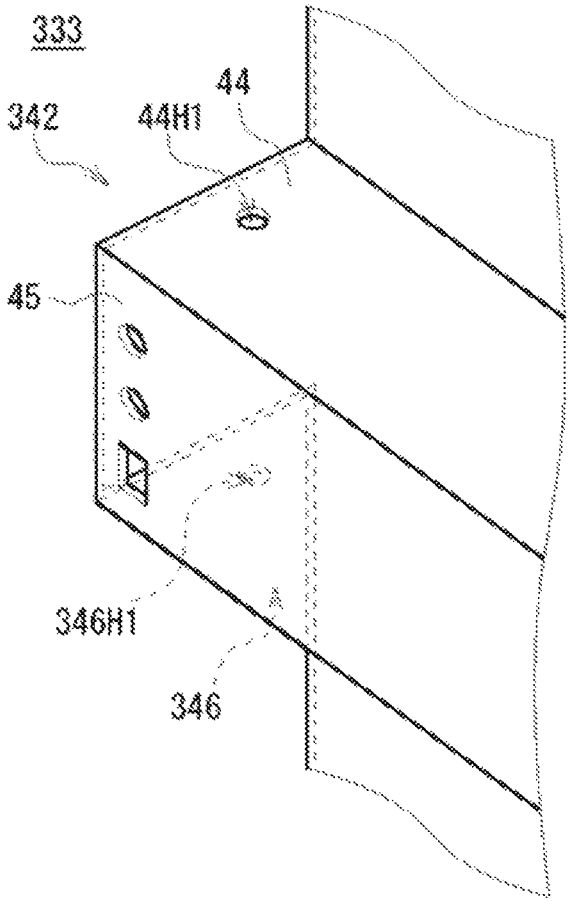
FIG. 21A is a schematic perspective view illustrating a configuration of a reinforcement portion of another exemplary embodiment.
Figure 21B:
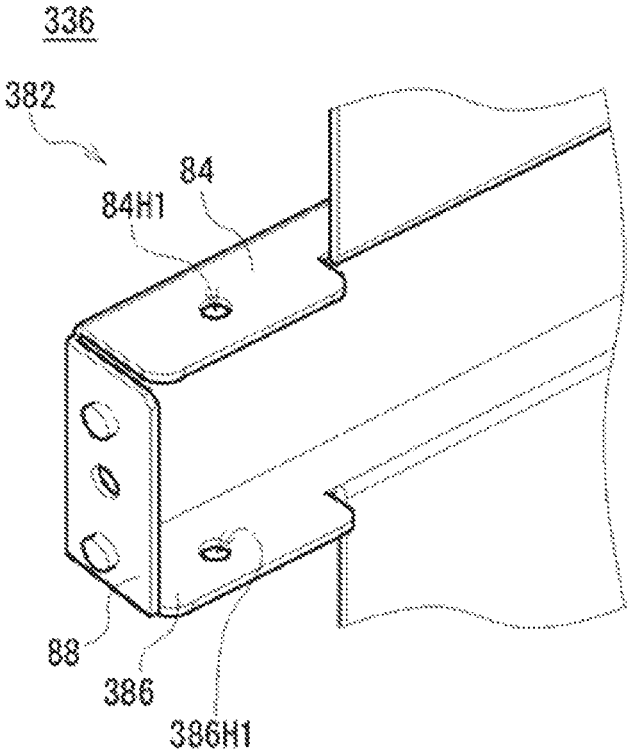
FIG. 21B is a schematic perspective view illustrating a configuration of a reinforcement portion of another exemplary embodiment.

Note that in the exemplary embodiment described above, a case has been explained in which, when fastening the reinforcement portions such as the reinforcement portion 42 of the lower frame 31, sheet metal is fastened together at two mutually orthogonal faces, for example at the left face portions and the upper face portions, by clinching the rivets R (FIG. 8B and FIG. 8C). However, the present invention is not limited thereto and, for example, fixing holes 346H1 and 386H1 may be respectively added to lower face portions 346 and 386 at a left rear portion of the lower frame 31 such as the left side plate 333 and the rear side plate 336 illustrated in FIG. 21A and FIG. 21B, and rivets R (not illustrated in the drawings) inserted through both lower face portions 346 and 386 and clinched. The strength against external force in the shear direction of the lower frame 31 (FIG. 19B and FIG. 20) can thereby be raised. Particularly in such cases, by respectively providing the fixing holes 346H1 and 386H1 at the lower side at positions substantially directly below the fixing holes 44H1 and 84H1 at the upper side, force can be distributed substantially evenly between the upper and lower rivets R when imparted with external force in the shear direction. This enables the resistance to external force to be raised. Similar applies to other fastening portions of the lower frame 31, such as at the left front portion.

Figure 22A:
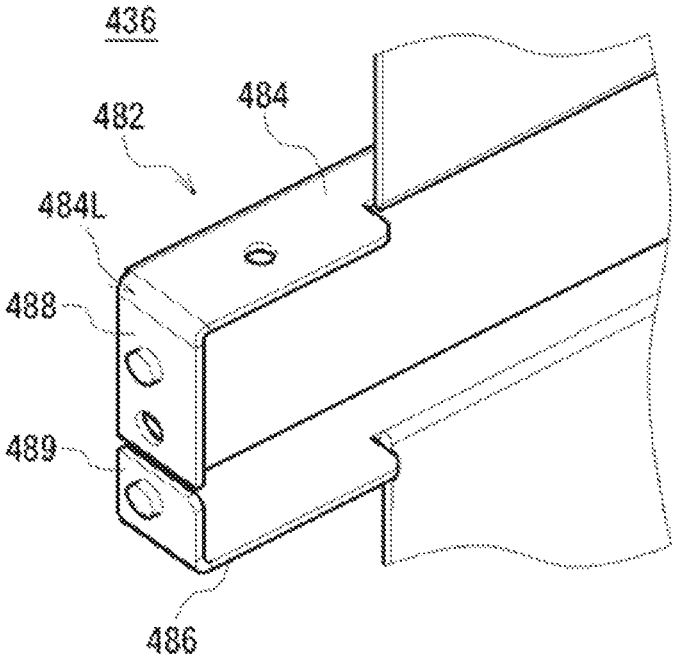
FIG. 22A is a schematic perspective view illustrating a configuration of a reinforcement portion of another exemplary embodiment.
Figure 22B:
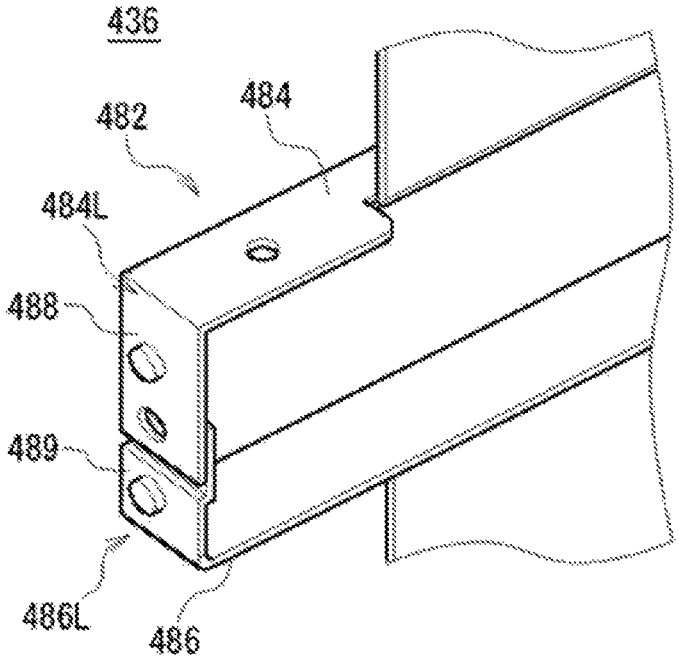
FIG. 22B is a schematic perspective view illustrating a configuration of a reinforcement portion of another exemplary embodiment.

In the exemplary embodiment described above, a case has been explained in which the left face portion 88 extended perpendicularly toward the front (FIG. 11A) from the left end of the rear face portion 85 on the reinforcement portion 82 of the rear side plate 36. However, the present invention is not limited thereto and, for example as illustrated in FIG. 22A, an upper left face portion 488 may be provided so as to extend perpendicularly downward from the left end of an upper face portion 484 of a rear side plate 436, corresponding to the rear side plate 36, and a lower left face portion 489 may be provided extending perpendicularly upward from the left end of a lower face portion 486. In such cases, positioning projections 488P1 and 488P2, and fixing holes 488H1, may be respectively provided to the upper left face portion 488 and the lower left face portion 489. In such cases, even if force acts in the shear direction after fastening (FIG. 20 and FIG. 19B), due to the bent location 484L having some length along the front-rear direction, force can be distributed in this area and borne thereby. Moreover, in such cases, as long as there is sufficient strength in the bent location 484L, the rivet R and the fixing hole 84H1 etc. on the upper face portion may be omitted. Moreover, for example as illustrated in FIG. 22B, the lower left face portion 489 may be extended upward and partly overlapped with the upper left face portion 488. A fixing hole may then be pierced through the overlapping portions, and a rivet R inserted through both portions and clinched. In such cases, force in the shear direction can also be borne by a bent location 486L at the lower side in addition to by the bent location 484L at the upper side. Similar applies to other fastening portions of the lower frame 31, such as at the left front portion.

Figure 23A:
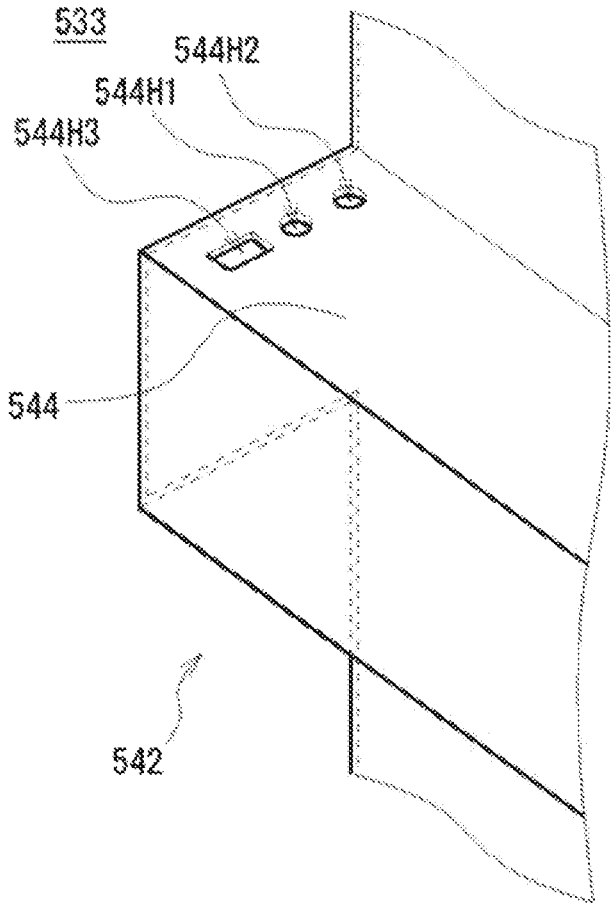
FIG. 23A is a schematic perspective view illustrating a configuration of a reinforcement portion of another exemplary embodiment.
Figure 23B:
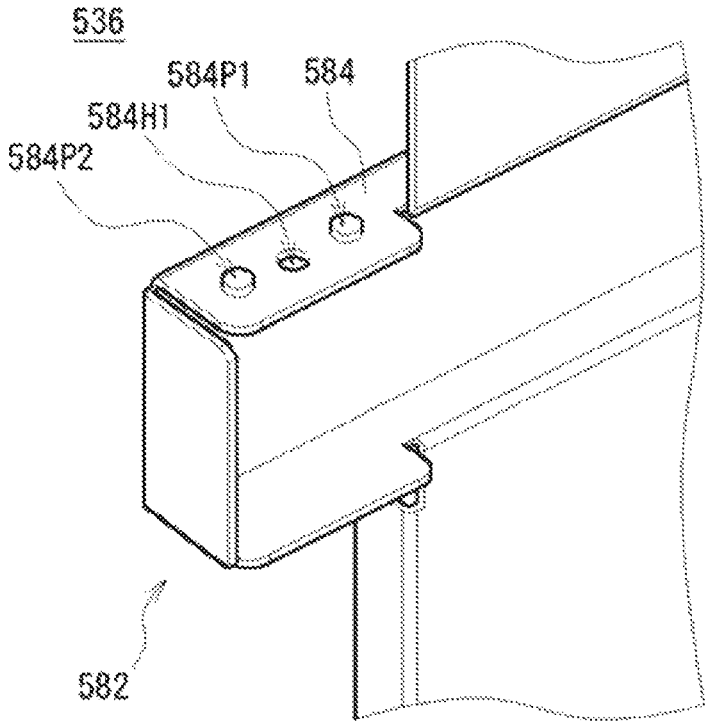
FIG. 23B is a schematic perspective view illustrating a configuration of a reinforcement portion of another exemplary embodiment.

Moreover, in the exemplary embodiment described above, a case has been explained in which the fixing hole 45H1 and the positioning holes 45H2 and 45H3 are formed in the left face portion 45 of the reinforcement portion 42 on the left side plate 33, and the fixing hole 88H1 and the positioning projections 88P1 and 88P2 are provided in the left face portion 88 of the reinforcement portion 82 on the rear side plate 36 (FIG. 8A and FIG. 11A). However, the present invention is not limited thereto and, for example as illustrated in FIG. 23A and FIG. 23B, a fixing hole 544H1 and positioning holes 544H2 and 544H3 may be formed in an upper face portion 544 of a reinforcement portion 542 on a left side plate 533, and a fixing hole 584H1 and positioning projections 584P1 and 584P2 may be provided on an upper face portion 584 of a reinforcement portion 582 on a rear side plate 536. In such cases, by fastening both portions together, the strength of the lower frame 31 to external force in the shear direction (FIG. 19B and FIG. 20) can be sufficiently raised. Moreover, in such cases, fixing by the rivet R may be omitted at other faces, such as at the left face portion etc. Furthermore, there is no limitation to the upper face portion of the reinforcement portions such as the reinforcement portion 42, and such configuration may also be provided at a lower face portion. Similar applies to other fastening portions of the lower frame 31, such as at the left front portion.

Figure 24:
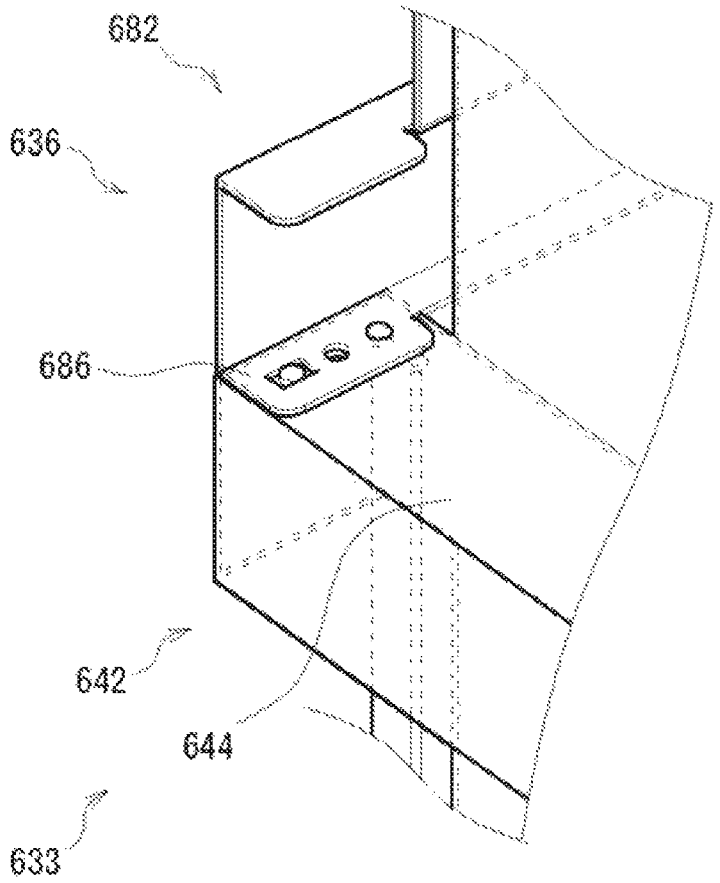
FIG. 24 is a schematic perspective view illustrating a configuration of a reinforcement portion of another exemplary embodiment.

Furthermore, in the exemplary embodiment described above, a case has been explained in which, the heights of the reinforcement portions are aligned so as to be substantially the same as each other at locations where reinforcement portions are fastened together, and fastening is performed in a state in which upper face portions and lower face portions have been respectively overlapped with each other (FIG. 8A, FIG. 8B, and FIG. 11A). However, the present invention is not limited thereto and, for example as with the left side plate 633 and rear side plate 636 illustrated in FIG. 24, a reinforcement portion 682 may be provided at a position higher than a reinforcement portion 642, and an upper face portion 644 of the reinforcement portion 642 overlapped with a lower face portion 686 of the reinforcement portion 682 and fastened. Alternatively, in an opposite configuration thereto, the reinforcement portion 682 may be provided at a lower position that that of the reinforcement portion 642. Similar applies to other fastening portions of the lower frame 31, such as at the left front portion.

Figure 25A:
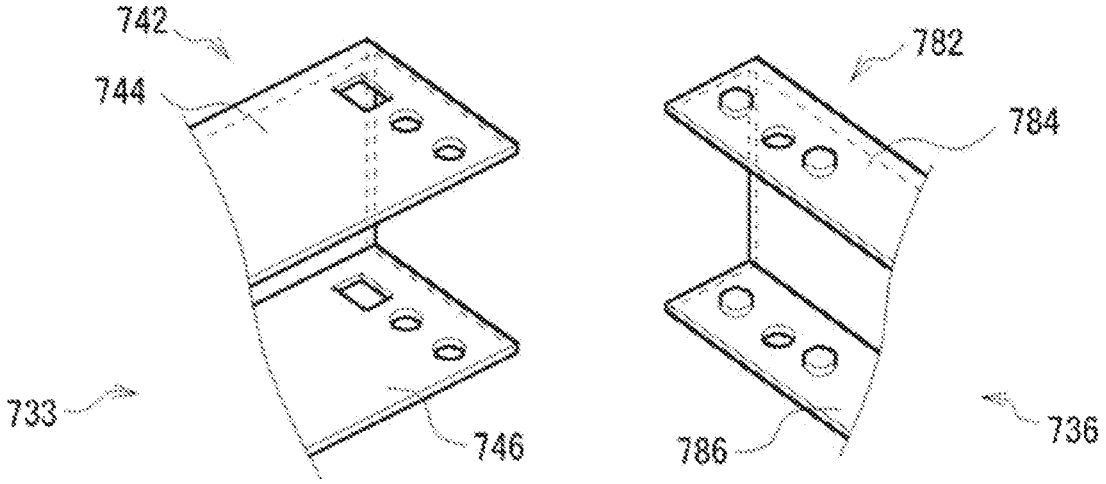
FIG. 25A is a schematic perspective view illustrating a configuration of a reinforcement portion of another exemplary embodiment.
Figure 25B:
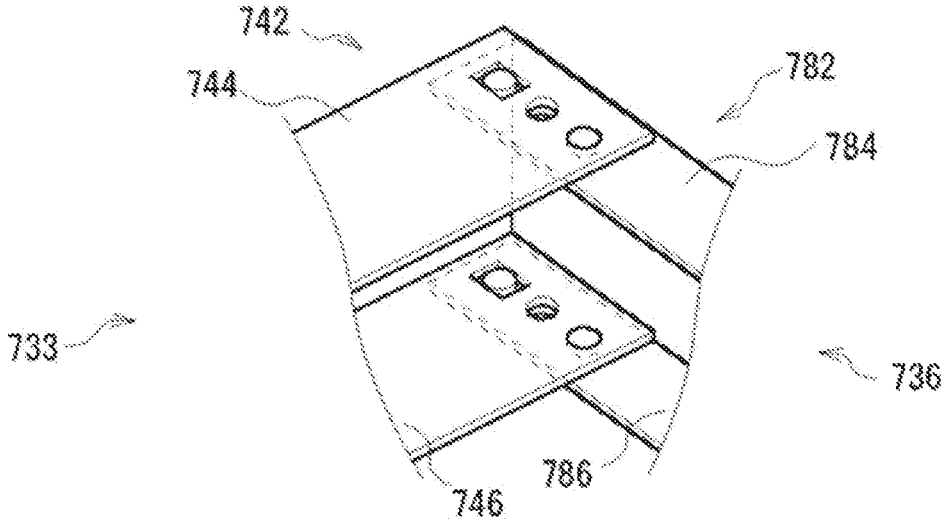
FIG. 25B is a schematic perspective view illustrating a configuration of a reinforcement portion of another exemplary embodiment.

Moreover, in the exemplary embodiment described above, a case has been explained in which, at locations where reinforcement portions are fastened together, one of the reinforcement portions (for example, the reinforcement portion 42 on the left side plate 33) is disposed so as to cover the outside of the other reinforcement portion (for example, the reinforcement portion 82 of the rear side plate 36), and sheet metal to be fixed together with the rivets R is overlapped (FIG. 8A, FIG. 8B, and FIG. 11A). However, the present invention is not limited thereto, and, for example as with a left side plate 733 and rear side plate 736 illustrated in FIG. 25A and FIG. 25B), positioning projections may be respectively projected upward from an upper side of an upper face portion 784 and an upper side of a lower face portion 786 of a reinforcement portion 782. In such cases, an upper face portion 744 of a reinforcement portion 742 may be overlapped at the upper side of the upper face portion 784 of the reinforcement portion 782, and a lower face portion 746 of the reinforcement portion 742 may be overlapped at the upper side of the lower face portion 786 of the reinforcement portion 782. Each of the positioning projections may then be inserted into each of the positioning holes, and then these riveted together with the rivets R and clinched. This enables the reinforcement portions to be fastened together at least as strongly as is in the configurations illustrated in FIG. 23A and FIG. 23B. Furthermore, in such cases the positioning projections and positioning holes may be provided, and clinching with the rivets R performed, at only one out of the upper face portion or the lower face portion. Similar applies to other fastening portions of the lower frame 31, such as at the left front portion.

Furthermore, in the exemplary embodiment described above, a case has been explained in which the reinforcement portions such as the reinforcement portion 42 on the lower frame 31 are disposed at positions higher than the center of gravity 17G of the banknote cassettes 17 when loaded into the banknote cassette loading space 31SB (FIG. 17). However, the present invention is not limited thereto, and, for example, the reinforcement portions such as the reinforcement portion 42 may be disposed at positions lower than the center of gravity 17G of the banknote cassettes 17 when loaded into the banknote cassette loading space 31SB.

Furthermore, in the exemplary embodiment described above, a case has been explained in which the reinforcement portions such as the reinforcement portion 42 on the left side plate 33 of the lower frame 31 are formed so as to have rectangular shapes in cross-section profile (FIG. 7A, FIG. 7B, FIG. 9A to FIG. 9C, and FIG. 10A and FIG. 10B). However, the present invention is not limited thereto, and various profiles may be employed for the cross-section profile, for example, a polygonal profile such as a triangular profile, or a semi-circular profile or semi-elliptical profile. In such cases, at portions where the reinforcement portions are fastened together, extending portions may be provided so as to overlap sheet metal, as with the left face portion 88 (FIG. 11A). Moreover, the cross-section profiles of the reinforcement portions on each of the side plates may be made different from each other.

Furthermore, in the exemplary embodiment described above, a case has been explained in which there is a difference in the length of projection of each of the reinforcement portions from each of the side plates, such as the length L54 of the upper face portion 54 (FIG. 9C) of the reinforcement portion 52 on the right side plate 34 being longer than the length L44 of the upper face portion 44 (FIG. 7B) of the reinforcement portion 42 on the left side plate 33. However, the present invention is not limited thereto, and, for example, the lengths that each of the reinforcement portions project out from each of the side plates may be aligned the same as each other. Moreover, a length that a reinforcement portion on a single side plate projects out from the respective side plate may be made different at each part of the reinforcement portion.

Furthermore, in the exemplary embodiment described above, a case has been explained in which the reinforcement portions such as the reinforcement portion 42 of the left side plate 33 on the lower frame 31 are formed in straight line shapes along a horizontal direction (FIG. 6 etc.). However, the present invention is not limited thereto, and, for example, the reinforcement portion 82 of the rear side plate 36 may be formed with various profiles, such as being inclined so that the right edge is higher than the left edge, or bent into a curved profile or the like as viewed from the rear side. Similar applies to other reinforcement portions. In such cases, the curved reinforcement portions etc. may be formed, for example, by processing technology such as pressing on metal sheets.

Furthermore, in the exemplary embodiment described above, a case has been explained in which the reinforcement portions such as the reinforcement portion 42 are formed at one location on each of the side plates such as the left side plate 33. However, the present invention is not limited thereto, and, for example, reinforcement portions may be provided at two or more locations on each of the side plates. In such cases, the strength of each of the side faces against warping (FIG. 19A) can be raised due to the increase in the number of reinforcement portions provided on each of the side plates, and the strength against shearing can moreover be raised due to the increase in the number of fastening locations where the reinforcement portions are fastened together (FIG. 19B).

Furthermore, in the exemplary embodiment described above, a case has been explained in which the reinforcement portion 42, for example, is provided on the left side plate 33 further to the left side than the upper sheet shaped portion 41 and the lower sheet shaped portion 43, namely, at a position projecting out to the opposite side to the banknote cassette loading space 31SB side, namely outwards (FIG. 5B etc.). However, the present invention is not limited thereto, and, on some or all of the side plates, a reinforcement portion may be provided to an upper sheet shaped portion or the like, on the same side as the banknote cassette loading space 31SB, namely inwards.

Furthermore, in the exemplary embodiment described above, a case has been explained in which sheet metal of the reinforcement portions is fastened together by rivets R (FIG. 8B and FIG. 8C). However, the present invention is not limited thereto, and the sheet metal of the reinforcement portions may be fixed together with screws, for example. Such cases enable easy disassembly, such as for maintenance work or the like, and easy re-assembly. Alternatively, the sheet metal of the reinforcement portions may be fixed together by welding, for example. Such cases enable the number of components to be reduced since rivets R are no longer needed.

Furthermore, in the exemplary embodiment described above, a case was explained in which the reinforcement portions 42 and 82 are fastened together by inserting the positioning projections such as the positioning projection 88P1 into the positioning hole 45H2 etc., and inserting the rivets R through the fixing holes 45H1 and 88H1 and then clinching (FIGS. 8A to 8C, and FIG. 11A). However, the present invention is not limited thereto, and, for example, the positioning projections and the positioning holes may be omitted in cases in which sufficient positioning precision can be secured by the rivets R.

Furthermore, in the exemplary embodiment described above, a case has been explained in which, at the portions where the reinforcement portions are fastened together, the positioning holes such as the positioning hole 45H2 are provided at the outside (for example, at the reinforcement portion 42 side of the left side plate 33), and the positioning projections such as the 88P1 are provided at the inside (for example, at the reinforcement portion 82 side of the rear side plate 36) (FIG. 8A and FIG. 11A). However, the present invention is not limited thereto, and, for example, a positioning projection that projects toward the inside may be provided to the left side plate 33 side for positioning at the outside, and a positioning hole may be formed in the rear side plate 36 side for positioning at the inside.

Furthermore, in the exemplary embodiment described above, a case has been explained in which portions where the reinforcement portions are fastened together are configured with one positioning hole 45H2 that is a round hole, and another positioning hole 45H3 that is an angular hole, namely, a rectangular shaped hole (FIG. 8A). However, the present invention is not limited thereto, and various shaped holes may be employed as the positioning hole 45H2, for example, such as a square shape or hexagonal shape. It is sufficient as long as movement in the front-rear direction and the up-down direction at the positioning projection 88P1 is restricted. Alternatively, the other positioning hole 45H3 may be an elongated hole. Namely, various shapes, such as a rectangular shape including two opposing sides having a shape curved into circular arc shapes, or the like may be employed for the positioning hole 45H3. Put succinctly, it is sufficient as long as movement in a rotational direction about the positioning hole 45H2 is restricted.

Furthermore, in the exemplary embodiment described above, a case has been explained in which the positioning projections 88P1 and 88P2 at the portions where the reinforcement portions are fastened together are both short circular pillar shaped (FIG. 11A). However, the present invention is not limited thereto, and various shapes may be employed therefor, for example short square pillar shapes, short hexagonal pillar shapes, or the like. Moreover, the shapes of the positioning projections 88P1 and 88P2 may be different from each other.

Furthermore, in the exemplary embodiment described above, a case has been explained in which the left side plate 33 and the like are configured from a metal sheet shaped material, and the reinforcement portions are formed by bending the sheet shaped material. However, the present invention is not limited thereto, and the reinforcement portions may, for example, be formed by attaching a rod shaped member to the left side plate 33 so as to run along the front-rear direction.

Furthermore, in the exemplary embodiment described above, a case has been explained in which a space is formed by surrounding the five banknote cassette loading spaces 31SB as a whole using the left side plate 33, the right side plate 34, the front side plate 35, and the rear side plate 36, and then dividing this space using the four divider plates 37 (FIG. 5B). However, the present invention is not limited thereto, and, for example, the five banknote cassette loading spaces 31SB may be formed by surrounding single banknote cassette loading spaces 31SB by four side plates including reinforcement portions, and then connecting five of these single spaces together along the front-rear direction.

Furthermore, in the exemplary embodiment described above, a case has been explained in which the cassette-side connector 139 is provided at the rear face side of the banknote cassette 17, and the loading-section-side connector 98 is provided at the rear side of the banknote cassette loading space 31SB (FIG. 13A to FIG. 13C). However, the present invention is not limited thereto, and, for example, a cassette-side connector 139 may be provided on a rear face side and a front face side of the banknote cassette 17, and loading-section-side connectors 98 provided at corresponding positions on the banknote cassette loading space 31SB. In such cases, the cassette-side connectors 139 should be provided at positions inside the cassette casing 130 of the banknote cassette 17 that do not impinge on the storage space 130S (FIG. 16).

Furthermore, in the exemplary embodiment described above, a case has been explained in which the loading-section-side connector 98 is provided on the right lower support section 92, which is disposed at the right rear side of the banknote cassette loading space 31SB, and the positioning pin 95 is provided on the left lower support section 91, which is disposed at the left rear side of the banknote cassette loading space 31SB (FIG. 11, FIG. 12, and FIG. 13A to FIG. 13C). However, the present invention is not limited thereto, and, for example, the positioning pin 95 may be provided at the right side and the left side of the loading-section-side connector 98 on the right lower support section 92. In such cases, the left lower support section 91 and the left lower indentation 134 on the banknote cassette 17 side may be omitted. Alternatively, in addition to the positioning pin 95 of the left lower support section 91, another positioning pin may be added in the vicinity of the loading-section-side connector 98.

Furthermore, in the exemplary embodiment described above, a case has been explained in which the positioning projection 62 is provided to each of the right internal side plates 38 on the lower frame 31, and the positioning groove 140 is provided on the right side face of each of the banknote cassettes 17, such that the banknote cassettes 17 are positioned by combining the positioning projections 62 and the positioning grooves 140 (FIG. 9A to FIG. 9C, FIG. 13A to FIG. 13C, and FIG. 15A, FIG. 15B). However, the present invention is not limited thereto, and, for example, positioning grooves may be provided on the left side face and the front side face of the banknote cassettes 17, and positioning projections may be provided at corresponding positions on the lower frame. Moreover, positioning projections may be provided on the banknote cassette 17 side, and positioning grooves may be provided on the lower frame 31 side. Furthermore, instead of the positioning projections 62 that run along the up-down direction, one or more short circular pillar shaped projection, such as the positioning projection 124 on the reject loading section 39, may be provided. Alternatively, the positioning projections 62 and the positioning groove 140 may be omitted in cases in which sufficient positioning precision can be achieved using the positioning pin 95, for example.

Furthermore, in the exemplary embodiment described above, a case has been explained in which, the left lower support section 91 and the right lower support section 92 are disposed in the vicinity of the lower edge of the rear side plate 36 and the divider plates 37 (FIG. 11 and FIG. 12). However, the present invention is not limited thereto, and, for example, the left lower support section 91 and the right lower support section 92 may be provided slightly to the upper side of the lower edge of the rear side plate 36. Moreover, the heights of the left lower support section 91 and the right lower support section 92 may be different from each other. In such cases, heights of the top faces 136 and 138 on the left lower indentation 134 and the right lower indentation 135 should be appropriately determined on the banknote cassette 17 side according to the respective heights of the left lower support section 91 and the right lower support section 92.

Furthermore, in the exemplary embodiment described above, a case has been explained in which the reject cassette loading space 31SR is formed by installing the reject loading section 39 at the front side of the front side plate 35 (FIG. 5A, FIG. 5B, and FIG. 6). However, the present invention is not limited thereto, and, for example, the reject cassette loading space 31SR may be formed by the addition of a single divider plate at the rear side of the front side plate 35.

Moreover, in the above exemplary embodiment, a case has been explained in which there are five banknote cassette loading spaces 31SB and one reject cassette loading space 31SR provided on the lower frame 31 (FIG. 5A, FIG. 5B). However, the present invention is not limited thereto and, for example, the reject cassette loading space 31SR may be omitted, and only the banknote cassette loading spaces 31SB provided. The number of the banknote cassette loading spaces 31SB may also be four or less, or six or more. Furthermore, a space may also be provided for loading a cassette for another purpose.

Furthermore, in the exemplary embodiment described above, a case has been explained in which portions positioned at the rearmost side of the rear raised portions 77 formed to the front side plate 35 are formed with planar shapes, and these planar shapes are placed in close proximity to or placed in contact with the banknote cassettes 17 (FIG. 10A, FIG. 10B). However, the present invention is not limited thereto and, for example, the raised portion 101 (FIG. 12) of each of the divider plates 37 may have a profile so as to run along the up-down direction, and ridge portions running along the up-down direction, namely, elongated line shaped portions, may be placed in close proximity to or placed in contact with the banknote cassettes 17. Alternatively, the rear raised portions 77 may be formed by processing technology other than "drawing" or "deep drawing", for example by pressing or the like. Similar applies to the front raised portions 87 of the rear side plate 36, and the rear raised portions 77 and the front raised portions 87 of the divider plates 37 etc.

Furthermore, in the exemplary embodiment described above, a case has been explained in which the right internal side plates 38 of the lower frame 31 (FIG. 9A, FIG. 9C) are each configured as a molded component made from a resin material. However, the present invention is not limited thereto and, for example, the right internal side plates 38 may each be configured by appropriate processing metal sheet. Alternatively, the lower right face portion 57 of the right side plate 34 may positioned substantially directly below the upper sheet shaped portion 51, and the right internal side plates 38 omitted. In such cases, the positioning projections 62 etc. may be formed by processing such as "drawing" on the lower right face portion 57.

Furthermore, in the exemplary embodiment described above, a case has been explained in which the bent portions such as the bent portion 41B are provided by bending an upper edge of the left side plate 33 etc. of the lower frame 31 back toward the opposite side to the banknote cassette loading space 31SB side. However, the present invention is not limited thereto, and, for example, the bent portion 41B may be omitted. In such cases, for example, cut faces of sheet metal at the position of the upper edge of the left side plate 33 may be subjected to rounding, or alternatively a protective member may be attached thereto. Put succinctly, it is sufficient to adopt a measure enabling the prevention of injury when touched by the hand of an operator or the like, and damage when making contact with the banknote cassettes 17. Similar applies to other portions.

Furthermore, in the exemplary embodiment described above, a case has been explained in which the left side of the lower frame 31 is the maintenance face side and the right side of the lower frame 31 is the non-maintenance face side, by configuring the lower frame 31 with the upper edge of the right side plate 34 lower than the upper edge of the left side plate 33 (FIG. 5B). However, the present invention is not limited thereto, and, for example, by left-right transposing the exemplary embodiment, namely by configuring the upper edge of the right side plate 34 lower than the upper edge of the left side plate 33, the right side of the lower frame 31 may be the maintenance face side and the left side of the lower frame 31 the non-maintenance face side.

Furthermore, in the exemplary embodiment described above, a case has been explained in which the reject cassette 18 (FIG. 18A, FIG. 18B) receives power supplied from the loading-section-side connector 128 through the cassette-side connector 166, rotates an internal motor and rollers (not illustrated in the drawings), and also sends and receives electrical signals. However, the present invention is not limited thereto, and, for example, electrical signals alone may be sent and received through the cassette-side connector 166 and the like, without power being supplied. In such cases, for example, a main-unit-side gear may be provided at the lower unit 10L side (FIG. 2), with drive force transmitted to the main-unit-side gear from a predetermined motor at a top face inside the safe casing 30, and a cassette-side gear may be provided to transmit the drive force to internal rollers and the like at an upper portion on the reject cassette 18 side. In such cases, drive force can be transmitted from the lower unit 10L side to the reject cassette 18 side by meshing the main-unit-side gear with the cassette-side gear when the lower frame 31 is in a state housed in the safe casing 30 (FIG. 2), so as to rotate the rollers and the like inside the reject cassette 18. Particularly in such cases, there is no need to provide a motor, nor wiring lines or connection terminals etc. for power supply on the reject cassette 18 side. This enables the reject cassette 18 to be simplified and more compact, and enables a reduction in weight to be achieved. Similar applies to the banknote cassettes 17.

Furthermore, in the exemplary embodiment described above, a case has been explained in which the present invention is applied to the automated teller machine 1 handling banknotes as the medium. However, the present invention is not limited thereto, and, for example, application may be made to various devices handling various paper sheet shaped media, such as securities and shopping coupons, or cash vouchers and the like.

The present invention is also not limited to the above exemplary embodiment and other exemplary embodiments. Namely, the application scope of the present invention encompasses exemplary embodiments arising from selected combinations of some or all of the exemplary embodiment described above and the other exemplary embodiments described above, and exemplary embodiments arising from extracting parts therefrom.

Furthermore, in the exemplary embodiment described above, a case has been explained in which the banknote pay-in/pay-out machine 10 serving as a medium processing device is configured by the banknote cassettes 17 serving as storage cassettes, the safe casing 30 serving as a casing, the lower frame 31 serving as a loading section, the side rails 32 serving as slide rails, and the loading-section-side connector 98 serving as a connector. However, the present invention is not limited thereto, and a medium processing device may be configured by a storage cassette, a casing, a loading section, slide rails, and a connector of various other configurations.

INDUSTRIAL APPLICABILITY

Exemplary embodiments of the present invention may, for example, be utilized in an automated teller machine that performs transactions related to banknotes with a customer.

The entire discloser of Japanese Patent Application No. 2015-250028 is incorporated by reference in the present specification.

All cited documents, patent applications and technical standards mentioned in the present specification are incorporated by reference in the present specification to the same extent as if the individual cited documents, patent application, or technical standard was specifically and individually indicated to be incorporated by reference.

The invention claimed is:

1. A medium processing device comprising:

a plurality of storage cassettes configured to store a medium, each of the storage cassettes having a projection;

a casing including an internal space to house the plurality of storage cassettes inside;

a loading section that supports the plurality of storage cassettes when the plurality of storage cassettes are in a loaded state in a loading space having an open bottom section, and includes a plurality of divider plates for dividing the loading space, each divider plate having an upper edge;

a slide rail that is attached to the casing and to the loading section, and that lets the loading section move between the internal space of the casing and outside; and a plurality of connectors that are provided inside the loading space of the loading section, and that electrically connect to the plurality of storage cassettes in a loaded state of the plurality of storage cassettes in the loading space, wherein each of the projections of each of the storage cassettes contacts a corresponding one of the upper edges of each of the divider plates in a one-to-one arrangement, and restricts a housing position of each of the storage cassettes.

2. The medium processing device of claim 1, wherein the loading section further comprises:

one face side plate at one face side parallel to a movement direction of the loading section using the slide rail;

another face side plate that is provided at another face side on the opposite side to the one face side, and that has a length from the bottom section to an upper edge longer than that of the one face side plate; and a first intersecting face side plate and a second intersecting face side plate that are respectively provided at a first intersecting face side and a second intersecting face side intersecting with the movement direction, and that are connected to the one face side plate and the other face side plate.

3. The medium processing device of claim 2, wherein a part of each of the one face side plate, the other face side plate, the first intersecting face side plate, and the second intersecting face side plate includes a reinforcement portion that is bent so as to project out more toward the outside or inside of the loading space than the periphery of the reinforcement portion.

4. The medium processing device of claim 3, wherein the reinforcement portions are fastened together on mutually connected side plates from out of the one face side plate, the other face side plate, the first intersecting face side plate, and the second intersecting face side plate.

5. The medium processing device of claim 2, wherein:

the plurality of storage cassettes include a first storage cassette and a second storage cassette;

the loading section includes a first loading-section-side positioning portion to position the first storage cassette with respect to the loading space;

the first storage cassette includes a first cassette-side positioning portion to engage with the first loading-section-side positioning portion; and the second storage cassette includes a second cassette-side positioning portion to engage with the second loading-section-side positioning portion.

6. The medium processing device of claim 5, wherein:

the plurality of connectors include a first loading-section-side connector and a second loading-section-side connector;

the first storage cassette and the second storage cassette are loaded into the loading space from above to below;

the first loading-section-side connector and the second loading-section-side connector are disposed below the loading space in the loading section;

the first loading-section-side positioning portion is arranged at a same height as the first loading-section-side connector; and the second loading-section-side positioning portion is arranged at a same height as the second loading-section-side connector.

7. The medium processing device of claim 5, wherein:

the loading section includes another first loading-section-side positioning portion to position the first storage cassette with respect to the loading space and another second loading-section-side positioning portion to position the second storage cassette with respect to the loading space, the another first loading-section-side positioning portion and the another second loading-section-side positioning portion being provided on the other face side plate;

the first storage cassette includes another first cassette-side positioning portion to engage with the another first loading-section-side positioning portion; and the second storage cassette includes another second cassette-side positioning portion to engage with the another second loading-section-side positioning portion.

8. The medium processing device of claim 5, wherein:

the plurality of connectors include a first loading-section-side connector and a second loading-section-side connector of the loading section;

the first storage cassette includes a first cassette-side connector to connect to the first loading-section-side connector of the loading section;

the second storage cassette includes a second cassette-side connector to connect to the second loading-section-side connector of the loading section;

the first cassette-side connector and the first cassette-side positioning portion are disposed in an indentation formed in an external profile of the first storage cassette so as to be indented inward from a surface of the cassette casing; and the second cassette-side connector and the second cassette-side positioning portion are disposed in an indentation formed in an external profile of the second storage cassette so as to be indented inward from a surface of the cassette casing.

9. The medium processing device of claim 2, wherein:

the one face side is a maintenance face side where an operator is positioned when maintenance work is performed on the loading section by the operator; and the other face side is a non-maintenance face side on the opposite side of the loading section to the maintenance face side.

10. The medium processing device of claim 2, wherein the one or more divider plates are fastened to the one face side plate and to the other face side plate, and divide the loading space by dividing a space surrounded by the one face side plate, the other face side plate, the first intersecting face side plate, and the second intersecting face side plate.

11. The medium processing device of claim 1, wherein the projection includes a flat face portion that contacts the divider plate, and an inclined face portion inclined from a side face of each of the storage cassettes toward an end of the flat face portion.

12. A medium transaction device, comprising:

a plurality of storage cassettes configured to internally store a medium to be transacted with a user or a transacted medium, each of the storage cassettes having a projection;

a casing including an internal space to house the plurality of storage cassettes inside;

a loading section that supports the plurality of storage cassettes when the plurality of storage cassettes are in a loaded state in a loading space having an open bottom section, and includes a plurality of divider plates for dividing the loading space, each divider plate having an upper edge;

a slide rail that is attached to the casing and to the loading section, and that lets the loading section move between the internal space of the casing and outside; and a plurality of connectors that are provided inside the loading space of the loading section, and that electrically connect to the plurality of storage cassettes in a loaded state of the plurality of storage cassettes in the loading space, wherein each of the projections of each of the storage cassettes contacts a corresponding one of the upper edges of each of the divider plates in a one-to-one, and restricts a housing position of each of the storage cassettes.

13. A medium processing device, comprising:

a storage cassette configured to store a medium;

a casing including an internal space to house the storage cassette inside;

a loading section that supports the storage cassette when the storage cassette is in a loaded state in a loading space having an open bottom section;

a slide rail that is attached to the casing and to the loading section, and that lets the loading section move between the internal space of the casing and outside; and a connector that is provided inside the loading space of the loading section, and that electrically connects to the storage cassette in a loaded state of the storage cassette in the loading space, wherein the loading section includes a first loading-section-side positioning portion to position the storage cassette with respect to the loading space, the storage cassette includes a first cassette-side positioning portion to engage with the first loading-section-side positioning portion and a cassette-side connector to connect to the connector of the loading section, and the cassette-side connector and the first cassette-side positioning portion are disposed in an indentation formed in an external profile of the storage cassette so as to be indented inward from a surface of the cassette casing.

14. The medium processing device of claim 13, wherein:

in the loading section, the storage cassette is loaded into the loading space from above to below;

the connector is disposed below the loading space in the loading section; and the first loading-section-side positioning portion is arranged at a same height as the connector.

15. The medium processing device of claim 14, wherein the loading section further comprises:

one face side plate at one face side parallel to a movement direction of the loading section using the slide rail;

another face side plate that is provided at another face side on the opposite side to the one face side, and that has a length from the bottom section to an upper edge longer than that of the one face side plate; and a first intersecting face side plate and a second intersecting face side plate that are respectively provided at a first intersecting face side and a second intersecting face side intersecting with the movement direction, and that are connected to the one face side plate and the other face side plate.

16. The medium processing device of claim 15, wherein:

in the loading section, another loading-section-side positioning portion is provided on the other face side plate to position the storage cassette with respect to the loading space; and the storage cassette includes another cassette-side positioning portion to engage with the second loading-section-side positioning portion.

17. The medium processing device of claim 15, wherein a part of each of the one face side plate, the other face side plate, the first intersecting face side plate, and the second intersecting face side plate includes a reinforcement portion that is bent so as to project out more toward the outside or inside of the loading space than the periphery of the reinforcement portion.

18. The medium processing device of claim 15, wherein the loading section further comprises one or more divider plates that are fastened to the one face side plate and to the other face side plate, and that divide the loading space by dividing a space surrounded by the one face side plate, the other face side plate, the first intersecting face side plate, and the second intersecting face side plate.

19. The medium processing device of claim 18, wherein a projection is formed on a side face of the storage cassette, the projection contacting an upper edge of the divider plate and restricting a housing position.

20. The medium processing device of claim 15, wherein:

the one face side is a maintenance face side where an operator is positioned when maintenance work is performed on the loading section by the operator; and the other face side is a non-maintenance face side on the opposite side of the loading section to the maintenance face side.

* * * * *